US012495915B2

(12) United States Patent
Ryan et al.

(10) Patent No.: US 12,495,915 B2
(45) Date of Patent: Dec. 16, 2025

(54) LOW-PROFILE PRODUCT MERCHANDIZER SYSTEMS

(71) Applicant: Retail Space Solutions LLC, Milwaukee, WI (US)

(72) Inventors: James M. Ryan, Fox Point, WI (US); Naveen Kumar Reddy Challa, Bengaluru (IN); Pavan Kumar R, Bangalore (IN)

(73) Assignee: Retail Space Solutions LLC, Milwaukee, WI (US)

( * ) Notice: Subject to any disclaimer, the term of this patent is extended or adjusted under 35 U.S.C. 154(b) by 0 days.

(21) Appl. No.: 18/731,576

(22) Filed: Jun. 3, 2024

(65) Prior Publication Data

US 2024/0407570 A1 Dec. 12, 2024

Related U.S. Application Data

(60) Provisional application No. 63/553,845, filed on Feb. 15, 2024, provisional application No. 63/588,458, filed on Oct. 6, 2023, provisional application No. 63/506,635, filed on Jun. 7, 2023.

(51) Int. Cl.
*A47F 1/12* (2006.01)
*A47F 5/00* (2006.01)

(52) U.S. Cl.
CPC ..... *A47F 1/126* (2013.01); *A47F 5/0043* (2013.01)

(58) Field of Classification Search
CPC ..... A47F 1/126; A47F 1/125; A47F 1/128; A47F 5/0043; A47F 5/005; A47B 61/02
USPC ..... 211/7, 59.3
See application file for complete search history.

(56) References Cited

U.S. PATENT DOCUMENTS 590,983 A * 10/1897 Herman ..... A47C 7/62 160/78
1,272,819 A * 7/1918 Linnett ..... A47G 25/746 312/334.3
1,748,068 A * 2/1930 Hood ..... A47B 61/02 211/105
1,861,273 A * 5/1932 Hood ..... A47B 61/02 33/8
2,185,605 A * 1/1940 Murphy ..... B65D 85/1081 206/805
2,538,165 A * 1/1951 Randtke ..... B42F 17/02 220/559

(Continued)

OTHER PUBLICATIONS

RTC Profit Pusher 3 Plus, admitted prior art.

(Continued)

*Primary Examiner* — Jennifer E. Novosad
(74) *Attorney, Agent, or Firm* — Andrus Intellectual Property Law, LLP

(57) ABSTRACT

A product merchandizer system for installation on a shelf includes a pusher assembly that pushes products with which the product merchandizer system is stocked toward a front end of the shelf and at least one partition configured to project upwardly from the shelf. A horizontal bar is supported above a rear end of the shelf. The pusher assembly has a rear end configured to be clipped to the horizontal bar and a front end configured to rest on the shelf. The partition also has a rear end configured to be clipped to the horizontal bar and a front end configured to rest on the shelf at the front end of the shelf.

22 Claims, 69 Drawing Sheets

(56) References Cited

U.S. PATENT DOCUMENTS 2,560,466 A * 7/1951 Meinke ..... A47B 77/14 211/105
2,562,982 A * 8/1951 Cieri ..... A47L 19/04 211/41.6
2,732,952 A * 1/1956 Skelton ..... A47F 1/126 221/60
3,393,948 A * 7/1968 Brefka ..... A47F 1/06 312/61
3,612,284 A * 10/1971 Stoltz ..... D06F 57/12 211/105
3,767,083 A * 10/1973 Webb ..... B65D 83/10 221/279
3,801,174 A * 4/1974 Kanarr ..... A47G 25/746 312/297
4,234,101 A * 11/1980 Pastore ..... A47F 1/065 221/241
4,588,093 A * 5/1986 Field ..... A47F 1/126 211/11
4,838,436 A * 6/1989 Bailey ..... B42F 17/14 211/10
5,161,702 A * 11/1992 Skalski ..... A47F 1/126 211/59.3
5,388,693 A * 2/1995 Ceraudo ..... B65D 83/00 206/340
5,605,237 A * 2/1997 Richardson ..... A47F 1/126 211/59.3
5,904,276 A * 5/1999 Chen ..... A45C 13/03 211/104
5,906,283 A * 5/1999 Kump ..... A47F 1/128 312/71
5,988,407 A * 11/1999 Battaglia ..... A47F 1/126 211/51
6,082,558 A * 7/2000 Battaglia ..... A47F 1/126 211/59.3
6,102,192 A * 8/2000 Tomuro ..... A47F 1/128 198/747
6,749,071 B2 * 6/2004 Caterinacci ..... A47F 1/126 211/59.3
6,886,700 B2 5/2005 Nagel
6,964,235 B2 11/2005 Hardy
7,032,761 B2 4/2006 Nagel
7,152,536 B2 12/2006 Hardy
7,497,342 B2 3/2009 Hardy
7,628,282 B2 12/2009 Hardy
7,854,334 B2 12/2010 Nagel
7,896,172 B1 * 3/2011 Hester ..... A47F 1/126 211/59.3
7,971,735 B2 7/2011 Mueller
8,016,128 B2 9/2011 Valiulis
8,096,427 B2 1/2012 Hardy
8,177,076 B2 5/2012 Rataiczak, III
8,342,340 B2 1/2013 Rataiczak, III
8,556,092 B2 10/2013 Valiulis
8,579,123 B2 11/2013 Mueller
8,627,965 B2 1/2014 Hardy
8,720,702 B2 5/2014 Nagel
8,752,717 B2 6/2014 Bird
8,893,901 B2 11/2014 Nagel
8,967,394 B2 3/2015 Hardy
8,978,904 B2 3/2015 Hardy
9,138,075 B2 9/2015 Hardy
9,215,938 B2 12/2015 Neumann
9,232,864 B2 1/2016 Hardy
9,241,583 B2 1/2016 Nagel
9,254,049 B2 2/2016 Nagel
9,259,102 B2 2/2016 Hardy
9,265,358 B2 2/2016 Hardy
9,320,367 B2 4/2016 Chambers
9,375,098 B2 * 6/2016 Sun ..... A47F 1/125
9,392,883 B2 7/2016 Kologe
9,468,309 B2 10/2016 Grubbs
9,629,480 B2 4/2017 Ewing
9,668,590 B1 * 6/2017 Bruegmann ..... A47F 1/126
9,730,528 B2 8/2017 Hardy
9,750,354 B2 9/2017 Hardy
9,820,585 B2 * 11/2017 Hardy ..... A47F 5/005
9,895,007 B2 2/2018 Hardy
9,986,852 B2 6/2018 Chenoweth
9,986,854 B2 * 6/2018 Riley ..... A47F 1/126
10,154,739 B2 12/2018 Turner
10,178,909 B2 1/2019 Hardy
10,441,092 B2 10/2019 Hardy
10,492,627 B2 12/2019 Nagel
10,555,623 B2 2/2020 Kologe
10,702,076 B2 * 7/2020 Mercier ..... A47F 5/083
10,758,061 B2 * 9/2020 McDonald ..... B65B 5/026
10,842,294 B2 11/2020 Nagel
10,959,540 B2 3/2021 Padvoiskis
10,959,541 B2 3/2021 Everett
10,974,901 B1 * 4/2021 Vlaming ..... A47F 1/126
11,178,980 B2 * 11/2021 Pongrac ..... A47F 1/126
11,510,506 B1 * 11/2022 Farinola ..... A47B 57/583
11,627,818 B2 * 4/2023 Hua ..... A47F 1/126 211/59.3
2007/0108142 A1 * 5/2007 Medcalf ..... A47F 1/126 211/59.3
2012/0217212 A1 * 8/2012 Czalkiewicz ..... A47F 1/12 211/59.2
2014/0263395 A1 * 9/2014 Gunderson ..... G07F 11/70 221/221
2018/0199735 A1 * 7/2018 Jones ..... A47F 1/10
2020/0060438 A1 2/2020 Chenoweth
2021/0052087 A1 2/2021 Nagel
2021/0137265 A1 5/2021 Liedtke
2021/0219742 A1 7/2021 Nagel
2022/0000282 A1 1/2022 Hardy
2022/0031090 A1 2/2022 Nagel
2022/0047098 A1 2/2022 Ewing
2024/0407570 A1 * 12/2024 Ryan ..... A47F 5/0043

OTHER PUBLICATIONS

Trion EWT Expandable Wire Tray Pizza, admitted prior art.
Siffron Next Pizza Trays, admitted prior art.
Siffron Frozen Pizza Rack, admitted prior art.
Carlson Airflo Freezer Self Facer, admitted prior art.

* cited by examiner

LOW-PROFILE PRODUCT MERCHANDIZER SYSTEMS

CROSS-REFERENCE TO RELATED APPLICATIONS

The present application claims the benefit of U.S. Provisional Application No. 63/506,635, filed Jun. 7, 2023; U.S. Provisional Application No. 63/588,458, filed Oct. 6, 2023; and U.S. Provisional Application No. 63/553,845, filed Feb. 15, 2024, each of which is hereby incorporated by reference herein in its entirety.

FIELD

The present disclosure relates to product merchandizer systems and more specifically to product merchandizer systems utilizing a pusher paddle to front-face products on a shelf.

BACKGROUND

The following patents are provided by way of background information and are hereby incorporated herein by reference.

U.S. Pat. No. 9,215,938 discloses a product display system including a plurality of brackets, a plurality of shelves, and a plurality of products. Each bracket is configured to mechanically engage a support structure. Each shelf is mechanically engaged with at least one bracket. The shelves form a first row, a second row, a third row, a first column, a second column, and a third column. The first row is adjacent the second row, and the second row is adjacent the third row. The first column is adjacent the second column, and the second column is adjacent the third column. Each product is supported by one of the shelves. The shelves are arranged such that the distance between the shelves in the first column and the third column is smaller than the width of the product supported by the shelves in the second column.

U.S. Pat. No. 10,154,739 discloses a universal front-facing merchandiser having a front rail having a first mating structure and a plurality of integrated pusher and divider assemblies. Each divider assembly includes a second mating structure that corresponds to and mates with the first mating structure to couple the integrated pusher and divider assemblies to the front rail. The mating structures of each pusher and divider assembly and the front rail are movable between a first position where the integrated pusher and divider assembly is coupled to and laterally movable about the front rail and is not removable from the front rail without force being applied to the integrated pusher and divider assembly and a second position where the integrated pusher and divider assembly is secured to the front rail in a desired position in a manner that hinders lateral movement of the integrated pusher and divider assembly.

U.S. Pat. No. 10,959,540 discloses a shelf management system having a tray defining a first mating structure and a second mating structure, a shelf management component having a spring biased pusher connected thereto and movable between a first position wherein the pusher is extended to a rear of the shelf management component and a second position wherein the pusher is retracted to a front of the shelf management component, and an interstitial member positioned between the shelf management component and the tray to secure the shelf management component to the tray and hinder lateral movement of the shelf management component with respect to the tray. Improved components of the shelf management system are also disclosed as are methods relating to same.

U.S. Pat. No. 10,959,541 discloses a display unit for a merchandise display system, comprising: a support surface for supporting a plurality of merchandise items, the support surface defining a travel path for said plurality of merchandise items between a rear of the display unit and a front of the display unit; a pusher element disposed for movement relative to said support surface along said travel path; an actuation member coupleable to said pusher element and operative to control movement of said pusher element; a releasable coupling for coupling said pusher element to said actuation member, said releasable coupling configured to couple said pusher element to said actuation member when an actuation force is applied to said actuation member, and to uncouple said pusher element from said actuation member when said actuation force applied to said actuation member exceeds a threshold.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to an exemplary embodiment of the present disclosure, a product merchandizer system configured to be installed on a shelf comprises a pusher assembly configured to push products with which the product merchandizer system is stocked toward a front end of the shelf and at least one partition configured to project upwardly from the shelf. A horizontal bar is supported above a rear end of the shelf. The pusher assembly comprises a rear end configured to be clipped to the horizontal bar and a front end configured to rest on the shelf. The at least one partition comprises a rear end configured to be clipped to the horizontal bar and a front end configured to rest on the shelf at the front end of the shelf.

According to some aspects, the pusher assembly comprises a paddle, a spring that biases the paddle toward the front end of the shelf, and an extensible member that couples the spring to the paddle.

According to some aspects, the pusher assembly further comprises a housing having a clip that couples a rear end of the spring and a rear end of the extensible member to the horizontal bar.

According to some aspects, the extensible member comprises a series of links.

According to some aspects, pairs of links in the series of links are coupled together along respective pivot axes. The pivot axes are oriented horizontally when the pusher assembly is installed on the shelf.

According to some aspects, a first distance between pivot axes at opposing ends of a first link in a given pair of links is not the same as a second distance between pivot axes at opposing ends of a second link in the given pair of links.

According to some aspects, at least one link in the series of links is curved from a first end thereof to a second end thereof.

According to some aspects, the at least one link has reverse curvature.

According to some aspects, at least one of the links in the series of links comprises a protrusion that is configured to interact with an adjacent link in the series of links so as to limit a degree to which the adjacent link can pivot with respect to the at least one of the links comprising the protrusion.

According to some aspects, the pusher assembly comprises a paddle slidable on the shelf into and between an extended position proximate the front end of the shelf and a collapsed position proximate the rear end of the pusher assembly. A locking mechanism has a first portion on the paddle and a second portion on the rear end of the pusher assembly, and the first portion is configured to be engaged with the second portion to retain the paddle in the collapsed position.

According to some aspects, a first one of the first portion and the second portion of the locking mechanism is configured as a cam and a second one of the first portion and the second portion of the locking mechanism is configured as a spring. The spring is configured to slide into engagement with the cam to retain the paddle in the collapsed position.

According to some aspects, the spring is configured to slide into engagement with the cam through a first opening into the cam, and to disengage from the cam via a second opening into the cam.

According to an exemplary embodiment of the present disclosure, a product merchandizer system configured to be installed on a shelf comprises a pusher assembly configured to push products with which the product merchandizer system is stocked toward a front end of the shelf. The pusher assembly comprises: a paddle at a front end of the pusher assembly, the paddle being configured to rest on the shelf; a housing at a rear end of the pusher assembly; a spring supported by the housing and configured to bias the paddle toward the front end of the shelf; and a series of links coupling the spring to the paddle.

According to some aspects, pairs of links in the series of links are coupled together along respective pivot axes. The pivot axes are oriented horizontally when the pusher assembly is installed on the shelf.

According to some aspects, a first distance between pivot axes at opposing ends of a first link in a given pair of links is not the same as a second distance between pivot axes at opposing ends of a second link in the given pair of links.

According to some aspects, at least one link in the series of links is curved from a first end thereof to a second end thereof.

According to some aspects, the at least one link has reverse curvature.

According to some aspects, at least one of the links in the series of links comprises a protrusion that is configured to interact with an adjacent link in the series of links so as to limit a degree to which the adjacent link can pivot with respect to the at least one of the links comprising the protrusion.

According to some aspects, the housing is configured to be clipped to a horizontal bar supported above a rear end of the shelf.

According to some aspects, the paddle is slidable on the shelf into and between an extended position proximate the front end of the shelf and a collapsed position proximate the rear end of the pusher assembly. The product merchandizer system further comprises a locking mechanism configured to retain the paddle in the collapsed position. The locking mechanism has a first portion on the paddle and a second portion on the housing, and the first portion is configured to be engaged with the second portion to retain the paddle in the collapsed position. A first one of the first portion and the second portion of the locking mechanism is configured as a cam and a second one of the first portion and the second portion of the locking mechanism is configured as a spring. The spring is configured to slide into engagement with the cam to retain the paddle in the collapsed position.

According to some aspects, the spring has a first end with a first diameter and a second end with a second diameter, and the first diameter is less than the second diameter.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
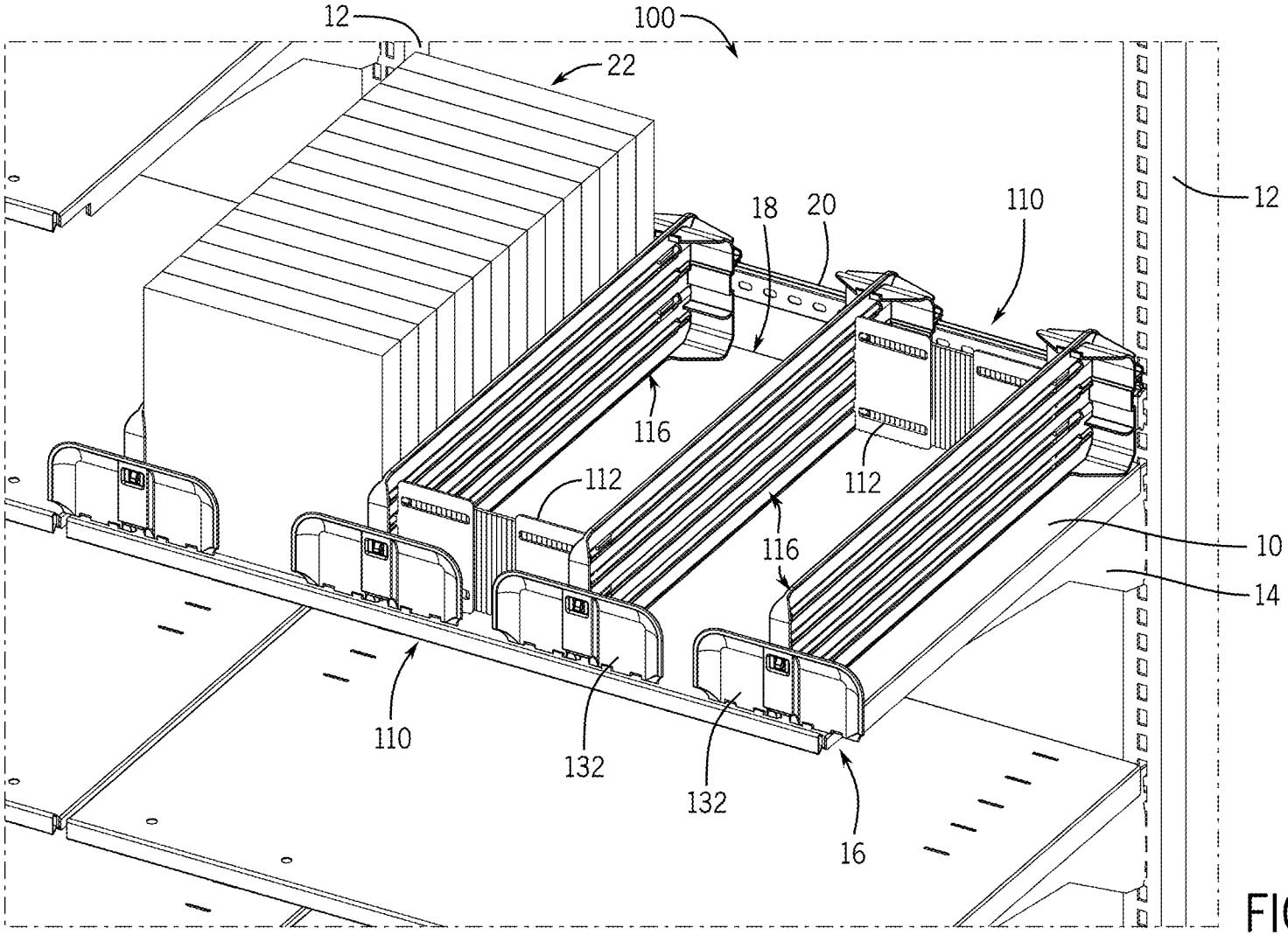
FIG. 1 illustrates one embodiment of a product merchandizer system according to the present disclosure.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C. Likewise, unless otherwise specified or limited, the terms "mounted," "connected," "linked," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "bottom," "front," "back," "left," "right," "lateral" or "longitudinal" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements from another.

Product merchandizer systems are used to front-face products in retail stores in order to facilitate consumer access to the product. Existing product merchandizer systems often utilize a coil spring that biases a pusher paddle toward a front of the merchandizer. Such existing product merchandizer systems may be suspended from a grid structure, in which case they require some sort of structure to support the products vertically. Such existing product merchandizer systems may also be supported on a shelf. In both cases, suspended and shelf-supported, some sort of architecture is required to anchor or restrain the coil spring, such as a track, rail, or platform, each of which consumes vertical and/or horizontal space. The vertical space consumed stacks up from level to level, decreasing the overall amount of vertical space available to hold products. Likewise, the horizontal space consumed adds up to decrease the overall horizontal space available to hold products. Furthermore, existing shelf-based solutions often also require components that attach to the front and/or back of the shelf to anchor the track, rail, or platform along which the pusher paddle travels, which anchoring components decrease the amount of space in the depth direction of the shelf that is available for pack-out.

In contrast, the present inventors have discovered through research and development that a shelf-supported merchandizer system can achieve the same or similar functionality as prior art systems, while consuming less vertical, horizontal, and pack-out space than existing merchandizers. The present merchandizer systems are thus low-profile in one, two, or all three dimensions. This allows a shelf to be stocked with a maximum amount of product, decreasing the frequency of re-stocking and thereby decreasing labor costs. The present inventors have achieved such beneficial results by way of a product merchandizer system configured to be installed on a shelf, which product merchandizer system includes a pusher assembly configured to push products with which the product merchandizer system is stocked toward a front end of the shelf. In some embodiments, the pusher assembly is biased by way of novel biasing components not heretofore known for use in product merchandizer systems. In other embodiments, the pusher assembly is biased by known biasing components, but those components are incorporated into the product merchandizer system in novel ways. The product merchandizer systems also include at least one partition configured to project upwardly from the shelf. In some embodiments, the partition has a horizontal width that is greatly reduced in comparison to existing partitions that incorporate pusher assemblies therein. A horizontal bar, which may be provided separately or as part of the product merchandizer system, is supported above a rear end of the shelf on which the pusher assembly and the at least one partition are to be installed. The pusher assembly comprises a rear end configured to be clipped to the horizontal bar and a front end configured to rest on the shelf. The at least one partition also comprises a rear end configured to be clipped to the horizontal bar and a front end configured to rest on the shelf at the front end of the shelf. Thus, no additional structure is required to be installed at the front or rear ends of the shelf to hold the pusher assembly or the partition(s).

FIGS. 1-7 show a first embodiment of a product merchandizer system 100 configured to be installed on a shelf 10. The shelf 10 is supported by two vertical uprights 12 by way of brackets 14. Further shelves may be installed above, below, and/or laterally to the side of the shelf 10 in a similar manner. One having ordinary skill in the art will recognize that the shelf 10 and vertical uprights 12 shown here are not the only possible arrangement on which the product merchandizer system 100 can be installed. The shelf 10 has a front end 16 and a rear end 18, the front end 16 being the end that is closer to the consumer when the shelf 10 is installed on the vertical uprights 12. A horizontal bar 20 is supported above the rear end 18 of the shelf 10. Generally, the horizontal bar 20 is more or less parallel with the rear end 18 of the shelf 10, although the two surfaces could be offset by a few inches from one another in a given application. The horizontal bar 20 may be a DIN rail having a top hat section, a C section, or a G section. In the present embodiment, the horizontal bar 20 is a DIN 3 rail having a top hat section, as shown best in FIGS. 4 and 5. In other embodiments, the horizontal bar 20 may be a different type of standard rail or may be a custom-manufactured rail (see, for example, horizontal bar 20' of FIGS. 43-66). In one embodiment, the vertical uprights 12 and shelf 10 may be preinstalled in a store location where the product merchandizer system 100 is to be installed, such as, by way of non-limiting example, in a refrigerator or freezer chest.

Figure 2:
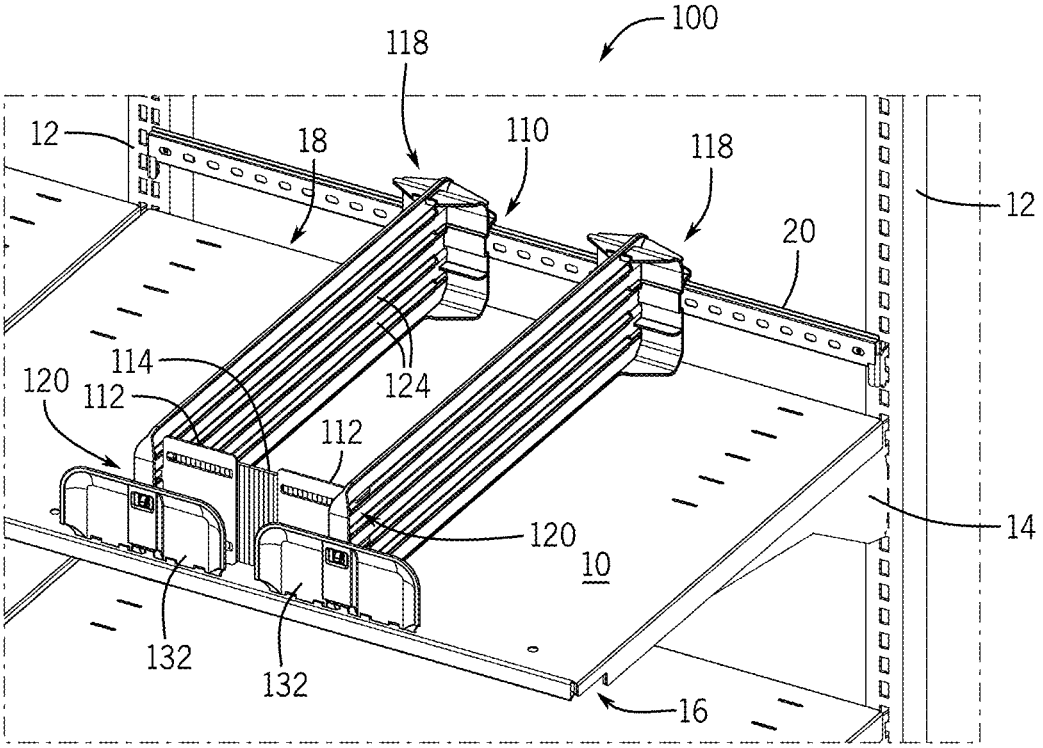
FIG. 2 illustrates the product merchandizer system of FIG. 1, with a pusher paddle in a first position.
Figure 3:
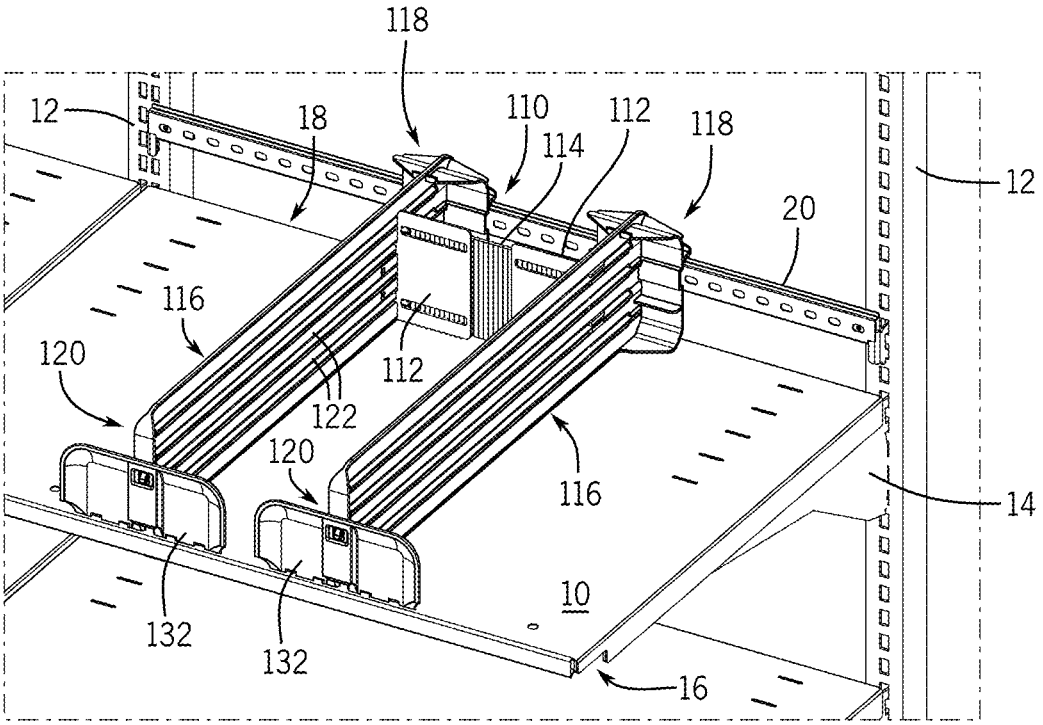
FIG. 3 illustrates the product merchandizer system of FIG. 1, with the pusher paddle in a second position.

The product merchandizer system 100 comprises a pusher assembly 110 configured to push products with which the product merchandizer system 100 is stocked toward the front end 16 of the shelf 10. As shown best in FIGS. 2 and 3, the pusher assembly 110 includes pusher paddles 112 that can move from the front end 16 of the shelf 10 as shown in FIG. 2 (see also left-hand pusher assembly 110 in FIG. 1) to the rear end 18 of the shelf 10 as shown in FIG. 3 (see also right-hand pusher assembly 110 in FIG. 1), as will be described further herein below. At least one partition 116 is configured to project upwardly from the shelf 10 to divide one channel of products (e.g. products 22, FIG. 1) from another channel of products.

Figure 4:
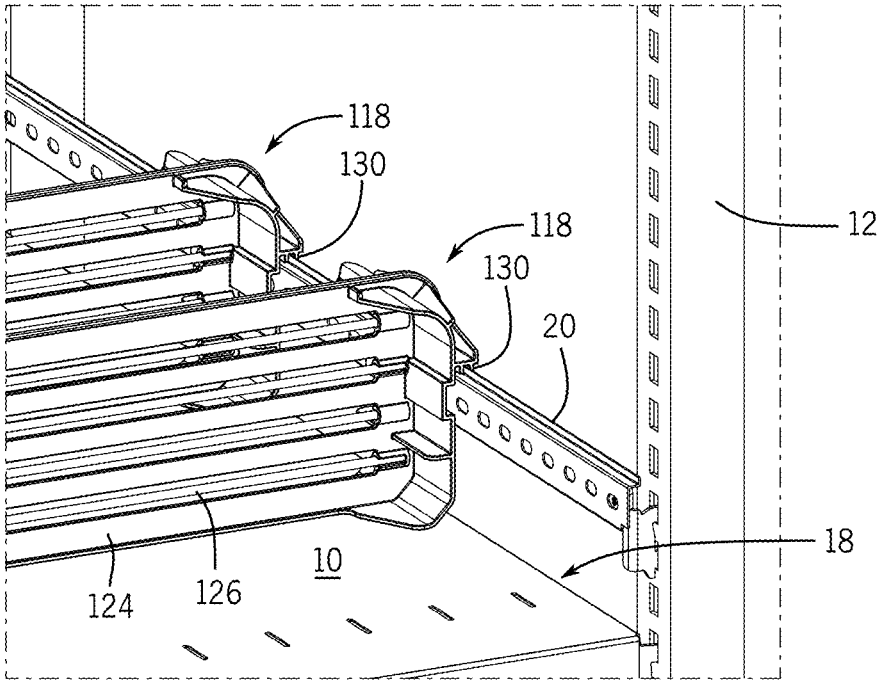
FIG. 4 illustrates a front perspective view of a rear end of a pusher assembly/partition of the product merchandizer system of FIG. 1.
Figure 5:
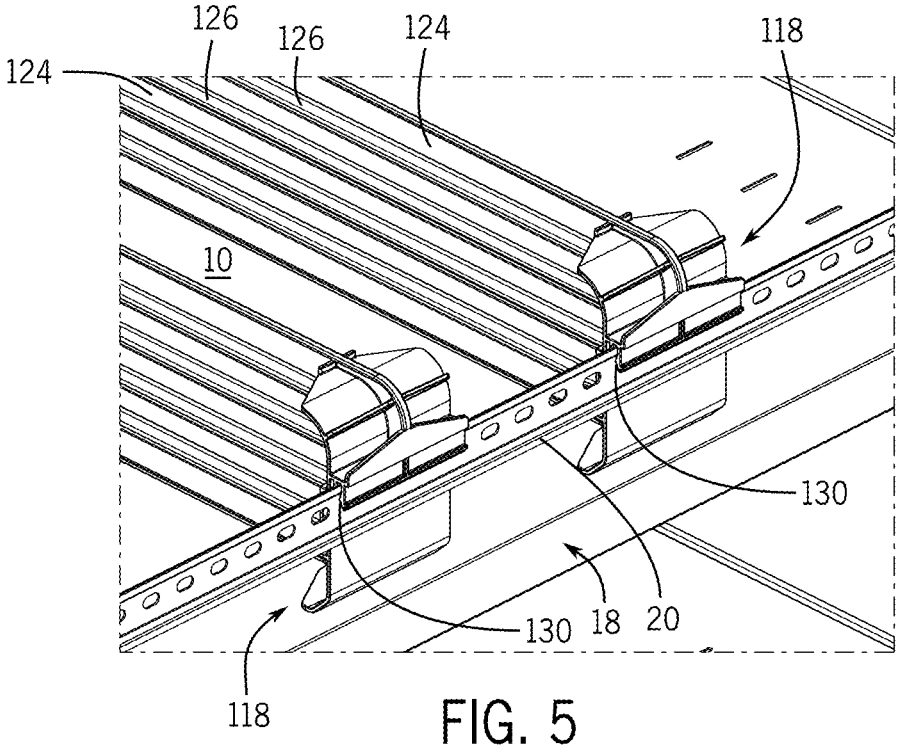
FIG. 5 illustrates a rear perspective view of a rear end of the pusher assembly/partition of the product merchandizer system of FIG. 1.
Figure 6:
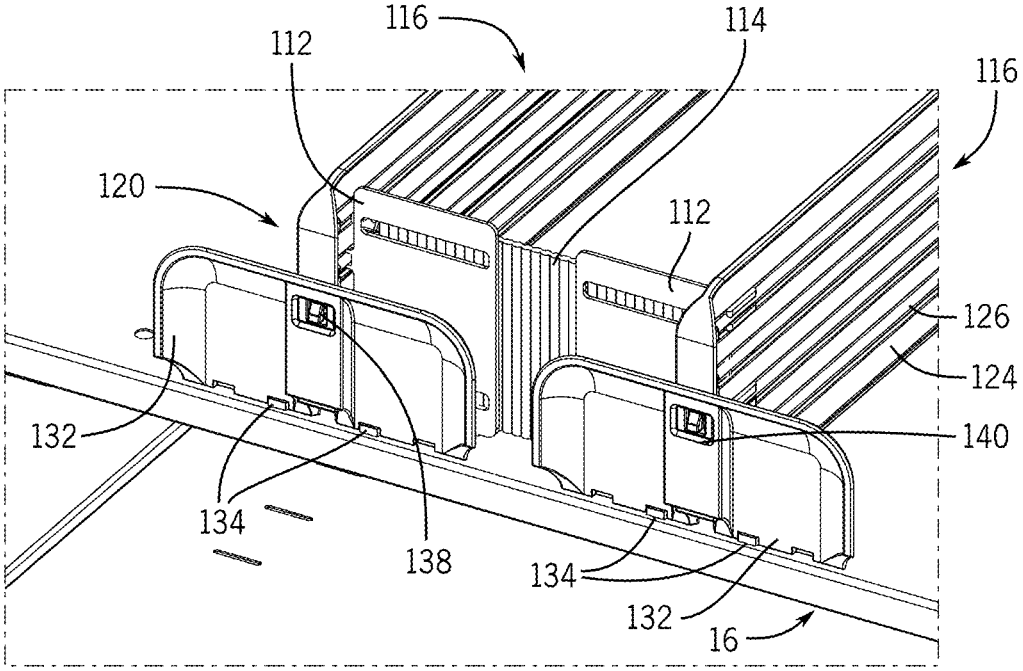
FIG. 6 illustrates a front perspective view of a front end of the pusher assembly/partition of the product merchandizer system of FIG. 1.
Figure 7:
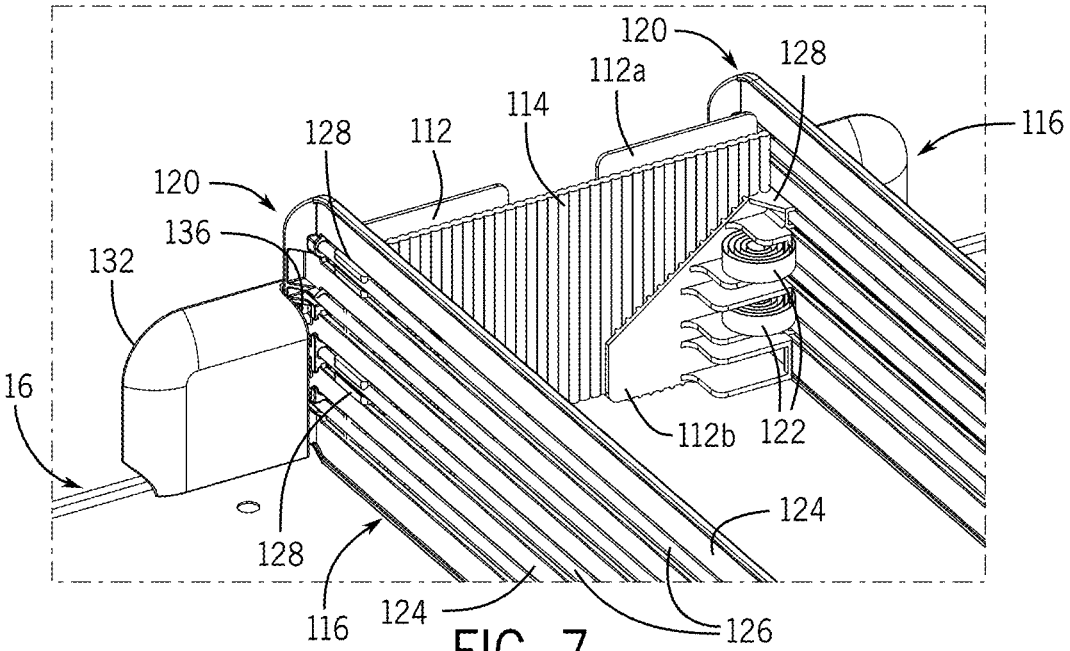
FIG. 7 illustrates a rear perspective view of a front end of the pusher assembly/partition of the product merchandizer system of FIG. 1.
Figure 8:
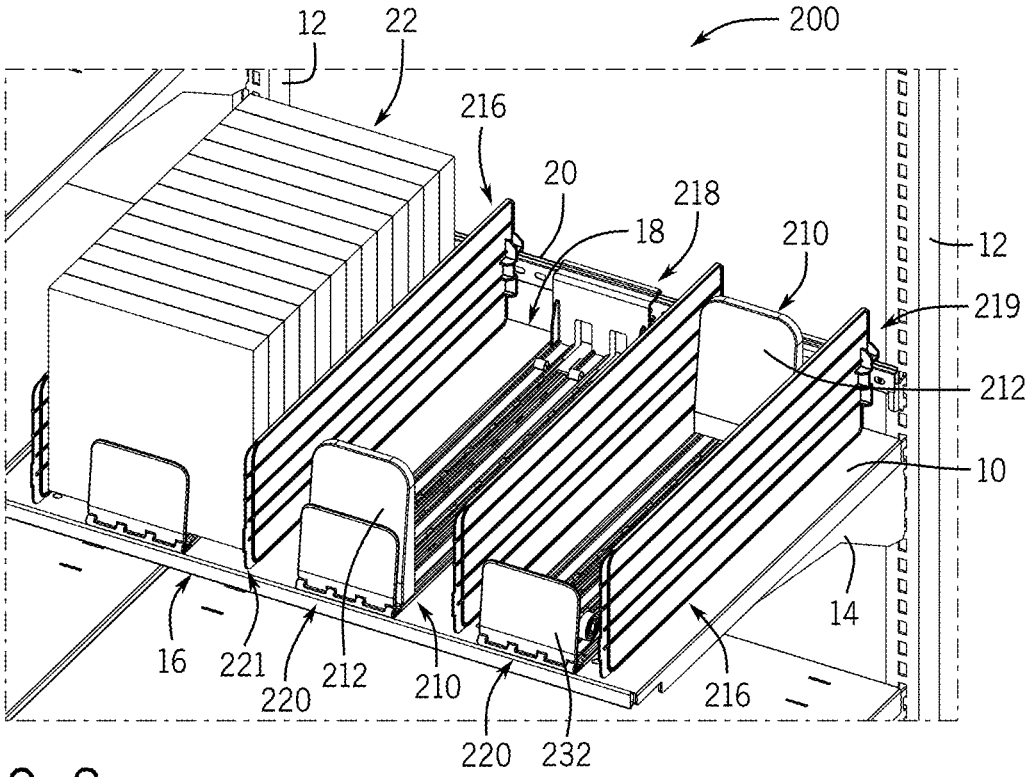
FIG. 8 illustrates another embodiment of a product merchandizer system according to the present disclosure.

As noted hereinabove, the manner of installation of the pusher assembly 110 and the partitions 116 does not require additional components to be attached to or installed on the shelf 10. Rather, the pusher assembly 110 comprises a rear end 118 configured to be clipped to the horizontal bar 20, as best shown in FIGS. 4 and 5, and a front end 120 configured to rest on the shelf 10 at the front end 16 of the shelf 10, as best shown in FIGS. 6 and 7. In the present embodiment, the pusher assembly 110 is at least partially built into the at least one partition 116. The at least one partition 116 thus also comprises a rear end 118 configured to be clipped to the horizontal bar 20 and a front end 120 configured to rest on the shelf 10 at the front end 16 of the shelf 10.

As noted, the pusher assembly 110 comprises a paddle 112. In the present embodiment, each pusher assembly 110 includes two paddles 112, each of which is supported by one of the partitions 116 on either side thereof. A bridge 114 is provided between the paddles 112. As shown in FIG. 7, the pusher assembly 110 also includes a coil spring 122 supported by the paddle 112. In the present embodiment, two coil springs 122 are stacked vertically on a single paddle 112 and separated by flanges formed on the rear of the paddle 112. In other embodiments, one, three, or more coil springs could be provided on the paddle 112. Although not shown herein, coil springs are also supported by the opposite paddle 112, which is a mirror image of the pusher paddle 112 shown in FIG. 7. Thus, each paddle 112 is biased by the coil springs 122 toward the front end 16 of the shelf 10. The bridge 114 is a semi-rigid member that helps to maintain the paddles 112 side-by-side as they travel between the partitions 116 under the force of the coil springs 122. However, the bridge 114 is flexible enough that it will not snap if one paddle 112 is slightly misaligned with the other. In one embodiment, the bridge 114 is made of plastic.

As shown best in FIG. 7, the bridge 114 is configured to slide into a pocket formed in each paddle 112, between a paddle front wall 112*a* and a paddle rear wall 112*b*. The bridge 114 may have multiple vertical segments and the pocket may have inner ribs (see, e.g., front face of rear wall 112*b*) forming channels that together allow the bridge 114 to be securely held in the pocket by way of a friction fit. In some embodiments, the ribs in the pocket may be provided only at a bottom end of the pocket, such that the bridge 114 can be pulled up out of the ribbed channels at the bottom of the pocket, slid along the smooth upper interior of the pocket, and then pushed back down into the ribbed channels at the bottom of the pocket. The adjustability of the bridge 114 allows the width of each product channel to be adjusted as needed to accommodate varying products. In other embodiments, no bridge may be provided and the paddle 112 may be a solid integral piece connected between two adjacent partitions 116. In other embodiments, no bridge 114 may be provided and the paddles 112 are instead maintained in alignment by the force of semi-rigid products tending to hold them in such an aligned state.

As shown in FIGS. 4-7, each partition 116 comprises a wall portion 124 and a wire 126 configured to extend from the rear end 18 of the shelf 10 to the front end 16 of the shelf 10. In the present embodiment, there are multiple wall portions 124 and wires 126, which alternate vertically. For example, the wall portions 124 could be part of a larger wall structure in which slots have been provided to accommodate the wires 126. In other embodiments, fewer or more wall portions 124 and wires 126 can be provided than those shown herein. Each paddle 112 is configured to slide along respective wires 126 to which it is attached. As shown in FIG. 7, the outer lateral side of the paddle 112 may be provided with a tab 128 or tabs configured to fit over/around a given wire 126. The tab 128 is able to slide along the wire 126 as the paddles 112 move along the shelf 10 under the force of the coil springs 122. To facilitate such sliding, each wire 126 may be, by way of non-limiting example, a steel powder-coated wire, while the paddles 112 may be made of plastic. The coil springs 122 meanwhile are configured to extend along the wall portions 124. For example, as shown in FIG. 3, two coil springs 122 are extended along respective wall portions when the paddles 112 are pushed by products against the bias of the coil springs 122 toward the rear end 18 of the shelf 10. In contrast, as shown in FIG. 2, the wall portions 124 along which the two particularly referenced coil springs 122 would extend are uncovered, as the coil springs 122 are in their relaxed state coiled behind the paddle 112 when the paddle 112 is at the front end 16 of the shelf 10. The wall portions 124 prevent the coil springs 122 from deflecting into a neighboring channel of products, which might cause interference with products and/or the pusher assembly in the neighboring channel. Meanwhile, the wires 126 support and guide the paddles 112 along the shelf.

As shown herein, the tabs 128 on a given paddle 112 are configured to slide along different wires than are the tabs of a paddle 112 in a neighboring channel. For example, as shown in FIG. 7, the tabs on every right-hand side paddle 112 (when viewed from the front of the shelf 10) can be attached to the uppermost wire 126 and to the wire 126 that is second from bottom. The tabs 128 on every left-hand side paddle (when viewed from the front of the shelf 10) can be attached to the wire 126 that is second from top and to the bottommost wire (which attachment is not visible in FIG. 7). This ensures that the tabs 128 on one paddle 112 do not interfere with the tabs 128 on a paddle in a neighboring channel. In other embodiments, the tabs on a given paddle may be provided on the two uppermost wires and the tabs on a neighboring paddle may be provided on the two bottommost wires. It should be understood that various permutations of the locations of the tabs are possible.

Thus, in the embodiment of FIGS. 1-7, the track (i.e., the wires 126) along which a given pusher paddle 112 travels is integrated into a respective partition 116. Further, the coil springs 122 are aligned along the partition wall portions 124.

These features together eliminate the need for any sort of track on the shelf 10 below the paddle 112, maximizing the amount of vertical space available for products. Further, because the wires 126 and wall portions 124 are alternately vertically stacked, this maximizes the amount of horizontal space available for products. The wires 126 are dimensioned so as not to be much thicker than a typical partition wall is wide.

In other embodiments, the partitions 116 are provided without the wall portions 124 and the springs 122 simply fit in the spaces between the wires 126. In still other embodiments, the partitions 116 are provided without wires 126 and the paddles 112 are supported by and travel along the wall portions 124.

As shown in FIGS. 4 and 5, the rear end 118 of each pusher assembly/partition comprises an integral clip feature 130. The clip feature 130 has the shape of a downwardly-facing U formed on a ledge that is integral with the structure that forms the wall portions 124 and that holds the wires 126 of the partitions 116. The clip feature 130 has an inherent spring force and thus is able to be attached to the horizontal bar 20 by way of angling the partition 116 such that its front end is further from the shelf 10, aligning the clip feature 130 on the horizontal bar 20, and pivoting the front end of the partition 116 downwardly toward the shelf 10 so as to cam the rear end 118 onto the horizontal bar 20. As noted hereinabove, the horizontal bar 20 in this embodiment is a top hat section DIN rail and the clip feature 130 is designed accordingly. The clip feature 130 may take other shapes if a different type of DIN rail or a different shape of bar is used. Each pusher assembly/partition is infinitely movable along the horizontal bar 20 by pivoting the pusher assembly/partition upward to reduce the friction fit between the clip feature and 130 and the horizontal bar 20, sliding the pusher assembly/partition to a desired location, and camming the clip feature 130 down over the horizontal bar 20 once again.

FIGS. 6 and 7 show how the front end 120 of each pusher assembly/partition is supported on the shelf 10. A front lens 132 is also supported on the shelf 10. Optionally, the front lens 132 may be provided with magnets 134 embedded therein or attached thereto, which magnets 134 attract to the metal shelf 10 and prevent pivoting of the front lens 132. In one non-limiting embodiment, the magnets are super-strong magnets such as Neodymium magnets. The front end 120 of the pusher assembly/partition dovetails into a slot 136 (FIG. 7) in the rear face of the front lens 132. A clip 138 on the front end of the pusher assembly/partition springs through an aperture 140 in the front lens 132 to secure the two parts together. Thus, the front end 120 of the pusher assembly 110, which is the same as the front end 120 of the partition 116, rests on and is supported by the shelf 10 at the front end 16 of the shelf 10 without the need for any additional rail or other structure. However, the front lens 132 (which is typically required in any case to prevent the product from being pushed off the front end 16 of the shelf 10) may be provided in order to further stabilize the front end 120 of the pusher assembly/partition. To detach the partition 116 from the front lens 132, the clip 138 is pushed inwardly until it clears the plane of the aperture 140 and the partition 116 is pulled upwardly.

Product loaded in the product merchandizer system 100 is pushed toward the front end 16 of the shelf 10 as the bias of the coil springs 122 pull the paddle 112 toward the front end 16 every time a product is removed from the product merchandizer system 100. As the product merchandizer system 100 is restocked with product, the force of the added product pushes the paddle 112 against the force of the springs 122 toward the rear end 18 of the shelf 10. Thus, the paddle 112 is positionable along the depth of the shelf 10, anywhere between the locations shown in FIGS. 2 and 3.

FIGS. 8-15 show another embodiment of a product merchandizer system 200 according to the present disclosure, which is configured to be installed on a shelf 10. The shelf 10, horizontal bar 20, and other related support components are the same as those described with respect to FIG. 1 and will not be described again.

Figure 10:
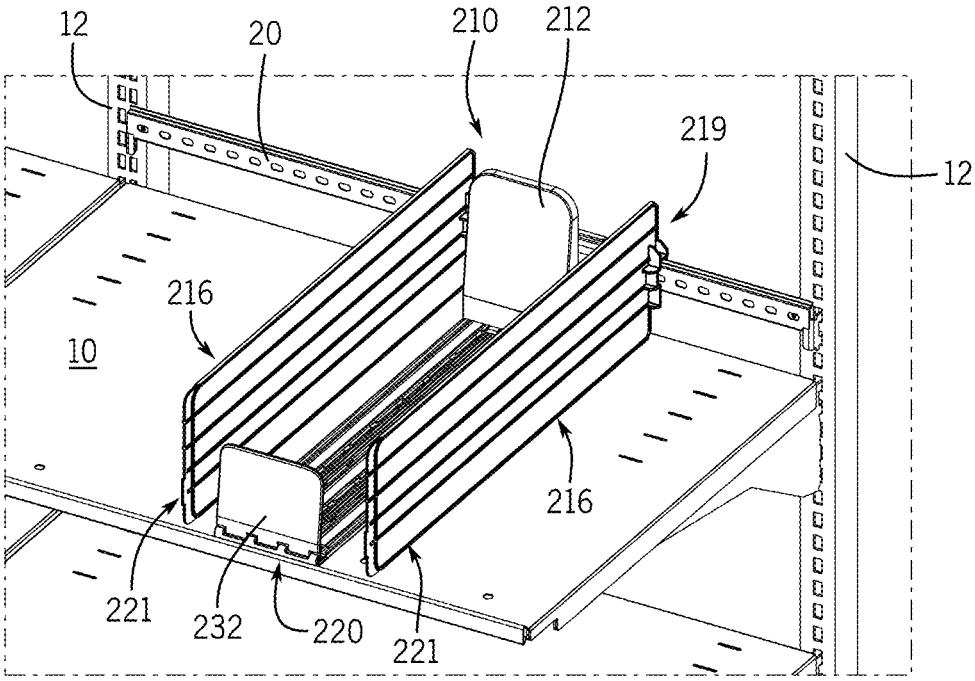
FIG. 10 illustrates the product merchandizer system of FIG. 8, with a pusher paddle in a first position.
Figure 11:
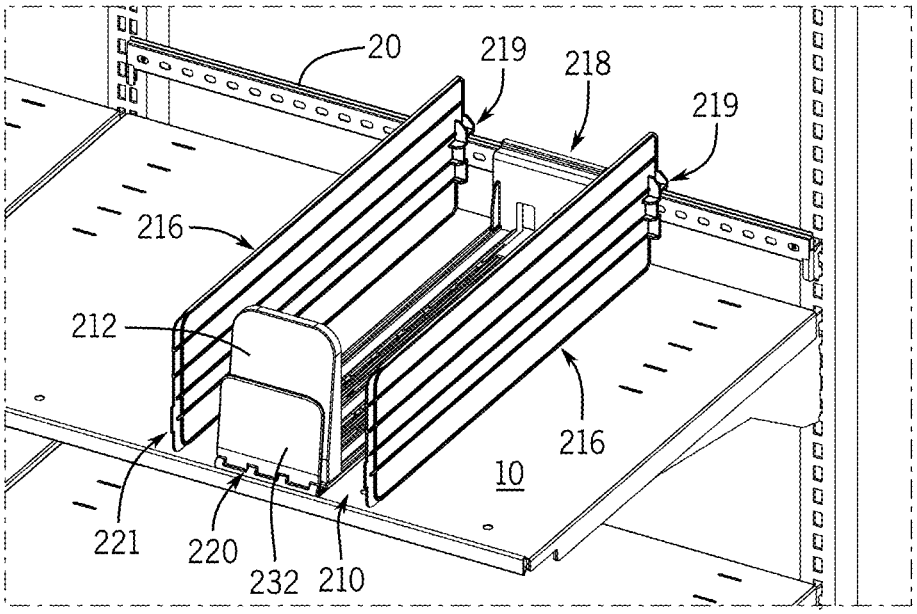
FIG. 11 illustrates the product merchandizer system of FIG. 8, with the pusher paddle in a second position.

The product merchandizer system 200 comprises a pusher assembly 210 configured to push products with which the product merchandizer system 200 is stocked toward the front end 16 of the shelf 10. As shown best in FIGS. 10 and 11, the pusher assembly 210 includes pusher paddles 212 that can move from the front end 16 of the shelf 10 as shown in FIG. 11 (see also left-hand pusher assembly 210 in FIG. 8) to the rear end 18 of the shelf 10 as shown in FIG. 10 (see also right-hand pusher assembly 210 in FIG. 8), as will be described further herein below. At least one partition 216 is configured to project upwardly from the shelf 10 to divide one channel of products (e.g. products 22, FIG. 8) from another channel of products.

Figure 12:
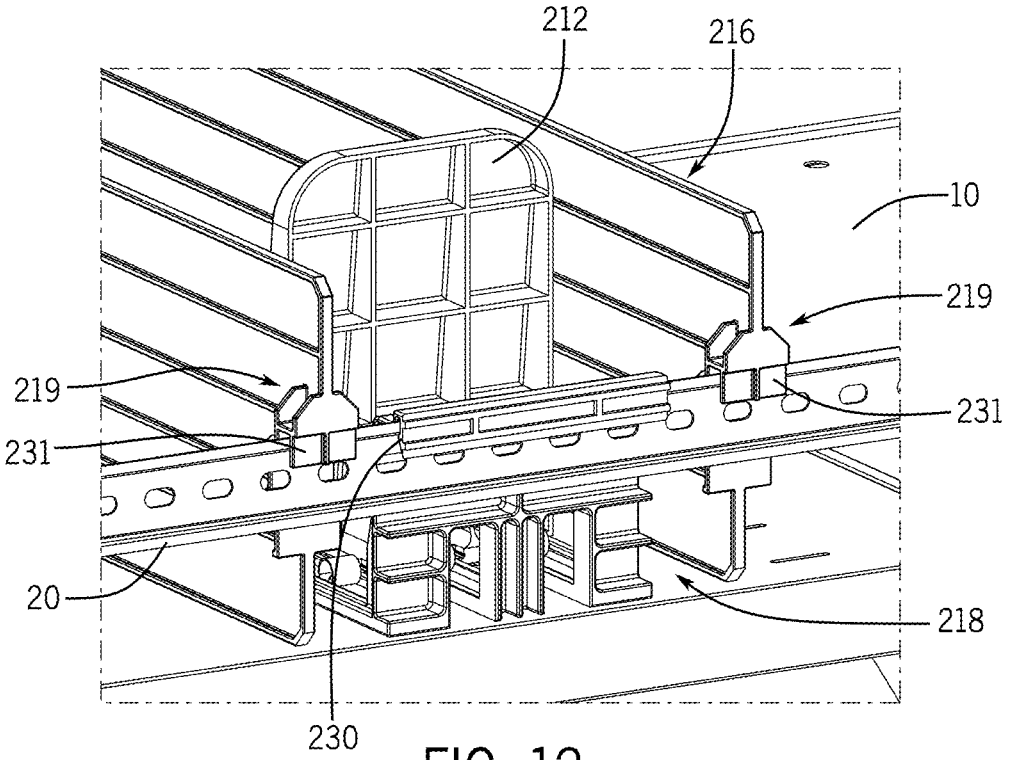
FIG. 12 illustrates a rear perspective view of a rear end of a pusher assembly and a rear end of a partition of the product merchandizer system of FIG. 8.
Figure 13:
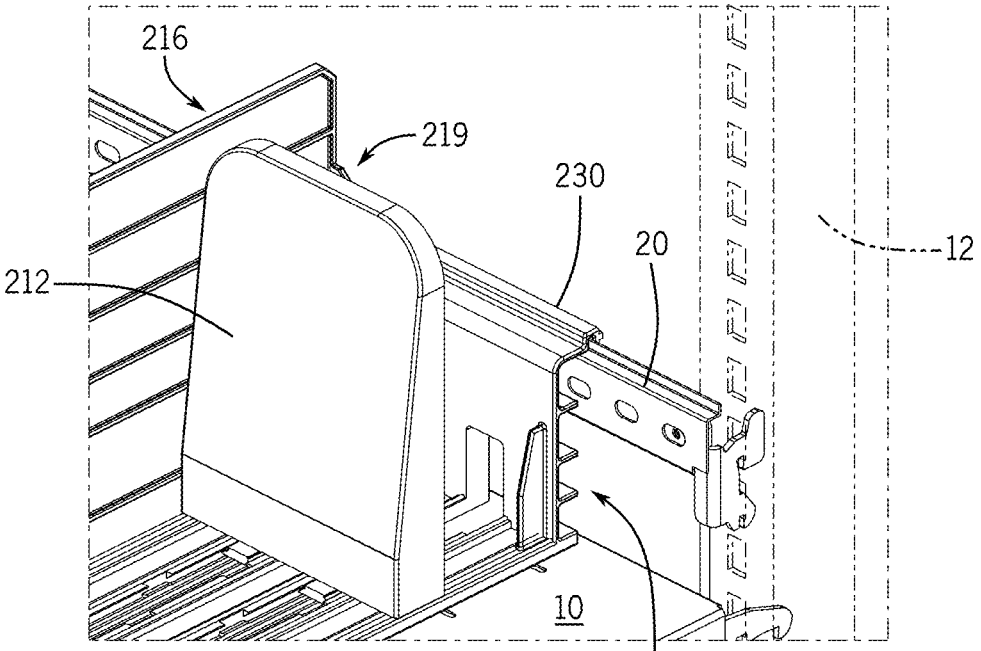
FIG. 13 illustrates a front perspective view of a rear end of the pusher assembly and a rear end of the partition of the product merchandizer system of FIG. 8.
Figure 14:
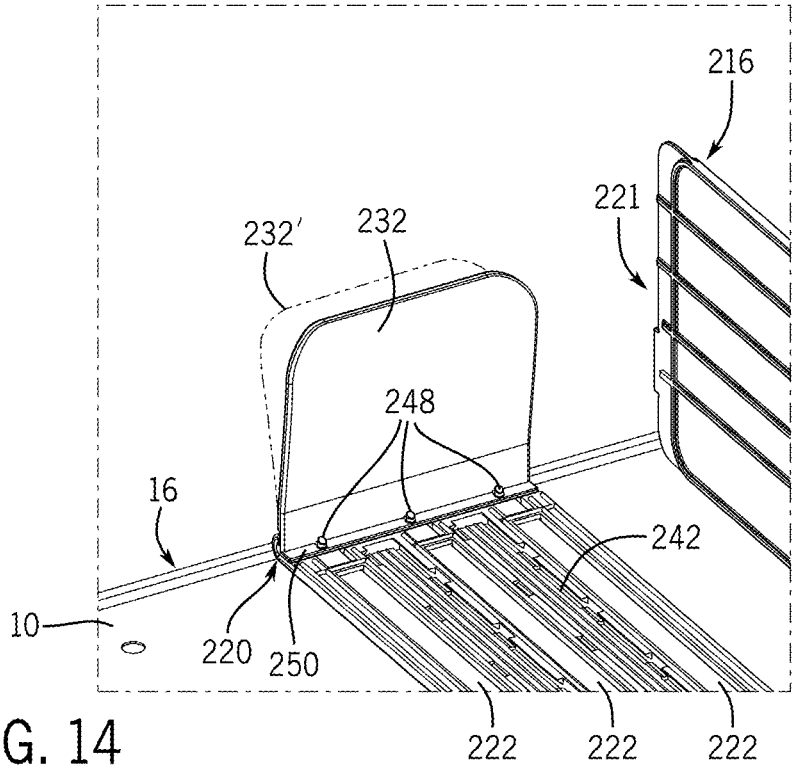
FIG. 14 illustrates a rear perspective view of a front end of the pusher assembly and a front end of the partition of the product merchandizer system of FIG. 8.
Figure 15:
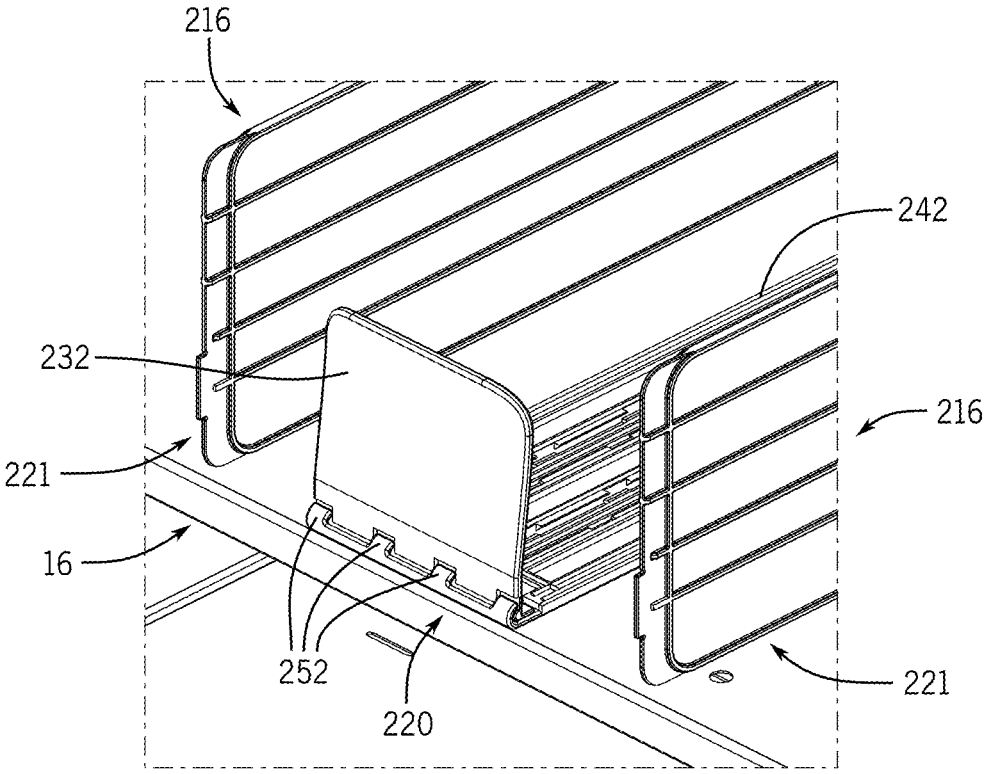
FIG. 15 illustrates a front perspective view of a front end of the pusher assembly and a front end of the partition of the product merchandizer system of FIG. 8.
Figure 16:
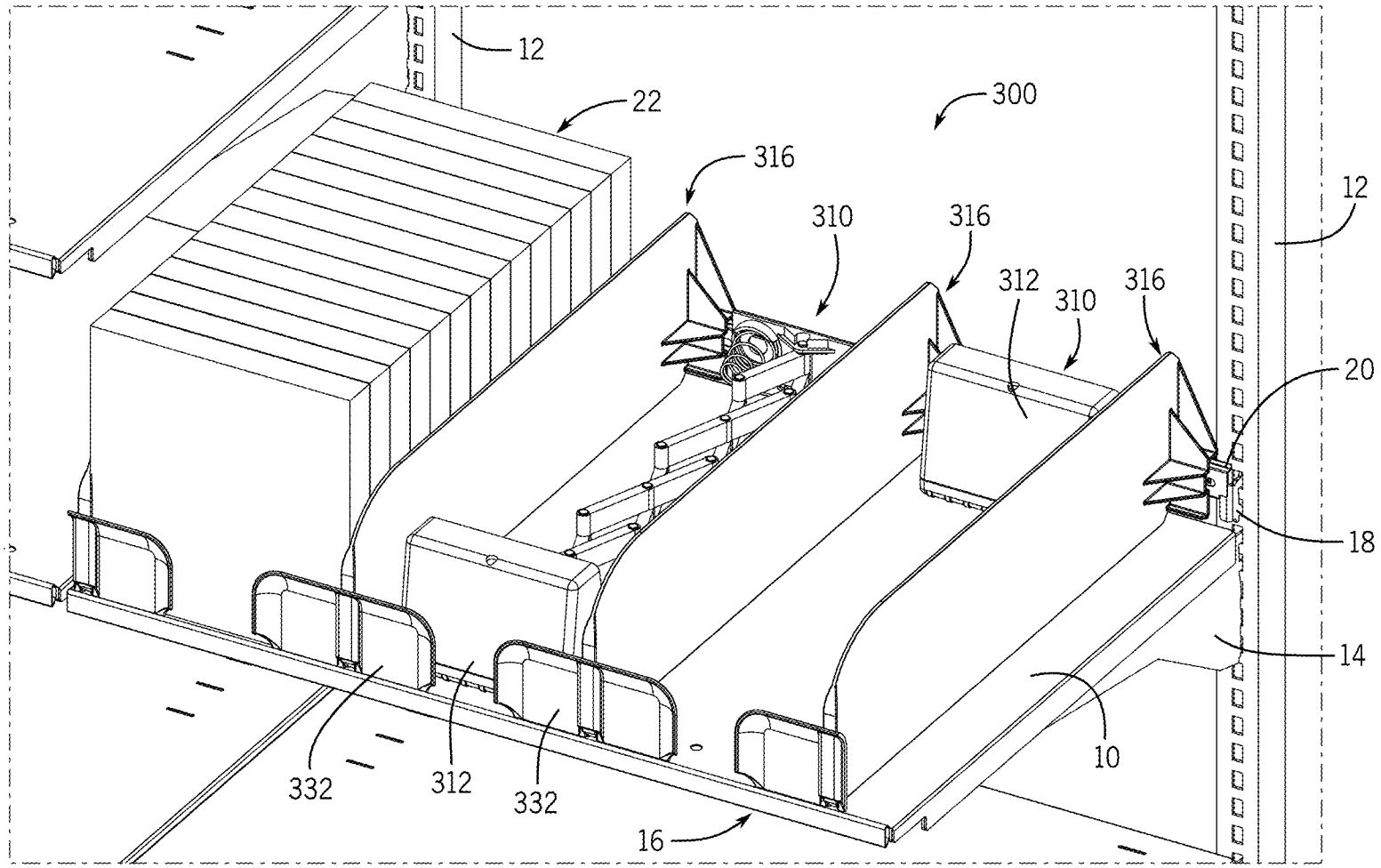
FIG. 16 illustrates another embodiment of a product merchandizer system according to the present disclosure.

As noted hereinabove, the manner of installation of the pusher assembly 210 and the partitions 216 does not require additional components to be attached to or installed on the shelf 10. Rather, the pusher assembly 210 comprises a rear end 218 configured to be clipped to the horizontal bar 20, as best shown in FIGS. 12 and 13, and a front end 220 configured to rest on the shelf 10 at the front end 16 of the shelf 10, as best shown in FIGS. 14 and 15. Likewise, the at least one partition 116 also comprises a rear end 219 configured to be clipped to the horizontal bar 20, as best shown in FIG. 12, and a front end 221 configured to rest on the shelf 10 at the front end 16 of the shelf 10, as best shown in FIGS. 14 and 15.

Figure 9:
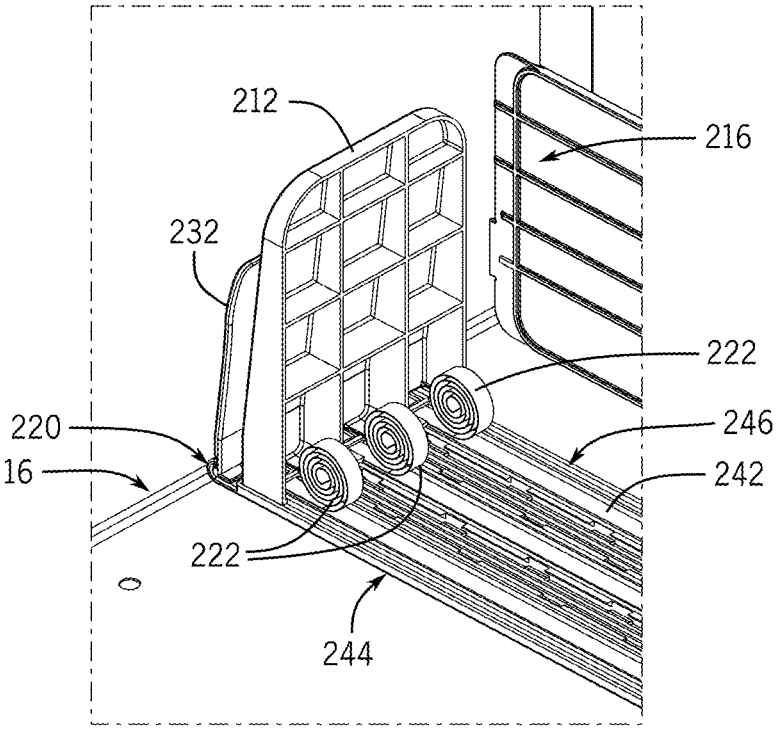
FIG. 9 illustrates a rear perspective view of a pusher paddle of the product merchandizer system of FIG. 8.

According to the present embodiment, referring to FIG. 9, the pusher assembly 210 comprises a track 242 having a lower surface 244 configured to be supported by the shelf 10 and an upper surface 246 configured to support products with which the product merchandizer system 200 is stocked. The paddle 212 rides along the track 242 such as by way of one or more projections on the lower portion of the paddle 212 sliding within one or more channels formed in the upper surface 246 of the track 242. Such arrangements are well known and will not be described further herein. A coil spring 222 biases the paddle 212 toward the front end 16 of the shelf 10. Here, three coil springs 222 are shown, but one, two, or more than three coil springs could be provided. Operation of the coil springs 222 to bias the paddle 212 is well known and will not be described further herein.

However, unlike known coil-spring biased pusher paddles that ride on a track, the pusher assembly 210 of the present embodiment further comprises an integral clip feature 230, best shown in FIGS. 12 and 13, that couples a rear end of the track 242 to the horizontal bar 20. Referring to FIG. 12 specifically, the rear end 219 of each partition 216 also comprises an integral clip feature 231. The clip features 230, 231 have the shape of a downwardly-facing U. The clip features 230, 231 have an inherent spring force and thus are able to be attached to the horizontal bar 20 by way of angling the pusher assembly 210 or partition 216 such that its front end is further from the shelf 10, aligning the clip feature 230 or 231 on the horizontal bar 20 and pivoting the front end of the pusher assembly 210 or partition 216 downwardly toward the shelf 10 so as to cam the rear end 218 of the pusher assembly 210 or the rear end 219 of the partition 216 onto the horizontal bar 20. As noted hereinabove, the horizontal bar 20 in this embodiment is a top hat section DIN rail and the clip features 230, 231 are designed accordingly. The clip features 230, 231 may take other shapes if a different type of DIN rail or a different shape of bar is used. Thus, no additional structure is required to be attached to the shelf 10 in order to hold the pusher assembly 210 and the partitions 216 on the shelf 10.

FIGS. 14 and 15 show how the front end 220 of each pusher assembly 210 is supported on the shelf 10. The track 242 simply rests on the upper surface of the shelf 10 at the front end 16 thereof. Similarly, the front ends 221 of each partition 216 also simply rest atop the shelf 10. Thus, no additional structure is required to be attached to the shelf 10 in order to hold the pusher assembly 210 and the partitions 216 on the shelf 10. The partitions 216 are infinitely movable along the horizontal bar 20 by pivoting the partition 216 upward to reduce the friction fit between the clip feature and 231 and the horizontal bar 20, sliding the partition 216 to a desired location, and camming the clip feature 231 down over the horizontal bar 20 once again. The repositioning of the partition 216 is unconstrained by any slots or other structure at the front end 16 of the shelf 10 into which the front end 221 of the partition 116 must be seated, as in prior art designs. The pusher assemblies 210 are infinitely positionable along the horizontal bar 20 in a similar manner.

FIGS. 14 and 15 also show the front lens 232 is hinged such that it can be moved to the position shown at 232' or even further outward from the front end 16 of the shelf 10. This feature may be useful when a customer wishes to pull product out from the product merchandizer system 200, or when an employee wishes to restock the product merchandizer system 200. Prior art hinged lenses require additional springs in order to return the front lens 232 to the upright position. In contrast, in the present embodiment, the front end of each coil spring 222 is attached to the front lens 232. This may be done in different ways, but here is done by fitting a hole in the front end of the spring 222 over a peg 248 that projects from a flange 250 (FIG. 14) formed at the bottom end of the front lens 232. The front end of the track 242 is formed with hinge knuckles 252 (FIG. 15) about which the front lens 232 pivots.

Product loaded in the product merchandizer system 200 is pushed toward the front end 16 of the shelf 10 as the bias of the coil springs 222 pull the paddle 212 toward the front end 16 every time a product is removed from the product merchandizer system 200. As the product merchandizer system 200 is restocked with product, the force of the added product pushes the paddle 212 against the force of the springs 222 toward the rear end 18 of the shelf 10. Thus, the paddle 212 is positionable along the depth of the shelf 10, anywhere between the locations shown in FIGS. 10 and 11.

FIGS. 16-22 show another embodiment of a product merchandizer system 300 according to the present disclosure, which is configured to be installed on a shelf 10. The shelf 10, horizontal bar 20, and other related support components are the same as those described with respect to FIG. 1 and will not be described again.

Figure 17:
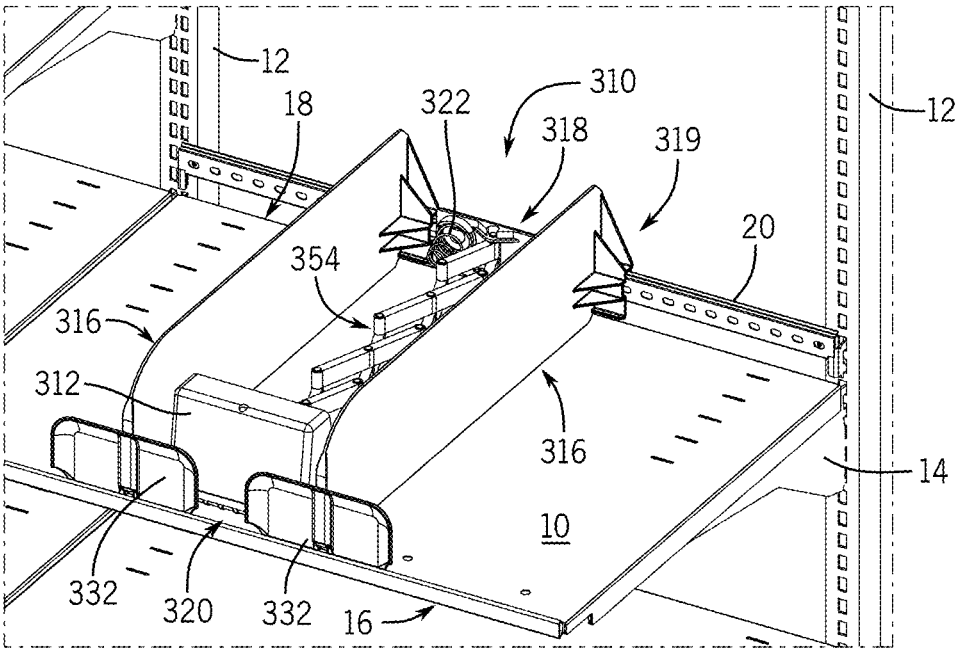
FIG. 17 illustrates the product merchandizer system of FIG. 16, with a pusher paddle in a first position.
Figure 18:
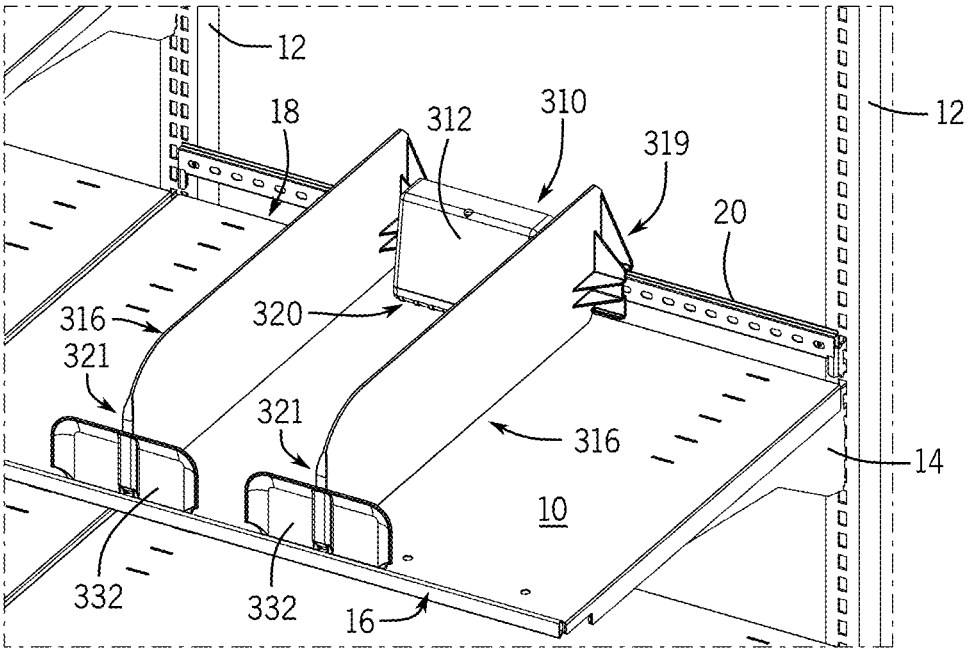
FIG. 18 illustrates the product merchandizer system of FIG. 16, with the pusher paddle in a second position.

The product merchandizer system 300 comprises a pusher assembly 310 configured to push products with which the product merchandizer system 300 is stocked toward the front end 16 of the shelf 10. As shown best in FIGS. 17 and 18, the pusher assembly 310 includes pusher paddles 312 that can move from the front end 16 of the shelf 10 as shown in FIG. 17 (see also left-hand pusher assembly 310 in FIG. 16) to the rear end 18 of the shelf 10 as shown in FIG. 18 (see also right-hand pusher assembly 310 in FIG. 16), as will be described further herein below. At least one partition 316 is configured to project upwardly from the shelf 10 to divide one channel of products (e.g. products 22, FIG. 16) from another channel of products.

Figure 19:
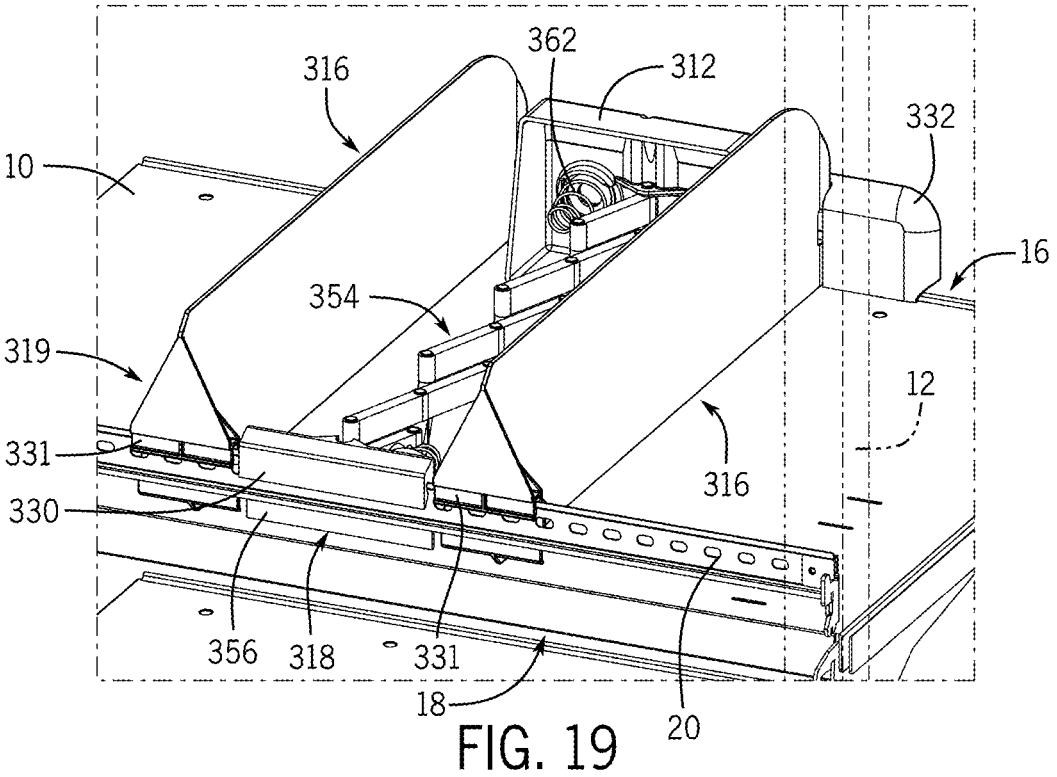
FIG. 19 illustrates a rear perspective view of a pusher assembly and a partition of the product merchandizer system of FIG. 16.
Figure 21:
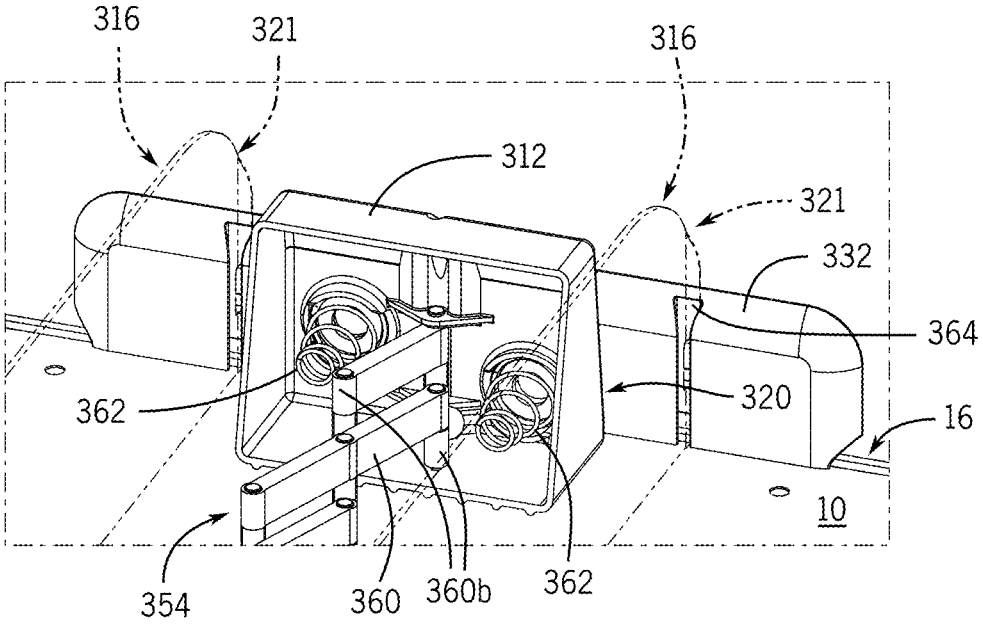
FIG. 21 illustrates a rear perspective view of a front end of the pusher assembly and a front end of the partition of the product merchandizer system of FIG. 16.

As noted hereinabove, the manner of installation of the pusher assembly 310 and the partitions 316 does not require additional components to be attached to or installed on the shelf 10. Rather, the pusher assembly 310 comprises a rear end 318 configured to be clipped to the horizontal bar 20, as best shown in FIGS. 17 and 19, and a front end 220 configured to rest on the shelf 10, as best shown in FIGS. 17, 18, and 21. (Note that in this embodiment, the front end 320 of the pusher assembly 310 is actually the paddle 312.) Likewise, the at least one partition 316 also comprises a rear end 319 configured to be clipped to the horizontal bar 20, as best shown in FIGS. 19 and 22, and a front end 321 configured to rest on the shelf 10 at the front end 16 of the shelf 10, as best shown in FIG. 21.

Figure 20:
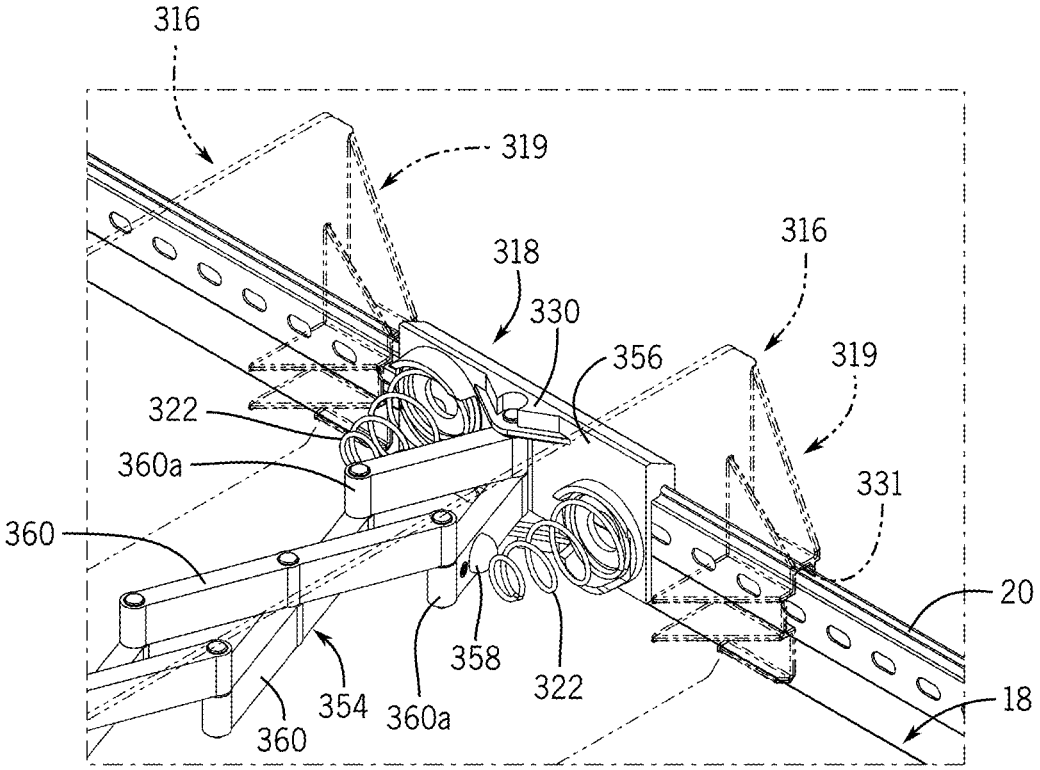
FIG. 20 illustrates a front perspective view of a rear end of the pusher assembly and a rear end of the partition of the product merchandizer system of FIG. 16.

According to the present embodiment, and referring to FIGS. 17 and 20, the pusher assembly 310 comprises a paddle 312 and a spring 322 that biases the paddle 312 toward the front end 16 of the shelf 10. An extensible member 354 couples the spring 322 to the paddle 312. The pusher assembly 310 further comprises a clip feature 330 that couples a rear end of the spring 322 and a rear end of the extensible member 354 to the horizontal bar 20. More specifically, as shown in FIG. 20, two springs 322 are provided, one on each side of a front plate 356 of the clip feature 330 to which the springs 322 and the extensible member 354 are attached. A rear end of each spring 322 is attached to the front plate 356 and a front end of each spring 322 is attached to a rubber stop 358, which is in turn attached (e.g., press fit) to the extensible member 354. Each of the springs 322 is a conical spring, the front end of which coils inside the rear end when fully compressed. As such, the fully compressed springs 322 consume a depth that is more or less the gauge of the wire that forms the springs 322.

The extensible member 354 comprises a series of links 360, pairs of which are crisscrossed in a pivotable fashion with one another (e.g., by way of pins) and attached to an adjacent pair of crisscrossed links 360 in a pivotable fashion (e.g., by way of pins). The number and length of links 360 will depend on the depth of the shelf 10 on which the product merchandizer system 300 is to be installed. As shown in FIG. 20, the two rearmost links **360*a* are not crisscrossed with one another, but are instead pinned to the front plate 356 at a common pivot point. A similar arrangement is provided for coupling the extensible member 354 to the rear face of the paddle 312, as shown in FIG. 21. Here, two additional springs 362 are provided and are connected between the rear face of the paddle 312 and the frontmost links 360*b*. The equal and opposite forces provided by the rear springs 322 and the front springs 362 cause the paddle 312 to move in a front-to-back direction on the shelf 10 without too much play in the side-to-side direction. Further, having springs 322, 362 at both the front and rear ends of the pusher assembly 310 can provide the required spring rate for pushing products across the shelf 10**.

Figure 22:
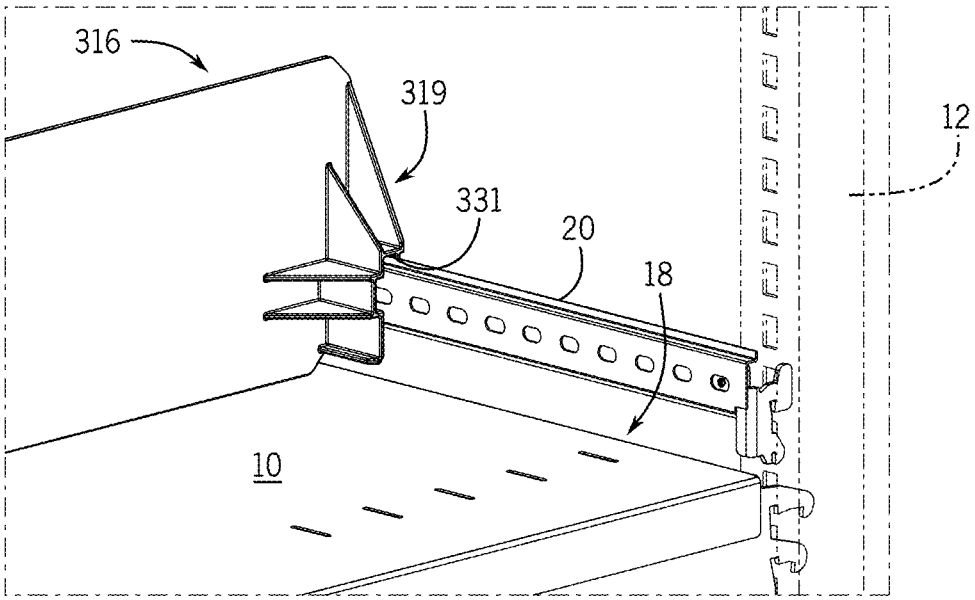
FIG. 22 illustrates a front perspective view of a rear end of the partition of the product merchandizer system of FIG. 16.
Figure 23:
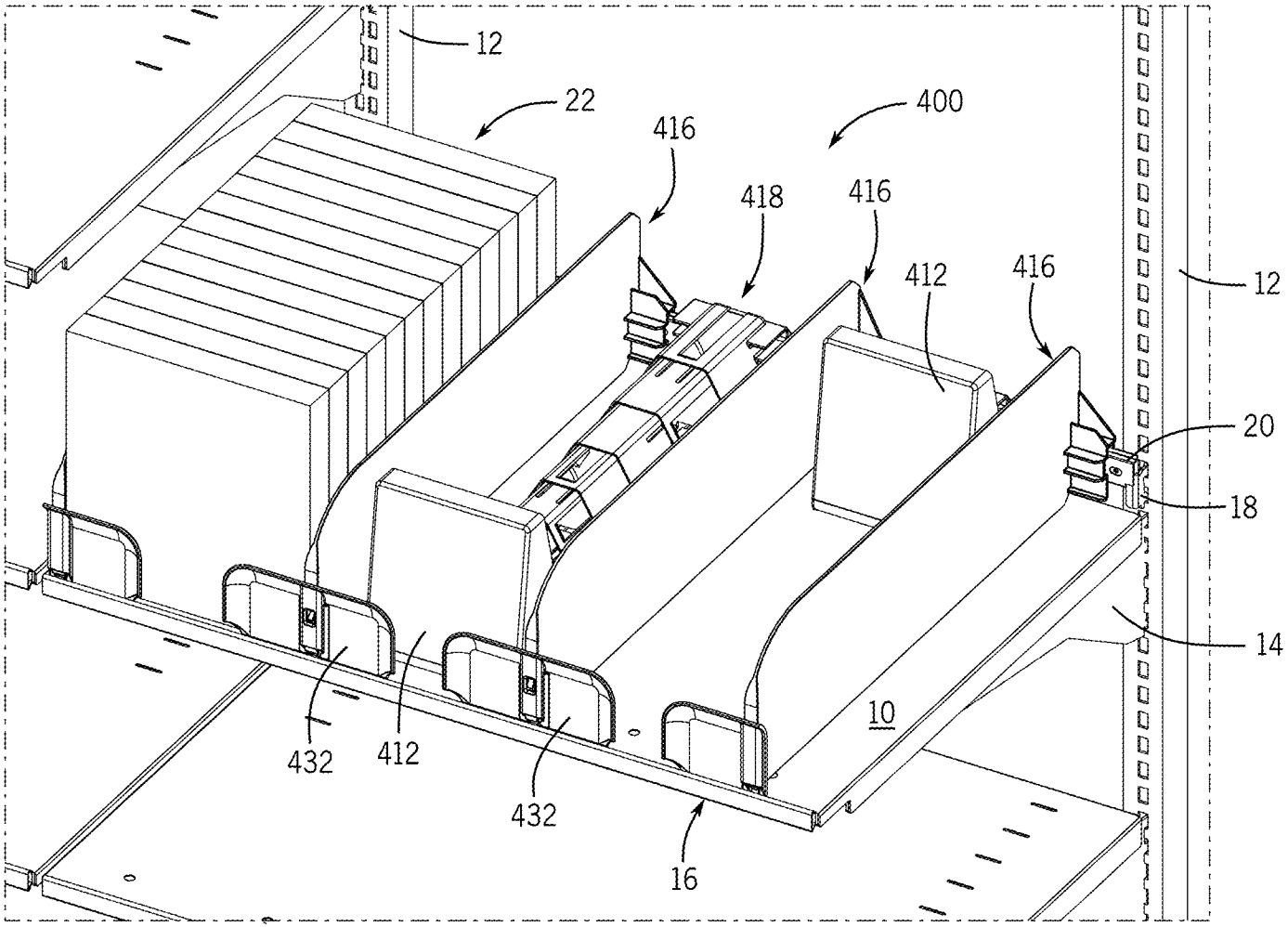
FIG. 23 illustrates another embodiment of a product merchandizer system according to the present disclosure.

As shown in FIGS. 19, 20, and 22, the at least one partition 316 comprises an integral clip feature 331 at rear end 319 thereof, which clip feature 331 is configured to be attached to the horizontal bar 20. At the front end 321 of the partition 316, the partition 316 dovetails into a slot 364 provided in a rear face of the lens 332, as shown in FIG. 21.

The clip feature 330 of the pusher assembly 310 and the clip feature 331 of the partition 316 cam onto the horizontal bar 20 in the same manner as described with respect to the embodiments of FIGS. 1-16.

In some embodiments, a mechanism is provided to prevent overtravel of the paddle 312. For example, a fixed-length wire could be connected between the clip feature 330 and one of the links 360 or pivot pins. In another embodiment, positive stops can be built into the links 360 to prevent overtravel. For example, see protrusions 867 discussed herein below with respect to FIG. 60.

In another embodiment, the springs 322 and extensible member 354 are attached to the horizontal bar 20 by way of a pair of collars, each of which holds an end of a link. The collars are secured to the horizontal bar 20 by way of thumb screws.

Product loaded in the product merchandizer system 300 is pushed toward the front end 16 of the shelf 10 as the bias of the conical springs 322 and 362 tends to extend the links 360, thereby pushing the paddle 312 toward the front end 16 every time a product is removed from the product merchandizer system 300. As the product merchandizer system 300 is restocked with product, the force of the added product pushes the paddle 312 against the force of the springs 322, the links 360 collapse on one another, and the paddle 312 moves toward the rear end 18 of the shelf 10. Thus, the paddle 312 is positionable along the depth of the shelf 10, anywhere between the locations shown in FIGS. 17 and 18.

FIGS. 23-29 show another embodiment of a product merchandizer system 400 according to the present disclosure, which is configured to be installed on a shelf 10. The shelf 10, horizontal bar 20, and other related support components are the same as those described with respect to FIG. 1 and will not be described again.

Figure 24:
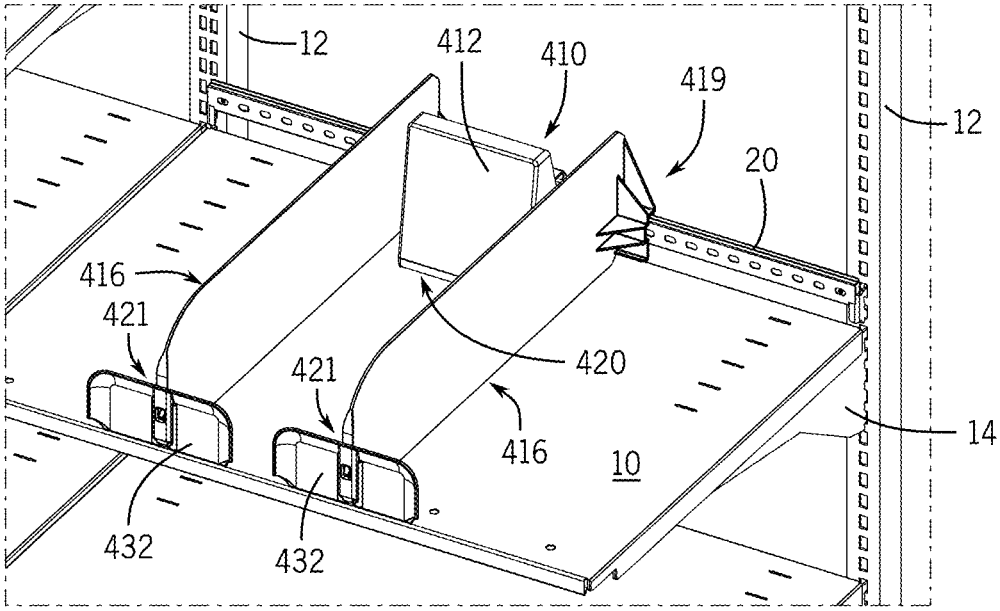
FIG. 24 illustrates the product merchandizer system of FIG. 23, with a pusher paddle in a first position.
Figure 25:
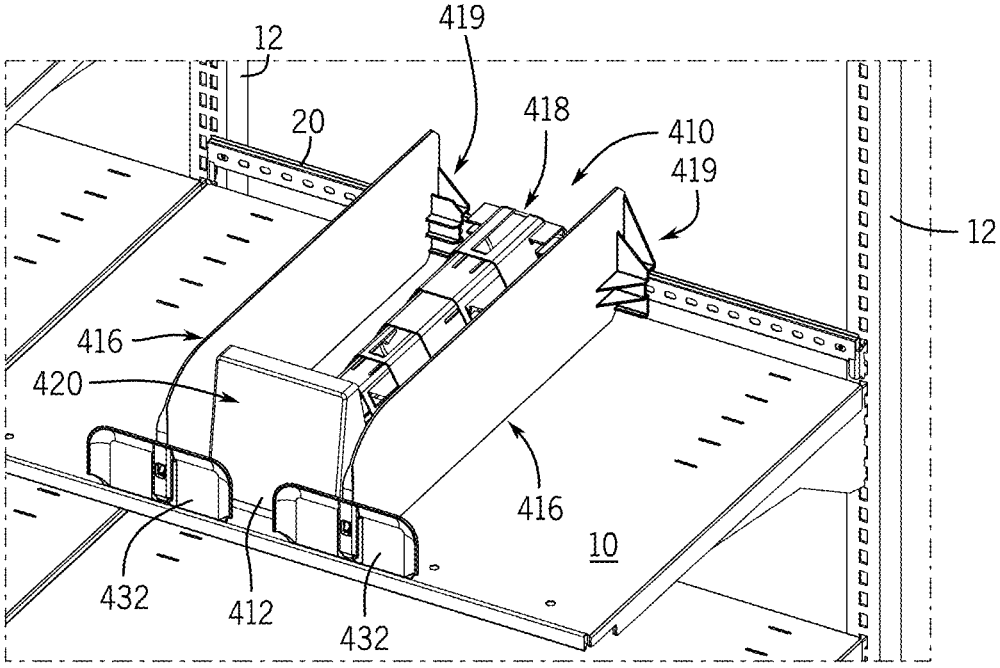
FIG. 25 illustrates the product merchandizer system of FIG. 23, with the pusher paddle in a second position.

The product merchandizer system 400 comprises a pusher assembly 410 configured to push products with which the product merchandizer system 400 is stocked toward the front end 16 of the shelf 10. As shown best in FIGS. 24 and 25, the pusher assembly 410 includes pusher paddles 412 that can move from the front end 16 of the shelf 10 as shown in FIG. 25 (see also left-hand pusher assembly 410 in FIG. 23) to the rear end 18 of the shelf 10 as shown in FIG. 24 (see also right-hand pusher assembly 410 in FIG. 23), as will be described further herein below. At least one partition 416 is configured to project upwardly from the shelf 10 to divide one channel of products (e.g. products 22, FIG. 23) from another channel of products.

Figure 26:
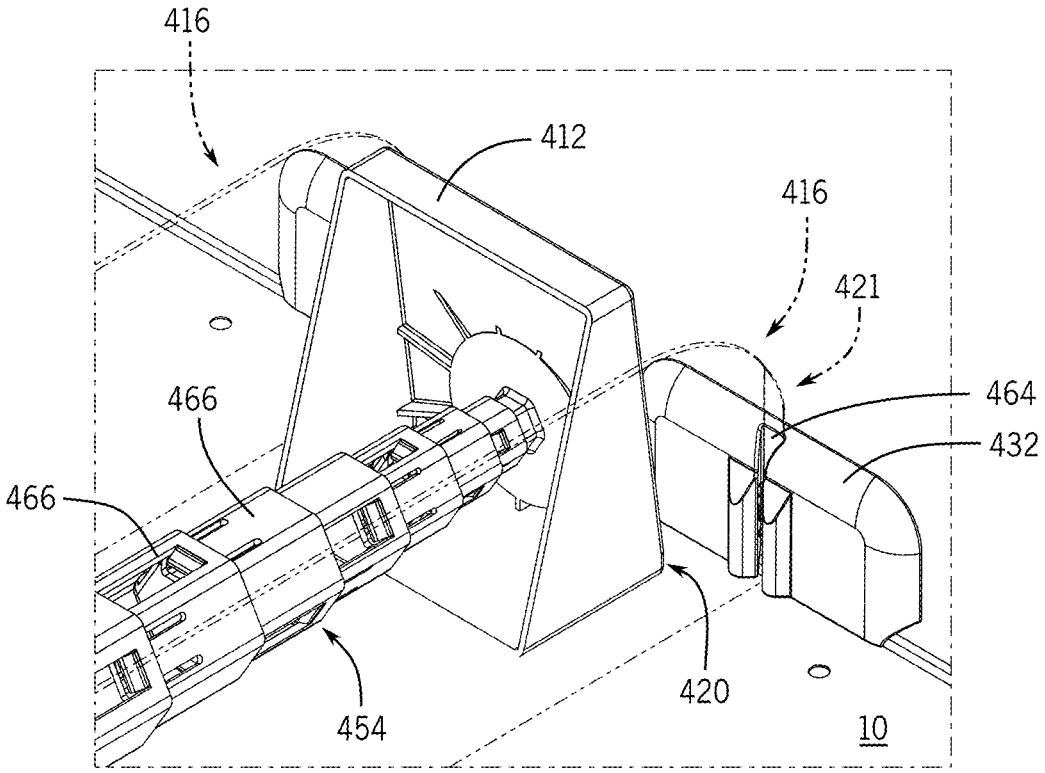
FIG. 26 illustrates a rear perspective view of a front end of a pusher assembly and a front end of a partition of the product merchandizer system of FIG. 23.

As noted hereinabove, the manner of installation of the pusher assembly 410 and the partitions 416 does not require additional components to be attached to or installed on the shelf 10. Rather, the pusher assembly 410 comprises a rear end 418 configured to be clipped to the horizontal bar 20, as best shown in FIGS. 28 and 29, and a front end 420 configured to rest on the shelf 10, as best shown in FIGS. 24-26. (Note that in this embodiment, the front end 420 of the pusher assembly 410 is actually the paddle 412.) Likewise, the at least one partition 416 also comprises a rear end 419 configured to be clipped to the horizontal bar 20, as best shown in FIGS. 27-29, and a front end 421 configured to rest on the shelf 10 at the front end 16 of the shelf 10, as best shown in FIGS. 26 and 28.

According to the present embodiment, and referring to FIGS. 25 and 29, the pusher assembly 410 comprises a paddle 412 and a spring 422 (FIG. 29) that biases the paddle 412 toward the front end 16 of the shelf 10. An extensible member 454 couples the spring 422 to the paddle 412. The pusher assembly 410 further comprises a clip feature 430 that couples a rear end of the spring 422 and a rear end of the extensible member 454 to the horizontal bar 20. The spring 422 is housed within the extensible member 454, with its rear end closer to the clip feature 430 and its front end closer to the paddle 412. The spring 422 is a conical spring, the front end of which coils inside the rear end when fully compressed.

In this embodiment, the extensible member 454 comprises a series of telescoping housings 466, each of which houses a separate conical spring 422. As products are loaded into the channel, the springs in each housing 466 compress and the housings 466, which decrease in size from the rear to the front of the extensible member 454, telescope into one another. When the extensible member 454 is fully compressed, each spring is seated between the rear end of the housing 466 in which it is housed and the rear end of the housing 466 immediately in front of the housing 466 in which the spring is housed. Thus, the entire extensible member 454 collapses down to the depth of the rearmost, largest housing 466.

Figure 27:
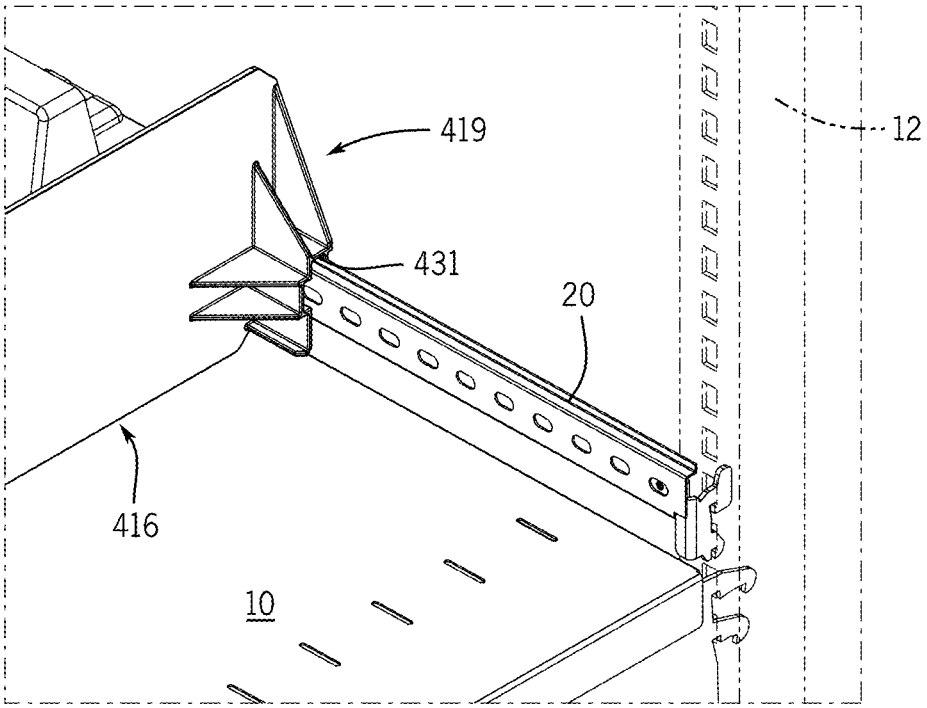
FIG. 27 illustrates a front perspective view of a rear end of the partition of the product merchandizer system of FIG. 23.
Figure 28:
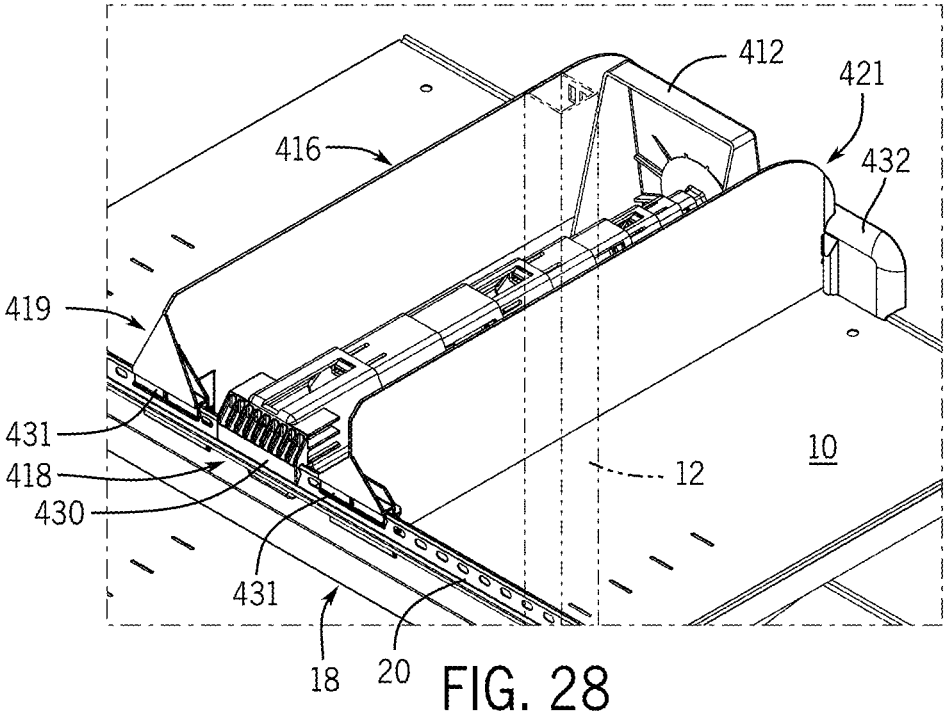
FIG. 28 illustrates a rear perspective view of the pusher assembly and the partition of the product merchandizer system of FIG. 23.
Figure 29:
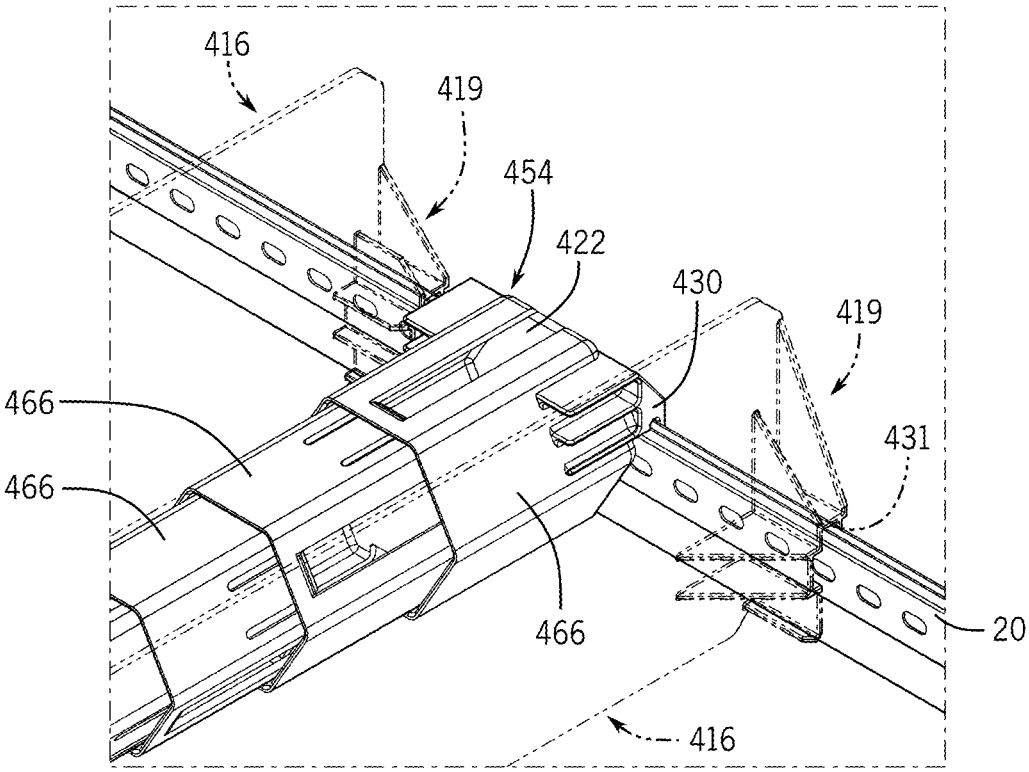
FIG. 29 illustrates a front perspective view of a rear end of the pusher assembly and a rear end of the partition of the product merchandizer system of FIG. 23.

As shown in FIGS. 27-29, the at least one partition 416 comprises an integral clip feature 431 at the rear end 419 thereof, which clip feature 431 is configured to be attached to the horizontal bar 20. At the front end 421 of the partition 416, the partition 416 slides into a slot 464 provided in a rear face of the lens 432, as shown in FIG. 26.

The clip feature 430 of the pusher assembly 410 and the clip feature 431 of the partition 416 cam onto the horizontal bar 20 in the same manner as described with respect to the embodiments of FIGS. 1-23.

It should be understood that many of the above features can be combined or alternated between embodiments. For example, the front end of the partition can be held by a clip configuration similar to that shown in FIG. 6, can rest on the shelf 10 with no supporting structure as shown in FIG. 15, or can dovetail or slide into a slot in the front lens as shown in FIGS. 21 and 26. Furthermore, the clip features provided at the rear ends of the partitions and pusher assemblies can vary in the way they are integrally formed with the remainder of the given component depending on the structural requirements. In still other embodiments, the clip features are not integrally formed with the partitions and pusher assemblies, but are instead manufactured separately and attached to the rear ends of the partitions and pusher assemblies.

In any of the above embodiments, a paddle locking mechanism can be provided. The paddle locking mechanism secures the paddle in the rear (compressed) position in response to the user simply pushing the paddle all the way to the rear end 18 of the shelf 10. This allows store clerks to bulk-load multiple items at a time. The paddle locking mechanism can be a push-push mechanism, such that the paddle is released when the last items are loaded and force is applied backwards through the item pack-out. Alternatively, the paddle locking mechanism can be a push-latch mechanism, which requires a user to undo a latch before the paddle will unlock.

For example, FIGS. 30-36 illustrate an embodiment of a pusher assembly 510 for a product merchandizer system which is configured to be installed on a shelf 10. The shelf 10, horizontal bar 20, and other related support components are the same as those described with respect to FIG. 1 and will not be described again. The illustrated embodiment of the pusher assembly 510 includes a paddle locking mechanism 570 configured to secure the paddle 512 in a collapsed position proximate the rear end 518 of the pusher assembly 510. The paddle 512, rear end 518, and other related components of the pusher assembly 510 are generally the same as those described with respect to FIGS. 16-22 and will not be described again. However, it should be noted that the paddle 512, rear end 518 and extensible member 554 of FIGS. 30-36 are arranged in a different orientation than those of the pusher assembly 310 of FIGS. 16-22. While the paddle 512, rear end 518 and extensible member 554 of FIGS. 30-36 are rotated 90 degrees from the corresponding elements illustrated in FIGS. 16-22, some embodiments of a pusher assembly may include at least one component that is positioned in a different location and/or orientation than those of the illustrated embodiments.

Figure 30:
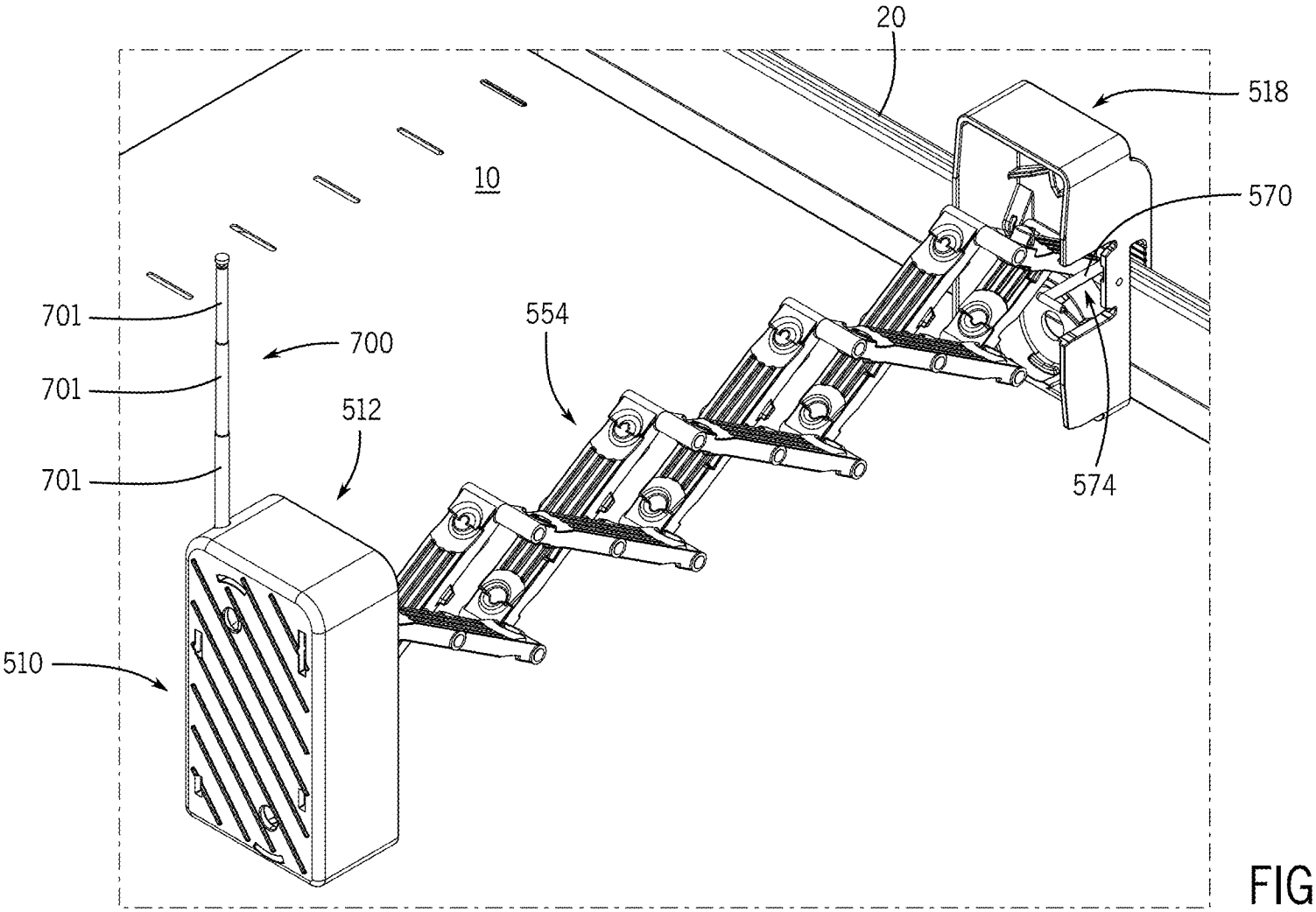
FIG. 30 illustrates a front perspective view of an embodiment of a pusher assembly for a product merchandising system like that of FIG. 16, the pusher assembly including a locking mechanism.
Figure 31:
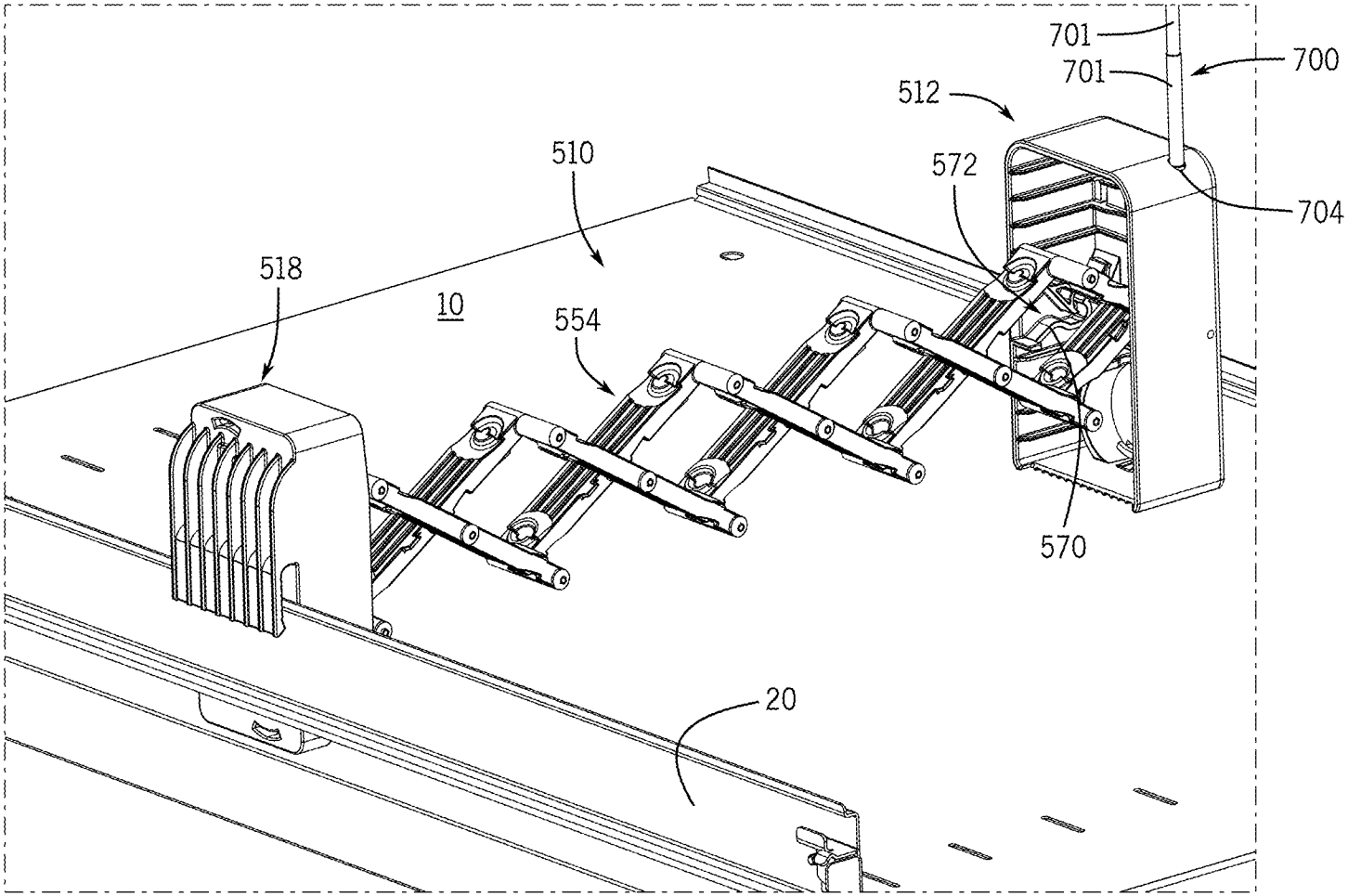
FIG. 31 illustrates a rear perspective view of the pusher assembly of FIG. 30.

Referring to FIGS. 30 and 31, the locking mechanism 570 has a first end 572 positioned on the paddle 512 (FIG. 31) and a second end 574 positioned on the rear end 518 (FIG. 30) of the pusher assembly 510. As discussed in further detail below, the first end 572 is configured to be engaged with the second end 574 to retain the paddle 512 in the collapsed position. In the embodiments of FIGS. 30-36, the first end 572 of the locking mechanism 570 is configured as a cam device 572 and the second end 574 is configured as a spring 574 that is configured to slide into engagement with the cam device 572 in order to retain the paddle 512 in the collapsed position. Some embodiments of a locking mechanism, however, may include a first end on the paddle configured as a spring and a second end on the rear end of the pusher assembly configured as a cam device (see, for example, FIGS. 37-41).

Figure 32:
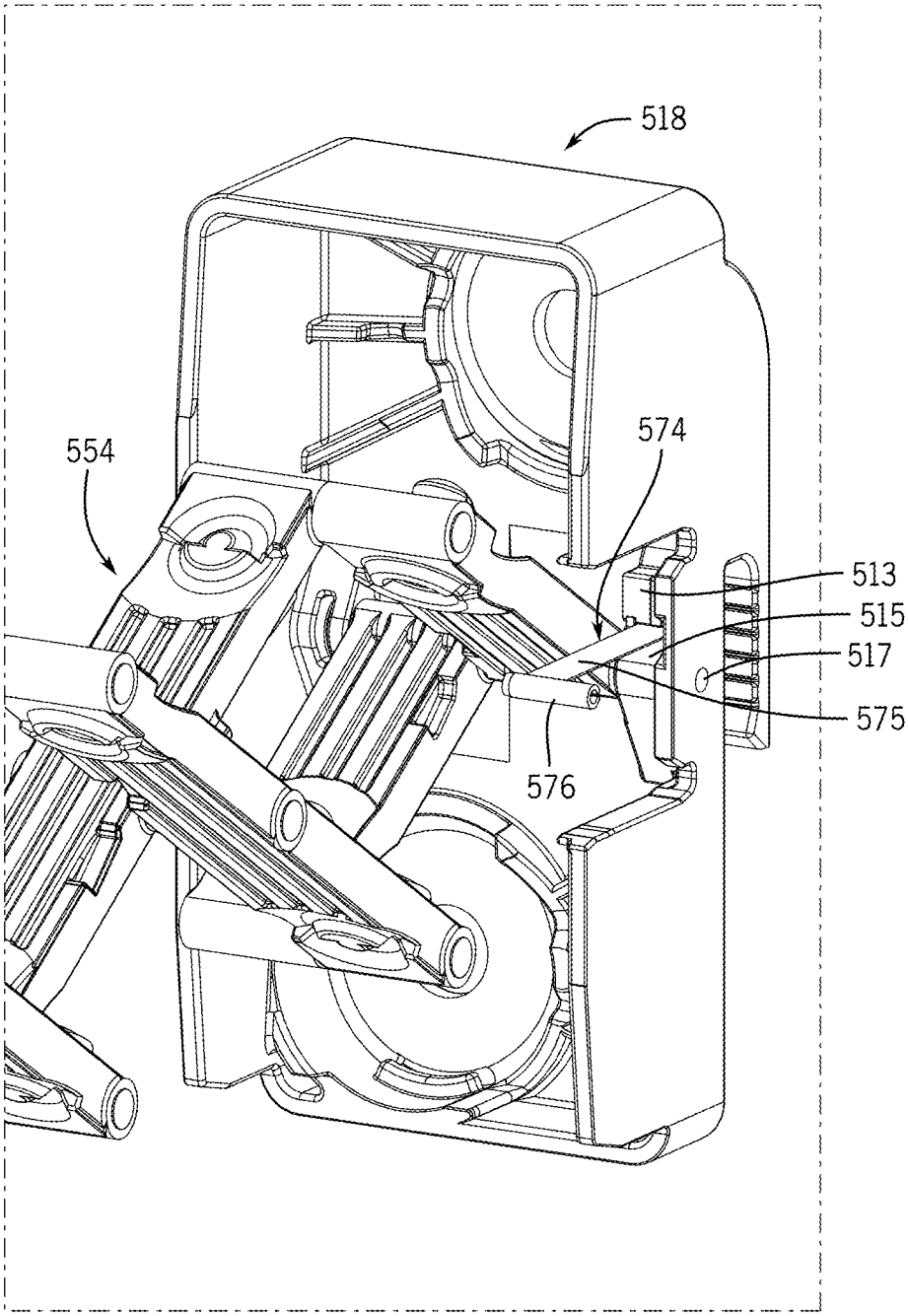
FIG. 32 illustrates a detailed perspective view of the rear end of the pusher assembly of FIG. 31.
Figure 33:
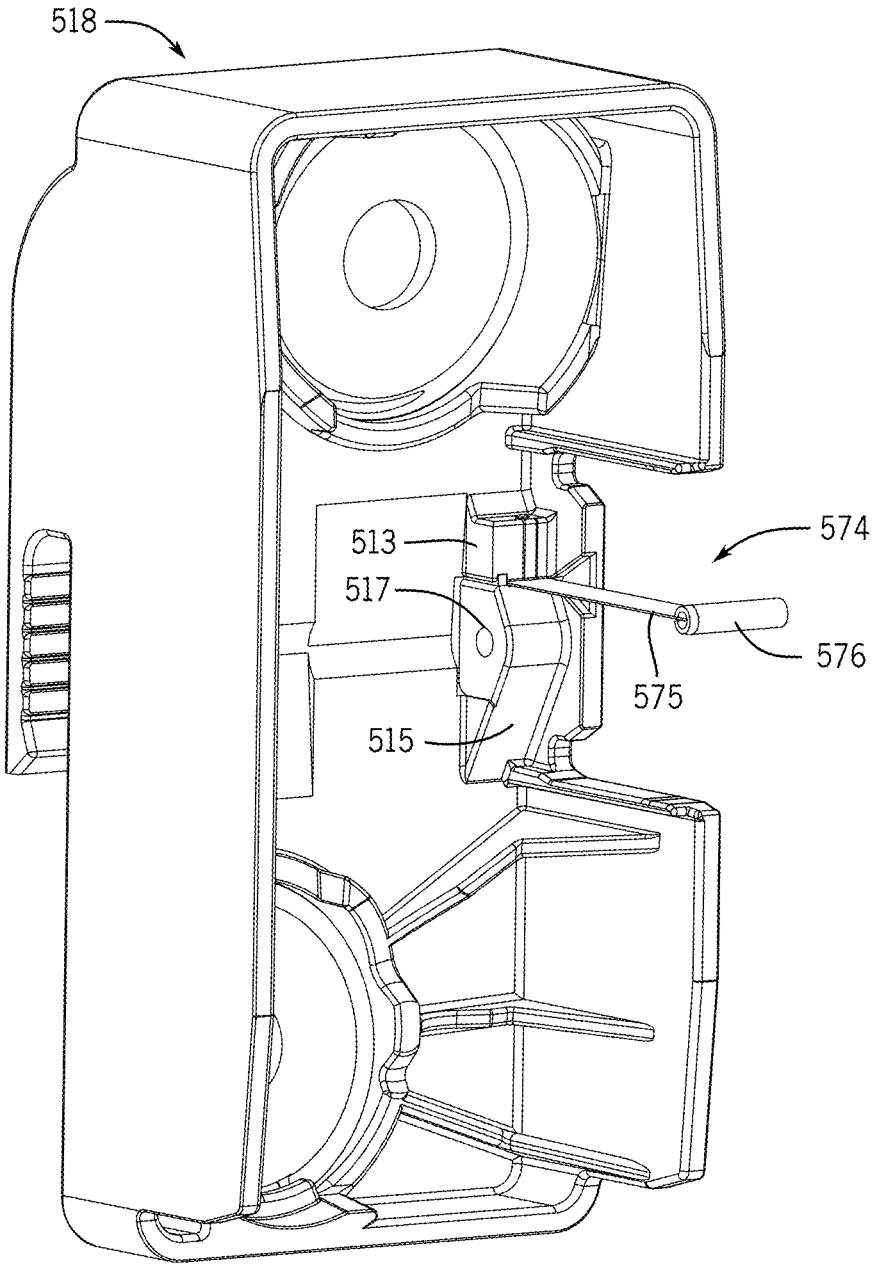
FIG. 33 illustrates a detailed perspective view of the rear end of the pusher assembly of FIG. 32 with other components of the pusher assembly omitted.
Figure 34:
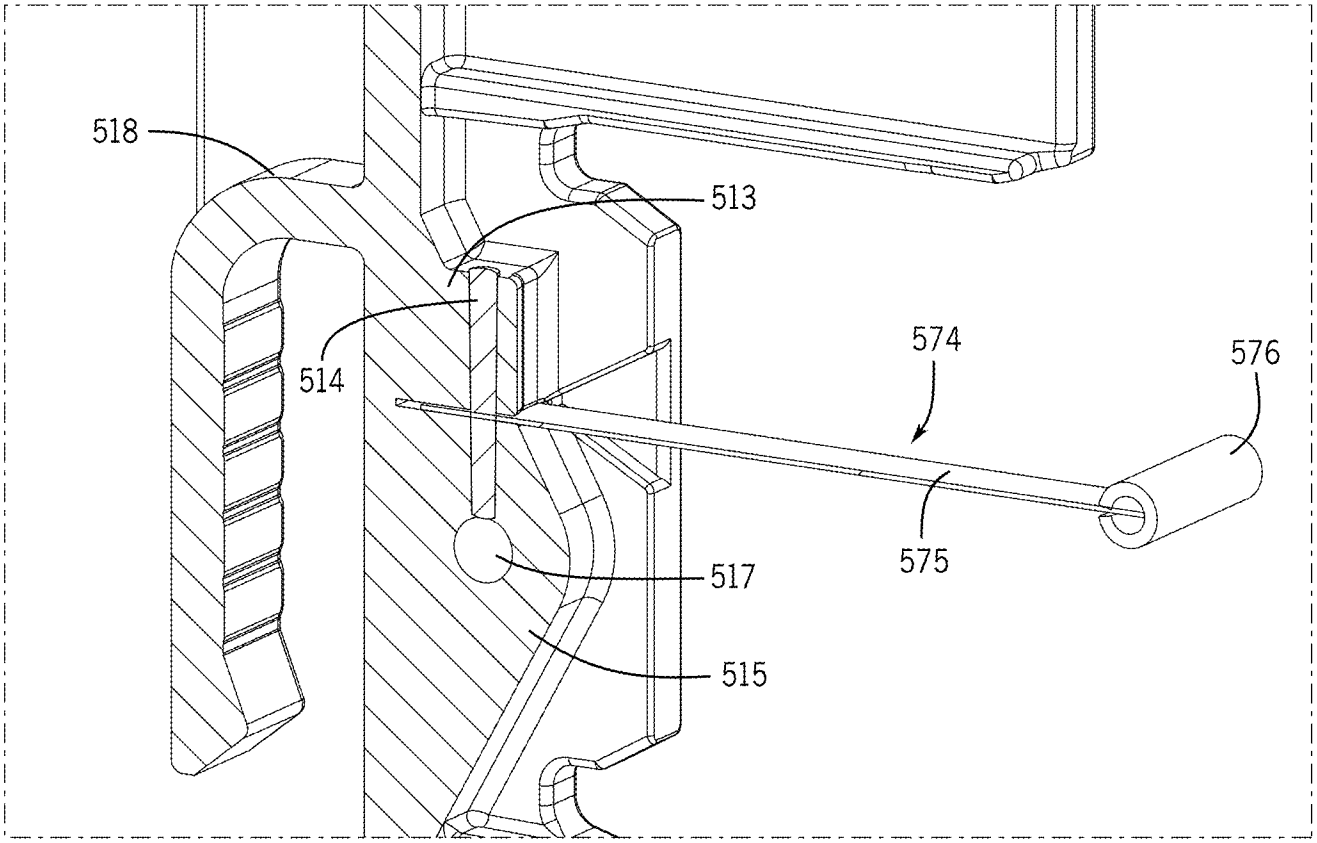
FIG. 34 illustrates a cross-sectional perspective view of a spring of the pusher assembly of FIG. 33.

Referring to FIGS. 32-34, the illustrated spring 574 is a flat spring with a generally planar flat section 575 which extends from a first end coupled to the rear end 518 of the pusher assembly 510 to an opposite second end, and a latch member 576 positioned at the second end of the flat section 575. In the illustrated embodiments, the first end of the flat section 575 is a resiliently deformable member which is secured to the rear end 518 of the pusher assembly 510 between an upper mounting member 513 and a lower mounting member 515. The flat section 575 may be clamped between the upper and lower mounting members 513, 515 and/or a pin 519 (FIG. 34) may extend through the flat section 575 and at least one of the upper mounting member 513 and the lower mounting member 515 to secure the first end of the flat section 575 thereto. Some embodiments may be configured with a different mounting arrangement for the spring 574. For example, embodiments of a spring 574 may include a mounting tab (not shown) extending downward from a lateral side of the flat section 575. In such an embodiment, the mounting tab may extend downward along the side of the lower mounting member 515 such that the mounting tab may be engaged by a pin (not shown) that extends through the mounting tab and into an opening 517 in the lower mounting member 515. Additionally or alternatively, such a mounting tab may be engaged by a pin that extends laterally across the rear end 518 of the pusher assembly 510 and engages the opening 517 in order to couple the extensible member 554. For example, see pin 873 in the embodiment shown in FIGS. 51 and 52.

In the illustrated embodiments, the spring 574 has a generally tubular latch member 576 that is coupled to the second end of the resiliently deformable flat section 575. Some embodiments, however, may be differently configured. For example, embodiments of a spring 574 may be formed from a generally flat sheet of metal and/or another resiliently deformable material. In such an embodiment, the latch member 576 may be formed by hemming the second end of the flat section 575 to form the generally tubular shape. In embodiments of a spring 574 including a mounting tab, the mounting tab may be formed by bending material at the first end downward. In order to achieve a desired flexibility and resiliency of a spring 574 formed from a sheet of metal, the bent and hemmed spring 574 may be heat treated in order to alter the material properties of the spring 574.

Figure 35:
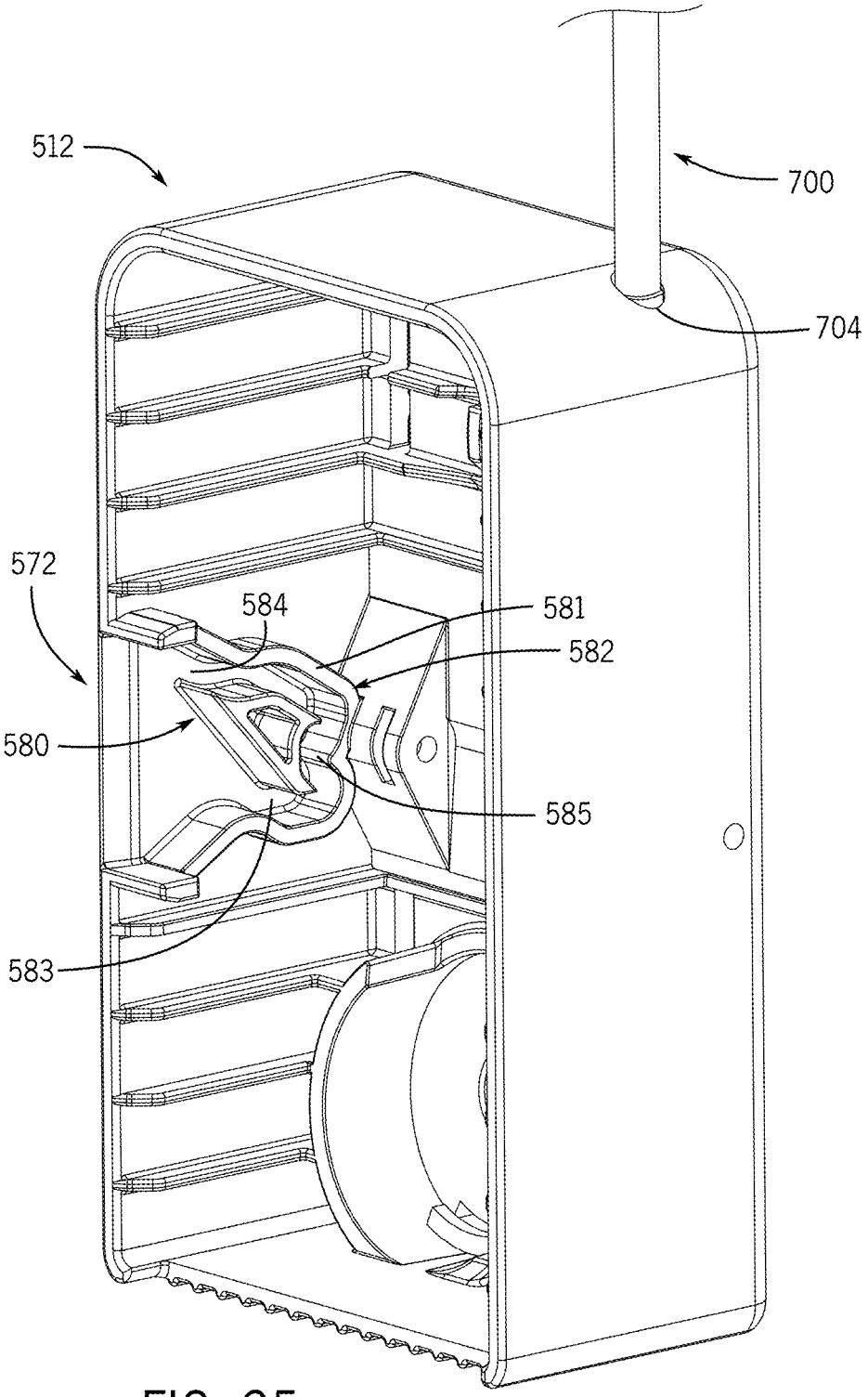
FIG. 35 illustrates a perspective view of the paddle of the pusher assembly of FIG. 31 with other components of the pusher assembly omitted.
Figure 36:
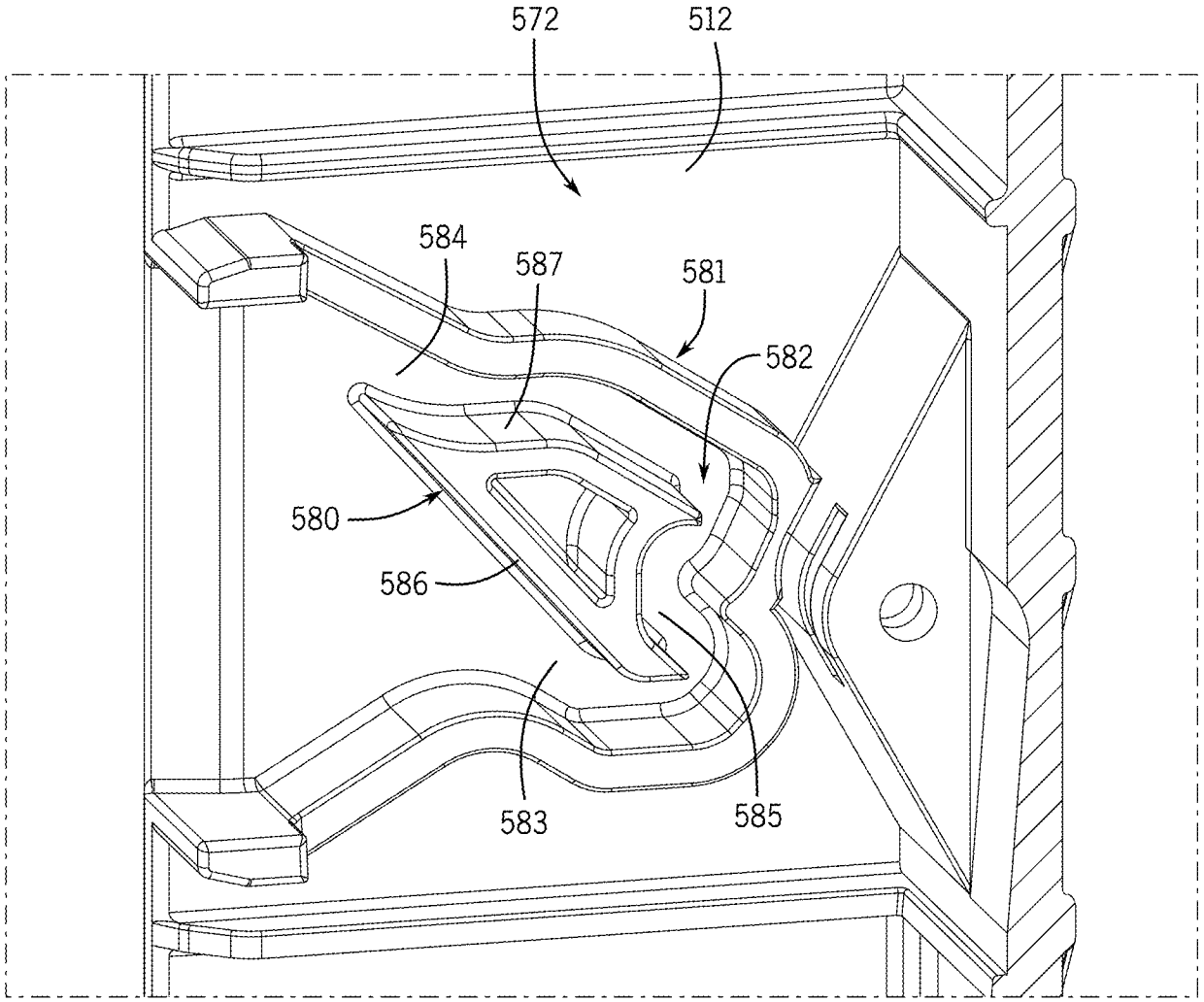
FIG. 36 illustrates a cross-sectional perspective view of a cam device of the pusher assembly of FIG. 35.

Referring to FIGS. 35 and 36, the cam device 572 on the paddle 512 includes a baffle member 580 and a wall member 581 that together form a serpentine path 582 between the baffle member 580 and the wall member 581. The serpentine path 582 extends from a first opening 583 into the cam device 572 positioned at a lower end of the cam device 572 to a second opening 584 positioned at an upper end of the cam device 572. A latch recess 585 is formed in the serpentine path 582 between the first and second openings 583, 584.

Referring to FIGS. 32-36, the illustrated locking mechanism 570 is configured as a push-push locking mechanism 570 that is movable into and between a locked position and a disengaged position by pushing the paddle 512 towards the rear end 518 of the pusher assembly 510. As the paddle 512 slides towards the rear end 518 of the pusher assembly 510, the latch member 576 at the second end of the flat section 575 is configured to slide into engagement with the cam device 572 to move the locking mechanism 570 into a locked position in which the paddle 512 is retained in the collapsed position. In particular, as the paddle 512 slides towards the rear end 518 of the pusher assembly 510, the latch member 576 moves into abutment with a ramped surface 586 of the baffle member 580, which is configured to bias the latch member 576 of the spring 574 downward and into the first opening 583. Once the latch member 576 of the spring 574 is received in the serpentine path 582 via the first opening 583, the springiness of the flat section 575 biases the latch member 576 upwards through the serpentine path 582 and into the latch recess 585, thereby placing the locking mechanism 570 in the locked position. To unlock the locking mechanism 570, the paddle 512 is again pushed towards the rear end 518 of the pusher assembly 510. As the paddle 512 moves towards the rear end 518 while the locking mechanism 570 in the locked position, the sides of the serpentine path 582 and/or the springiness of the flat section 575 bias the latch member 576 upwards in the serpentine path 582. When pressure on the paddle 512 is thereafter released, the paddle 512 is biased away from the rear end 518 (for example by a spring similar to the spring 322 of FIGS. 29-36), thereby pulling the latch member 576 forward. An upper ramp surface 587 of the baffle member 580 biases the latch member 576 upward towards the second opening 584. Continued movement of the paddle 512 toward the front of the shelf causes the latch member 576 to exit the cam device 572 via the second opening 584, thereby placing the locking mechanism 570 in the unlocked position.

In the embodiments of FIGS. 30-36, the pusher assembly 510 includes one locking mechanism 570 positioned proximate a lateral side of the paddle 512 and the rear end 518 of the pusher assembly 510. Some embodiments, however, may be configured with at least one additional locking mechanism, which may be the same as or different than the illustrated locking mechanism 570, at another location on the paddle 512, the rear end 518 of the pusher assembly 510, and/or any other portion of the merchandizer system.

It should be appreciated that the locking mechanism 570 of FIGS. 30-36 may be used with any other embodiments of a pusher assembly, such as the pusher assemblies 110, 210, 310, 410 disclosed herein. Additionally or alternatively, some embodiments of a locking mechanism may be differently configured. For example, FIGS. 37-41 illustrate an embodiment of a pusher assembly 610 that includes a differently configured locking mechanism 670. The shelf 10, horizontal bar 20, and other related support components are the same as those described with respect to FIG. 1 and will not be described again. The paddle 612, rear end 618, and other related components of the pusher assembly 610 of FIGS. 37-41 are generally the same as those described with respect to FIGS. 1-7. Thus, these components will not be described again.

Similar to the locking mechanism 570 of FIGS. 30-36, the locking mechanism 670 of FIGS. 37-41 has a first end 672 (FIG. 38) on the paddle 612 and a second end 674 (FIG. 37) on the rear end 618 of the pusher assembly 610 that is configured to be engaged by the first end 672. Unlike the locking mechanism 570 of FIGS. 30-36, however, the locking mechanism 670 of FIGS. 37-41 has a first end 672 on the paddle 612 configured as a spring 672 (similar to the spring 574) and a second end 674 on the rear end 618 configured as a cam device 674 (similar to the cam device 572). That is, the first and second ends 672, 674 of FIGS. 37-41 are reversed from those of FIGS. 30-36.

Figure 39:
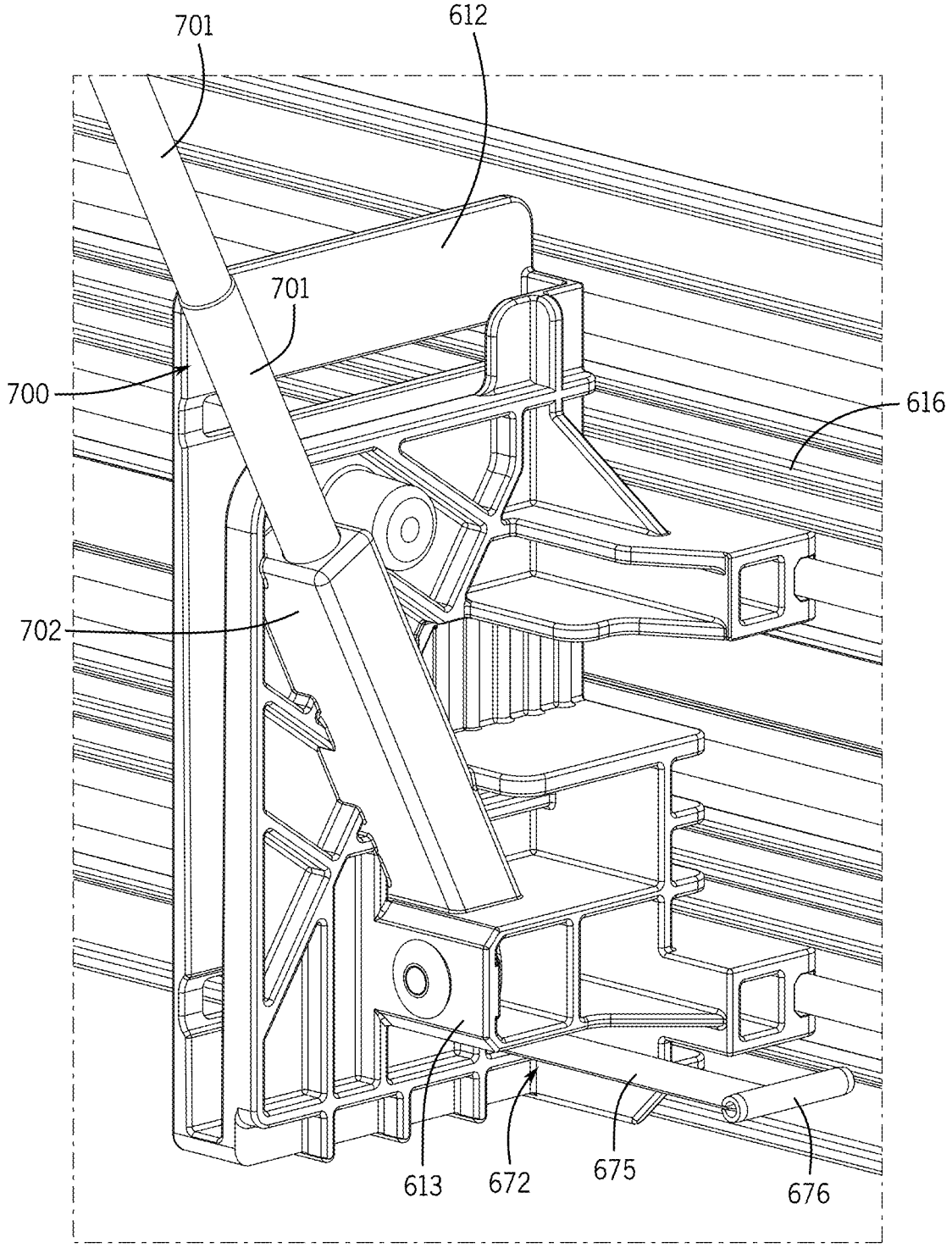
FIG. 39 illustrates a detailed perspective view of a spring of the pusher assembly of FIG. 38.
Figure 40:
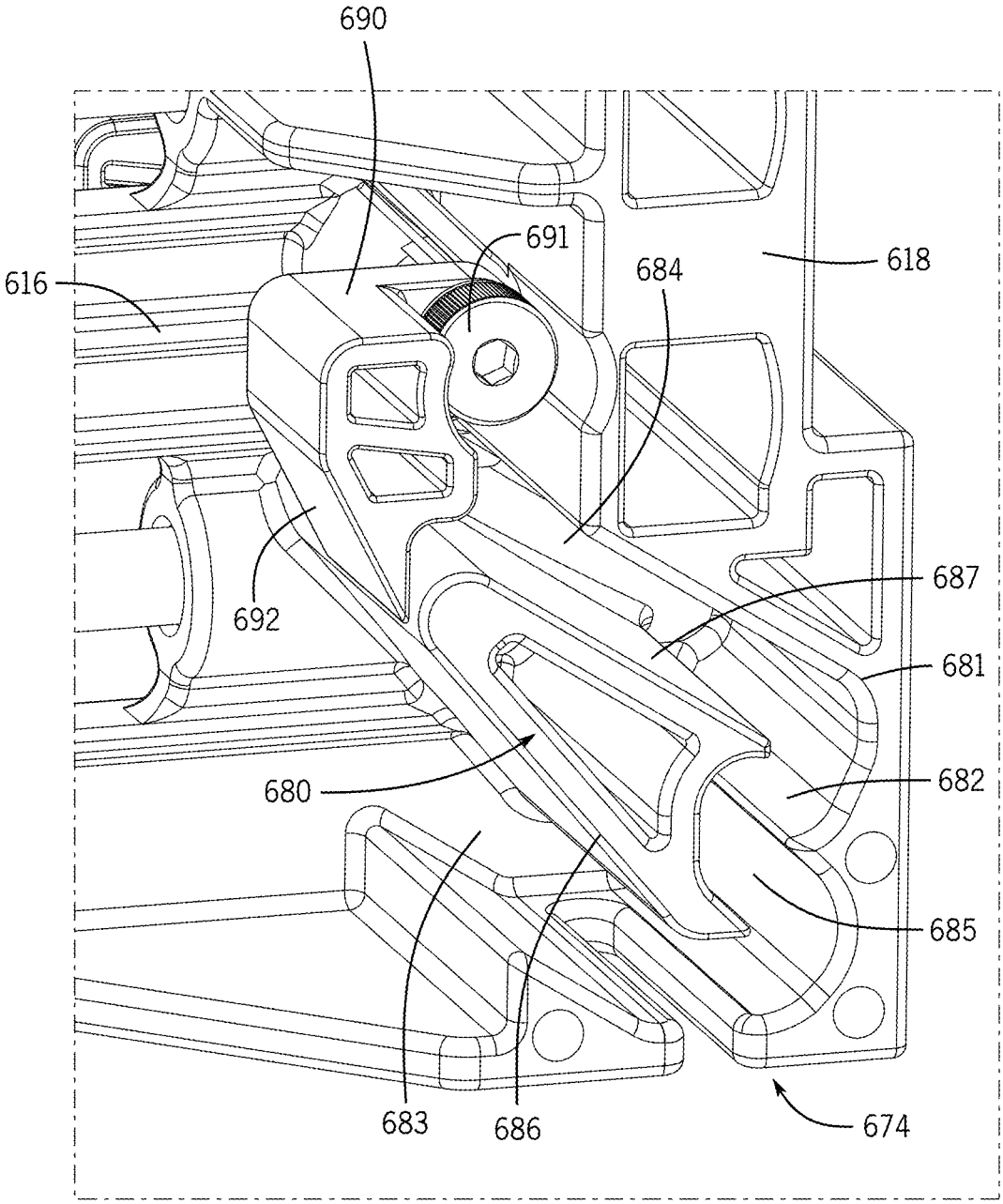
FIG. 40 illustrates a detailed perspective view of a cam device of the pusher assembly of FIG. 38.
Figure 41:
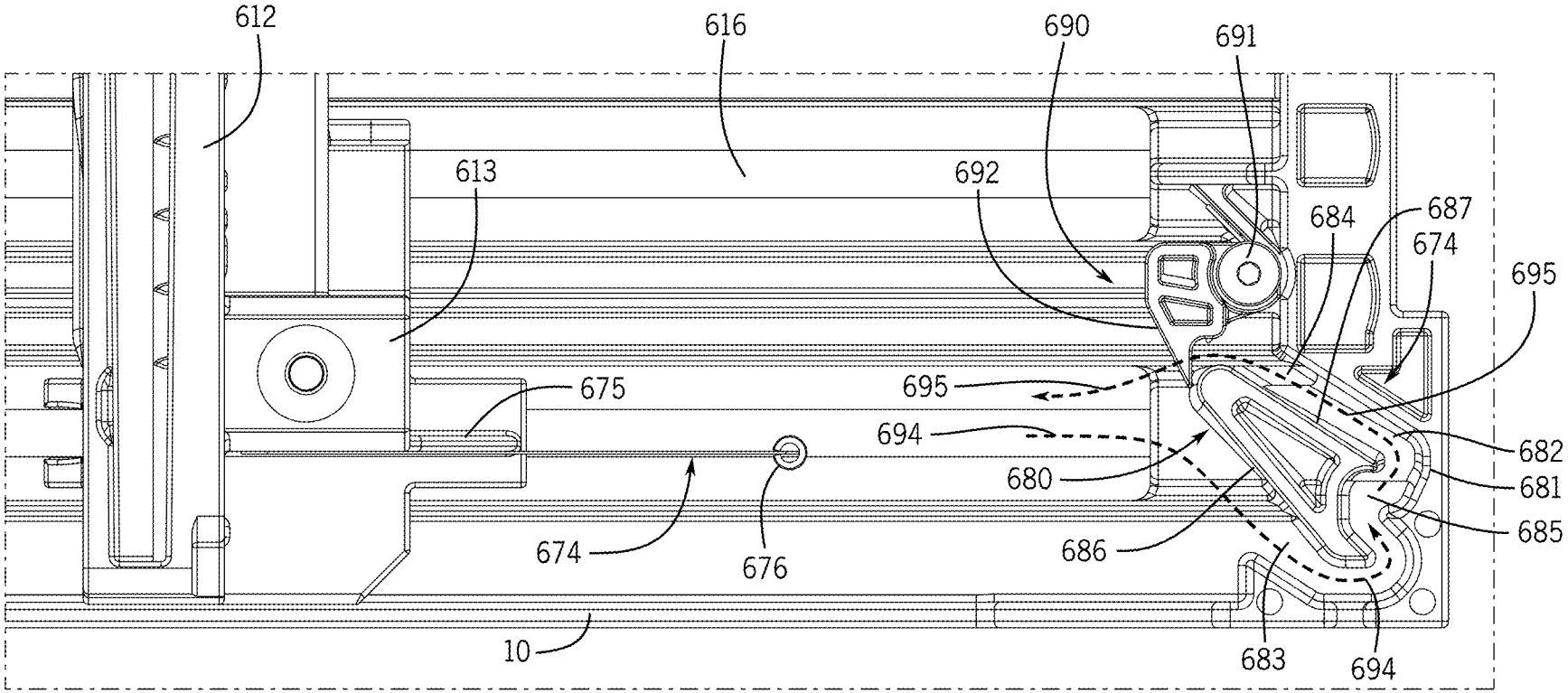
FIG. 41 illustrates a side cross sectional view of the pusher assembly of FIG. 37.

As illustrated in FIGS. 39 and 41, the spring 672 is a flat spring with a generally planar flat section 675 which extends from a first end coupled to the paddle 612 to a latch member 676 at the opposite second end. The first end of the flat section 675 is secured to a mounting member 613 formed on the paddle 612. Referring to FIGS. 40 and 41, the cam device 674 includes a serpentine path 682 that is formed between a baffle member 680 and a wall member 681 and extends between first and second openings 683, 684. As previously discussed in reference to FIGS. 32-36, as the paddle 612 is moved towards the rear end 618 of the pusher assembly 610, the baffle member 680 and the wall member 681 are configured to guide the latch member 676 into the latch recess 685 within the serpentine path 682, thereby placing the locking mechanism 670 in the locked position. For example, the latch member 676 may enter the serpentine path 682 and move into the latch recess 685 along the path indicated by arrow 694 in FIG. 41. When the paddle 612 is again pushed towards the rear end 618 of the pusher assembly 610, the latch member 676 is forced upwards through the serpentine path 682 and out of the cam device, for example along the path indicated by arrow 695 in FIG. 41, in order to place the locking mechanism 670 in the unlocked position.

Additionally or alternatively, some embodiments of a locking mechanism 670 may include a movable locking member configured to assist in guiding the latch member 676 into the cam device 674, thereby entering the serpentine path 682 (for example along paths indicated by arrow 694 and arrow 695), and/or to retain the latch member 676 in the serpentine path 682. For example, referring to FIGS. 40 and 41, the second end 674 of the locking mechanism 670 includes a rotating lock member 690. The lock member 690 is pivotably coupled to the rear end 618 of the pusher assembly 610 by a fastener 691 and is movable between a closed position (FIGS. 40 and 41) in which the second opening 684 into the serpentine path 682 is blocked and an open position (not shown) in which the lock member 690 is rotated about the fastener 691 and away from the second opening 684. When the lock member 690 is in the closed position (FIG. 41), an outer ramped surface 692 of the lock member 690 is at least partially aligned with the ramped surface 686 of the baffle member 680 such that the outer ramped surface 692 may guide the latch member 676 downward towards the ramped surface 686 of the baffle and/or into the serpentine path 682 via the first opening 683. This may be useful, for example, in order to prevent the latch member 676 from entering the serpentine path 682 in the reverse direction via the second opening 684.

Figure 42:
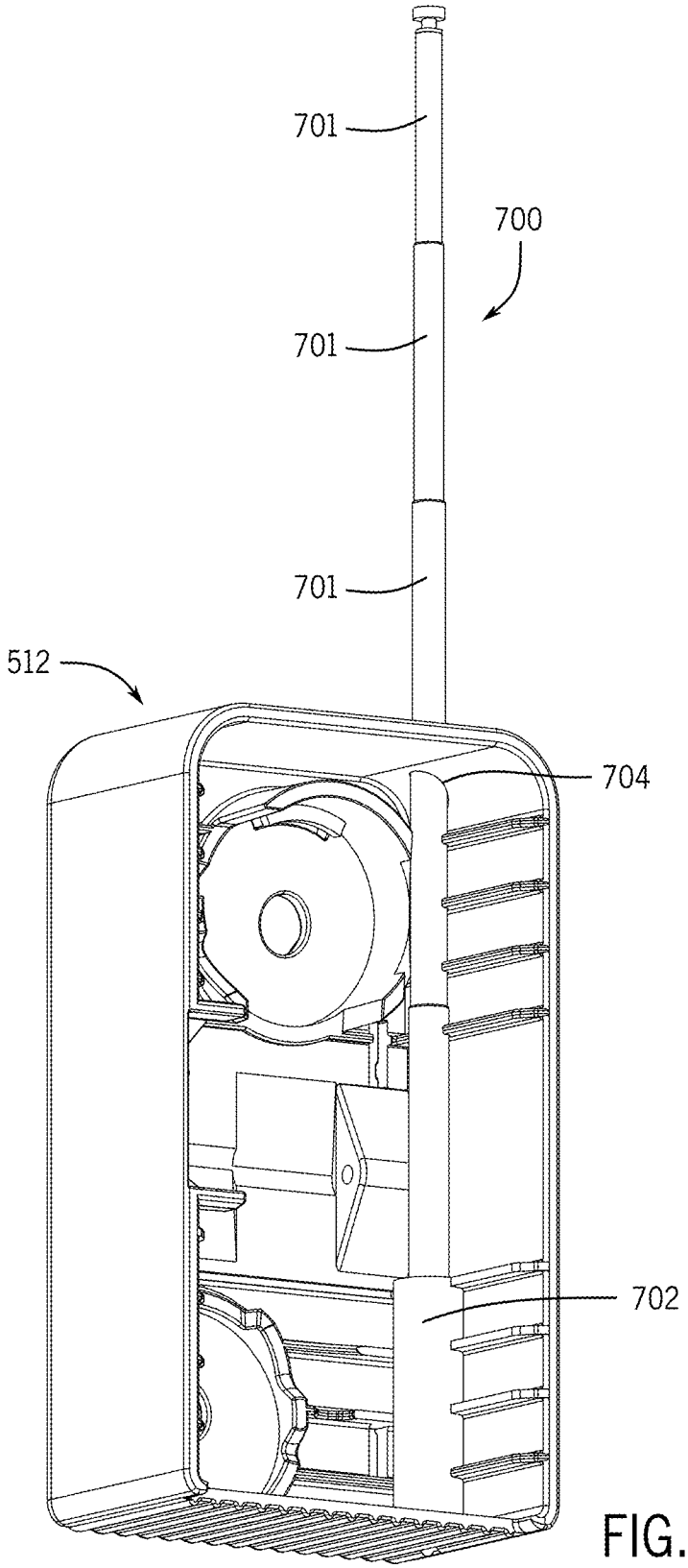
FIG. 42 illustrates a rear perspective view of the paddle of the pusher assembly of FIG. 35.
Figure 43:
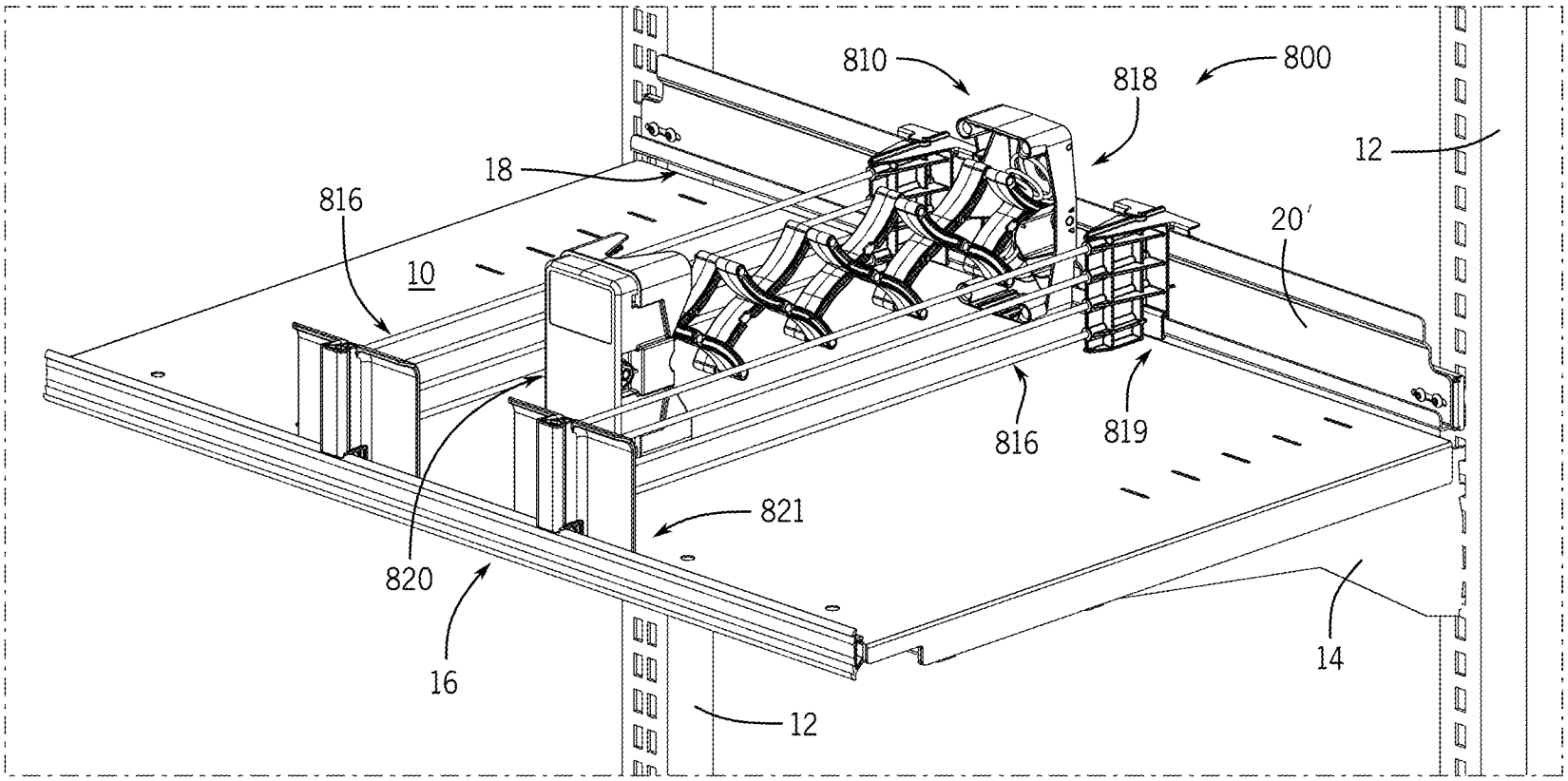
FIG. 43 illustrates another embodiment of a product merchandizer system according to the present disclosure.

In any of the embodiments described herein, the paddle may be vertically adjustable to prohibit taller merchandise from falling behind the paddle. Additionally or alternatively, embodiments of the paddle may be configured with a vertically adjustable extender configured to prohibit the products from falling between the paddle and the rear end of the pusher assembly. For example, the pusher assembly of FIGS. 30-36 may be configured with an extender 700 that is positioned on the paddle 512 and can be extended and retracted in the vertical direction. Referring to FIGS. 30 and 42, the illustrated extender 700 is configured as a telescoping extender 700 with a plurality of concentrically disposed segments that can be retracted into each other to retract the extender and extended out from each other to vertically extend the extender. This may be useful, for example, in order to adjust the height of the extender 700 based on the dimensions of the shelves that the product merchandizer is installed on. As illustrated in FIG. 42, the telescoping extender 700 is coupled to a mounting member 702 on the paddle 512 and extends upwards through an opening 704 formed in the top side of the paddle 512.

Figure 37:
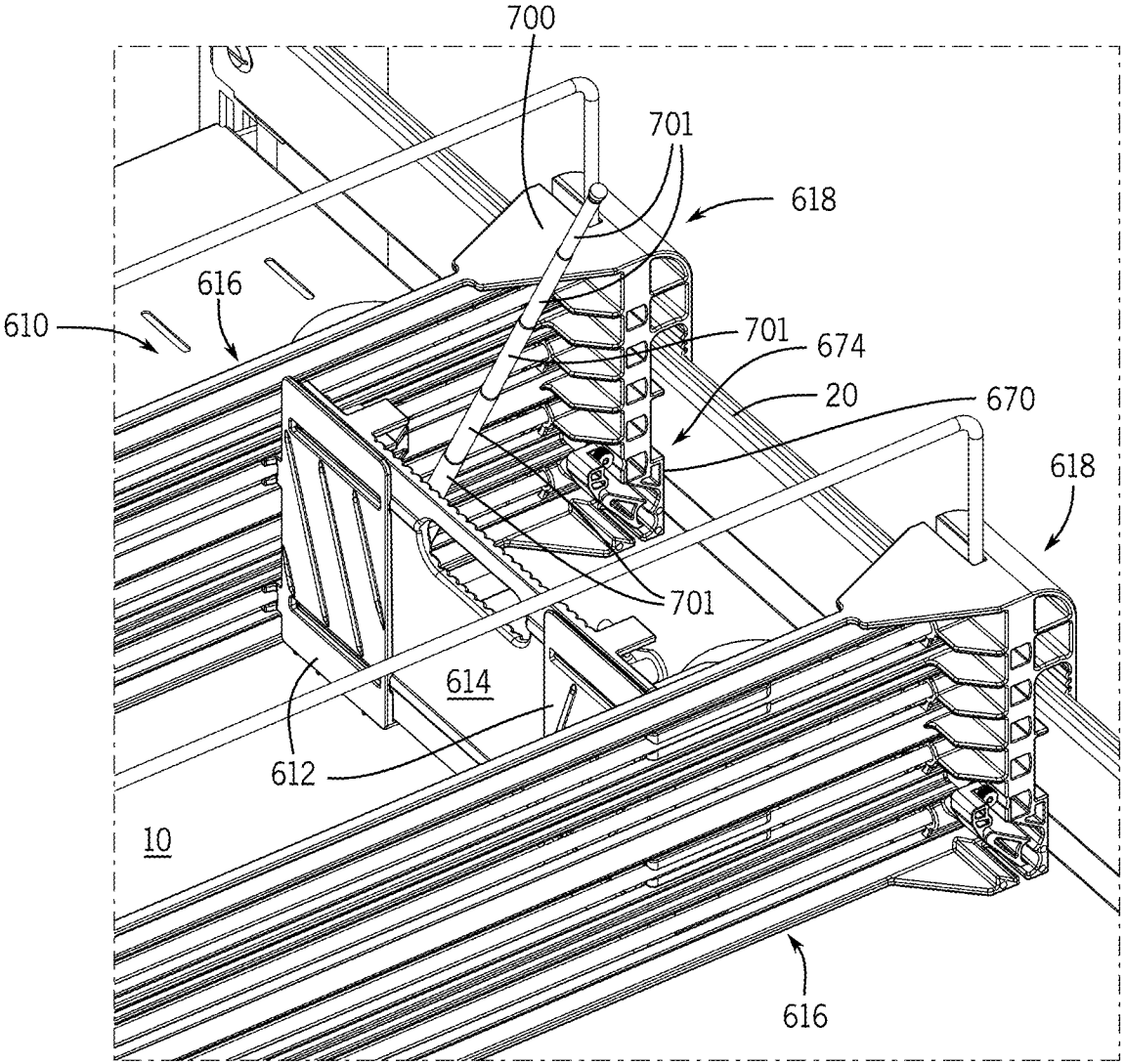
FIG. 37 illustrates a front perspective view of another embodiment of a pusher assembly for a product merchandising system like that of FIG. 1, the pusher assembly including a locking mechanism.
Figure 38:
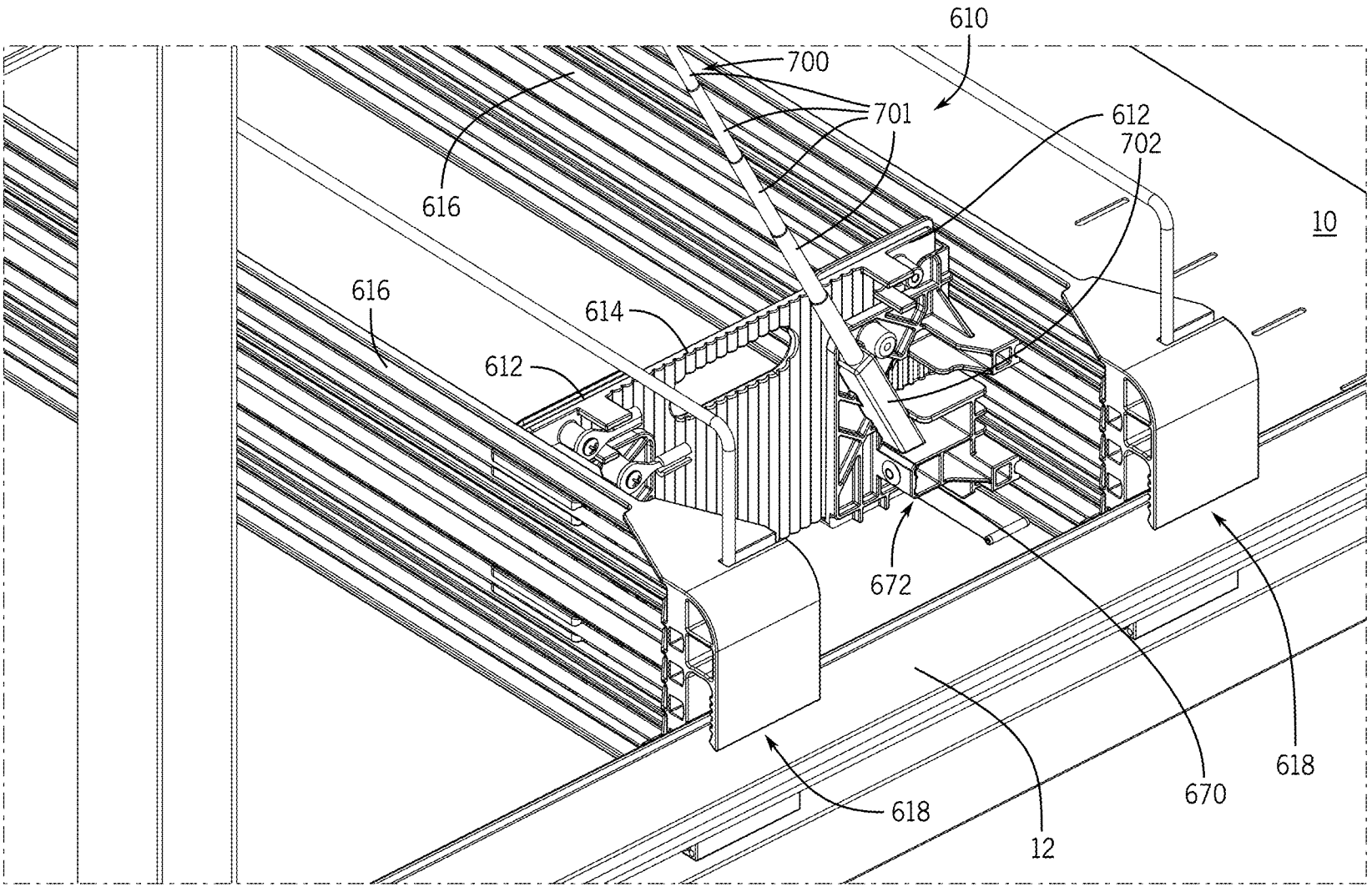
FIG. 38 illustrates a rear perspective view of the pusher assembly of FIG. 37.

Referring to FIGS. 37 and 39, the pusher assembly 610 of FIGS. 37-41 includes a telescoping extender 700 positioned on the paddle 612. The telescoping extender 700 is secured to a mounting member 702 on the paddle 612 and extends upwards therefrom. The illustrated extender 700 is mounted to the paddle 612 at an angle (as opposed to the extender of FIGS. 30-36 and 42, which generally extends straight upwards). This may be useful, for example, so that the extender 700 extends laterally across the width of the pusher assembly 610.

Figure 44:
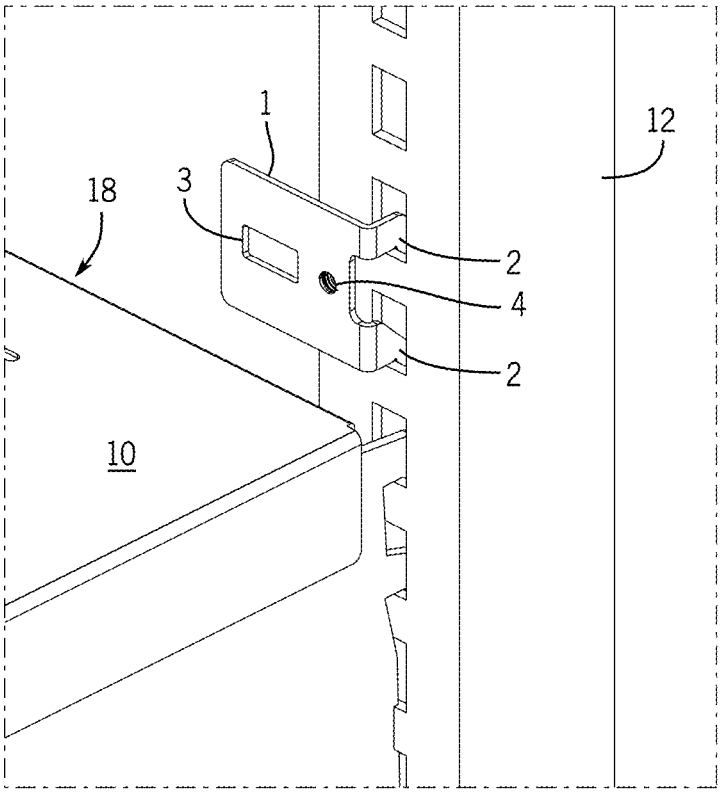
FIG. 44 shows a rear bracket for attaching a horizontal bar to a vertical upright as shown in FIG. 43.
Figure 45:
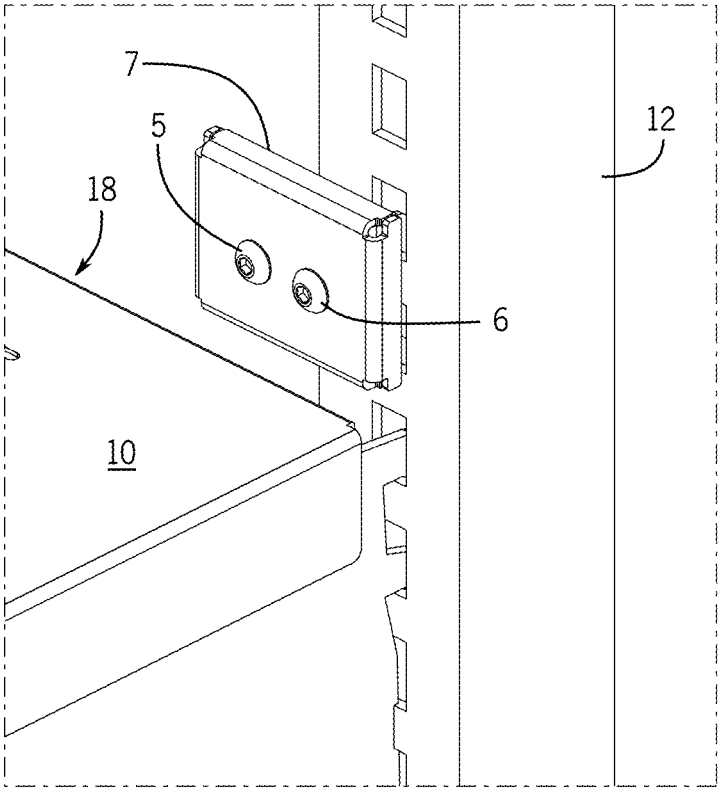
FIG. 45 shows a front bracket attached to the rear bracket for attaching a horizontal bar to a vertical upright as shown in FIG. 43.
Figure 46:
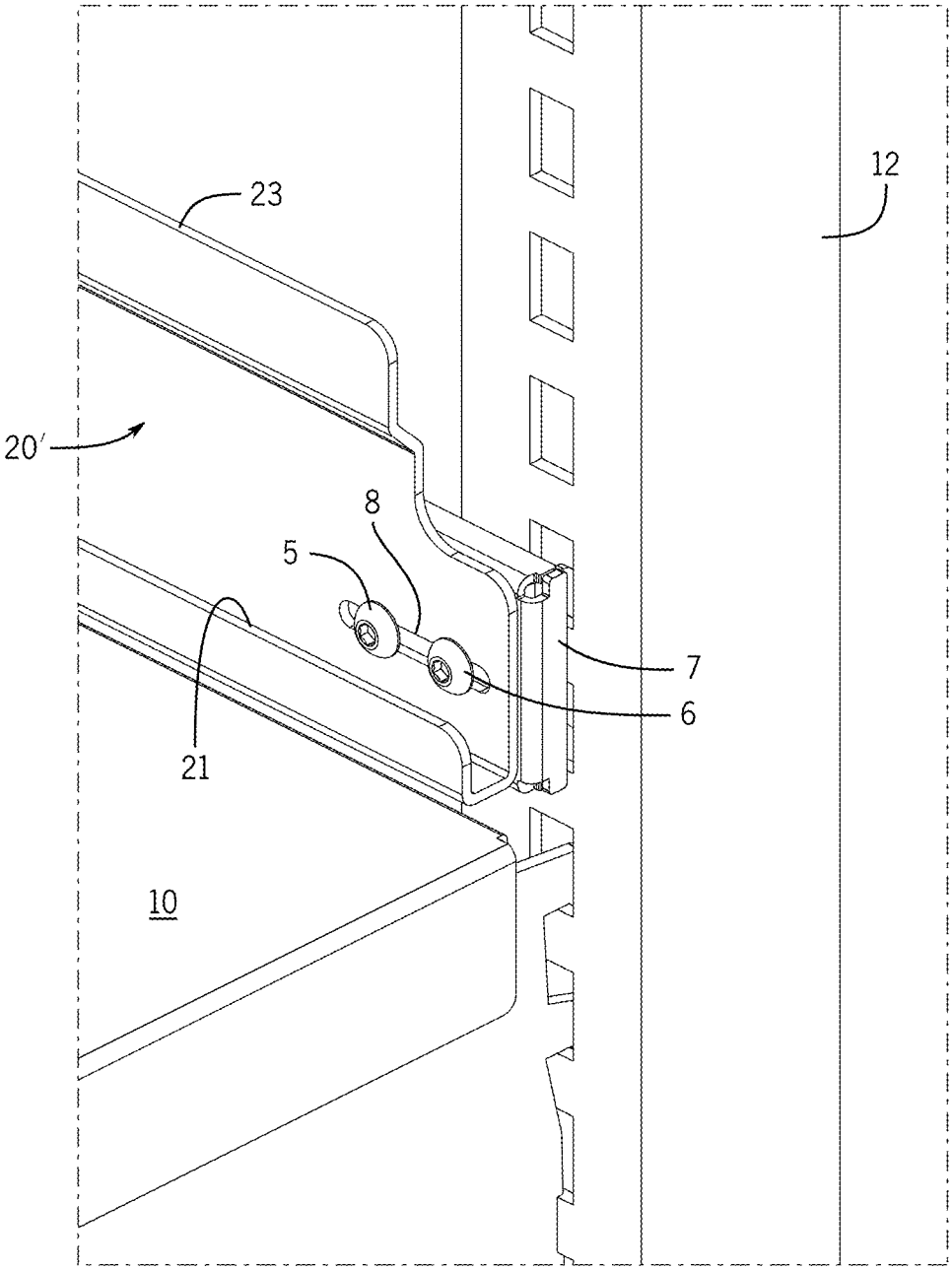
FIG. 46 shows the horizontal bar attached to the front and rear brackets of FIG. 45.

FIGS. 43-66 illustrate an embodiment of a pusher assembly 810 for a product merchandizer system 800 which is configured to be installed on a shelf 10. The shelf 10, vertical uprights 12, and brackets 14 are the same as those described with respect to FIGS. 1-3 and will not be described again. However, the horizontal bar 20' has a different configuration and is attached to the vertical uprights 12 in a different manner, as shown in FIGS. 44-46. FIG. 44 shows a rear bracket 1 attached to the vertical upright 12 by insertion of hooks 2 through apertures in the vertical upright 12. The rear bracket 1 has an aperture 3 and a hole 4, through which fasteners 5, 6 (FIG. 45) extend. The fasteners 5, 6 hold a front bracket 7 to the rear bracket 1, and also hold the horizontal bar 20' to the front bracket 7, rear bracket 1, and ultimately to the vertical upright 12, as shown in FIG. 46. A slot 8 in the horizontal bar 20' allows the horizontal bar 20' to be shifted left or right before the fasteners 5, 6 are fully tightened, after which the horizontal bar 20' is clamped to the front bracket 7. The slot 8 allows the horizontal bar 20' to be used with shelving systems having various widths between the vertical uprights 12. The horizontal bar 20' includes a lower lip 21 and an upper flange 23, the purpose of which will be described further herein below. In other embodiments, the product merchandizer system 800 may be configured to be coupled to a horizontal bar 20 like the DIN rail shown and described with respect to FIGS. 1-5.

Returning to FIG. 43, the product merchandizer system 800 is configured to be installed on the shelf 10. The product merchandizer system 800 comprises a pusher assembly 810 configured to push products with which the product merchandizer system 800 is stocked toward a front end 16 of the shelf 10. At least one partition 816 is configured to project upwardly from the shelf 10. The horizontal bar 20' is supported above the rear end 18 of the shelf 10 as discussed above. As noted hereinabove, the manner of installation of the pusher assembly 810 and the partitions 816 does not require additional components to be attached to or installed on the shelf 10. The pusher assembly 810 comprises a rear end 818 configured to be clipped to the horizontal bar 20' and a front end 820 configured to rest on the shelf 10. The at least one partition 816 comprises a rear end 819 configured to be clipped to the horizontal bar 20' and a front end 821 configured to rest on the shelf 10 at the front end 16 of the shelf 10.

Figure 47:
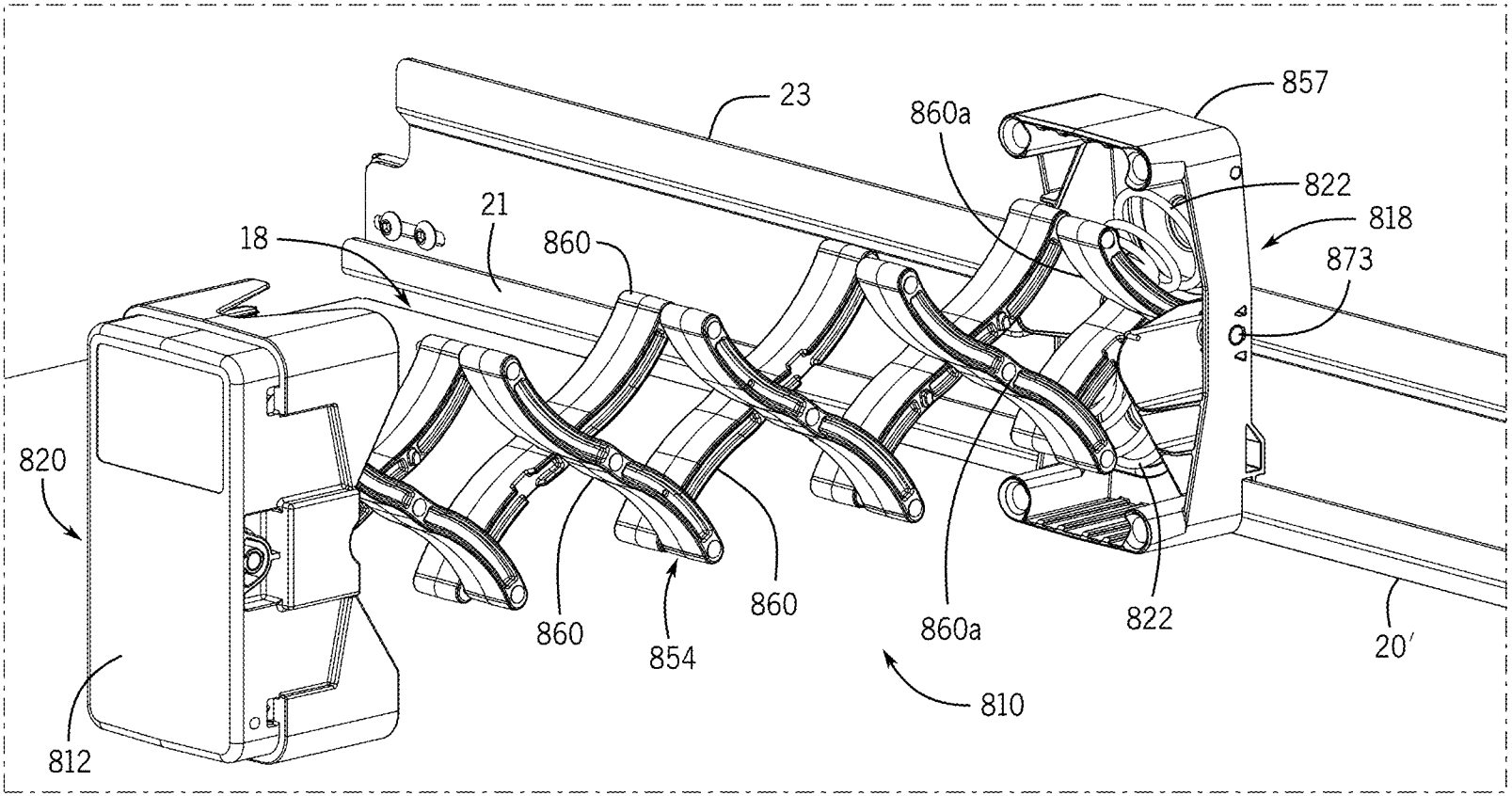
FIG. 47 shows a detailed front perspective view of a pusher assembly of the product merchandizer system of FIG. 43.
Figure 48:
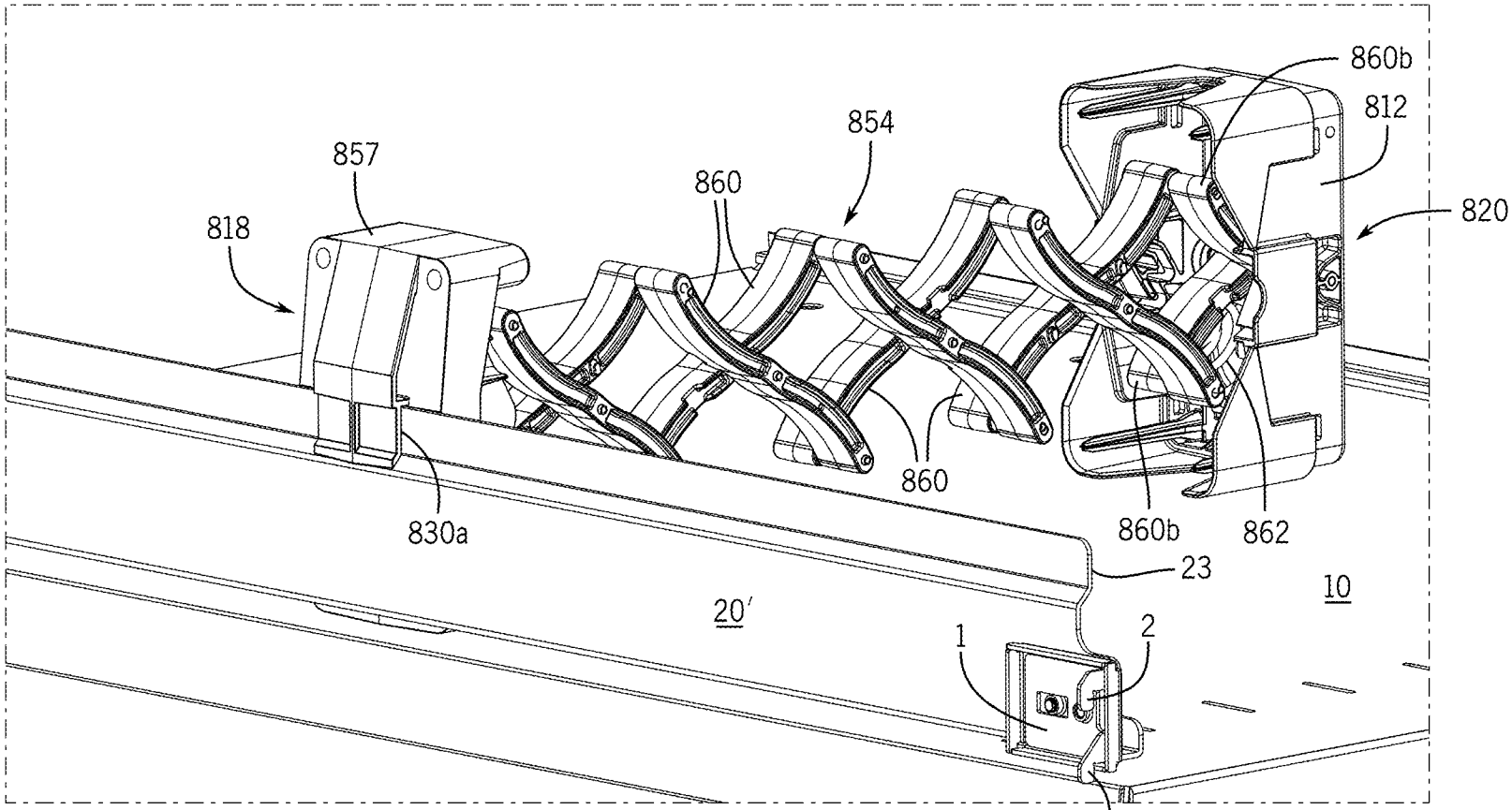
FIG. 48 shows a detailed rear perspective view of the pusher assembly of the product merchandizer system of FIG. 43.

As shown in FIGS. 47 and 48, the pusher assembly 810 comprises a paddle 812 at the front end 820 thereof, springs 822 that bias the paddle 812 toward the front end 16 of the shelf 10, and an extensible member 854 that couples the springs 822 to the paddle 812. The pusher assembly 810 further comprises a housing 857 at the rear end 818 thereof having a clip 830*a* that couples a rear end of the springs 822 and a rear end of the extensible member 854 to the horizontal bar 20'. More specifically, as shown in the cross section of FIG. 49, the clip 830*a* is provided on the rear face of the housing 857 and hooks over the flange 23 at the upper end of the horizontal bar 20'. The clip 830*a* has the shape of a downwardly-facing U formed on a ledge that is integral with the structure that forms the housing 857. The clip 830*a* has an inherent spring force and in this way is able to be attached to the horizontal bar 20'. A second clip 830*b* provided on the rear face of the housing 857 hooks over the lower lip 21 formed in the horizontal bar 20'. The first clip 830*a* is narrower than the housing 857 so that the partition 816 can be clipped immediately adjacent to the housing 857, in order to accommodate products having a narrow width.

Figure 50:
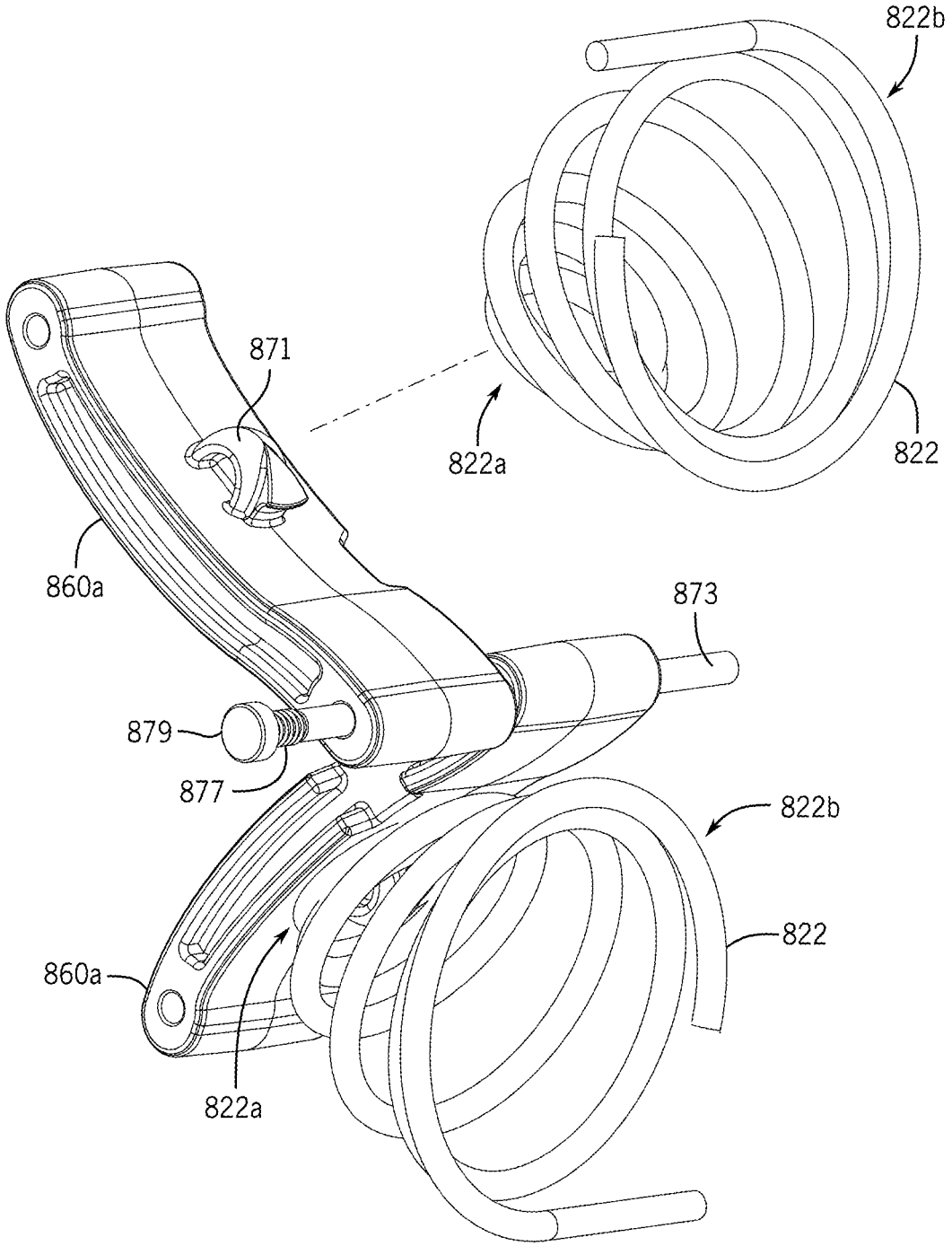
FIG. 50 shows a portion of the pusher of FIGS. 47 and 48 assembly in isolation.

Returning to FIGS. 47 and 48, the extensible member 854 comprises a series of links 860, pairs of which are crisscrossed in a pivotable fashion with one another (e.g., by way of pins) and attached to an adjacent pair of crisscrossed links 860 in a pivotable fashion (e.g., by way of pins). The number and length of links 860 will depend on the depth of the shelf 10 on which the product merchandizer system 800 is to be installed. As shown in FIGS. 47 and 50, the two rearmost links 860*a* are not crisscrossed with one another, but are instead pinned to the housing 857 at a common pivot point defined by pin 873. As shown in FIG. 50, the pin 873 is a rigid (e.g., stainless steel) straight pin with a cap 879 at one end and barbs 877 on its shaft. The barbs 877 digs into the plastic material of the housing 857 and prevent the pin 873 from falling out of the housing 857. In another example, a straight pin with no cap or barbs may be used. A similar pin arrangement is provided for coupling the extensible member 854 to the rear face of the paddle 812, as shown in FIG. 48. Here, two additional springs (only one of which is visible at 862) are provided and are connected between the rear face of the paddle 812 and the frontmost links 860*b*. The equal and opposite forces provided by the rear springs 822 and the front springs 862 cause the paddle 812 to move in a front-to-back direction on the shelf 10 without too much play. Further, having springs 822, 862 at both the front and rear ends of the pusher assembly 810 can provide the required spring rate for pushing products across the shelf 10.

Figure 52:
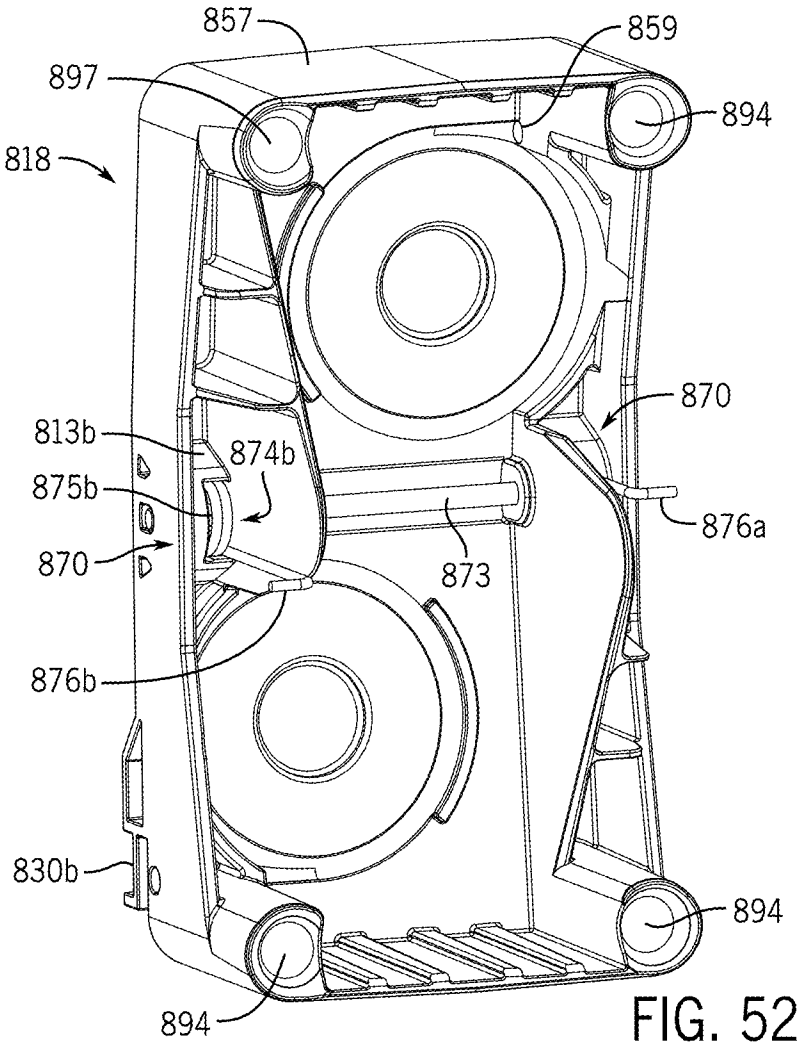
FIG. 52 is a second perspective view of the front side of the housing of FIG. 51.
Figure 51:
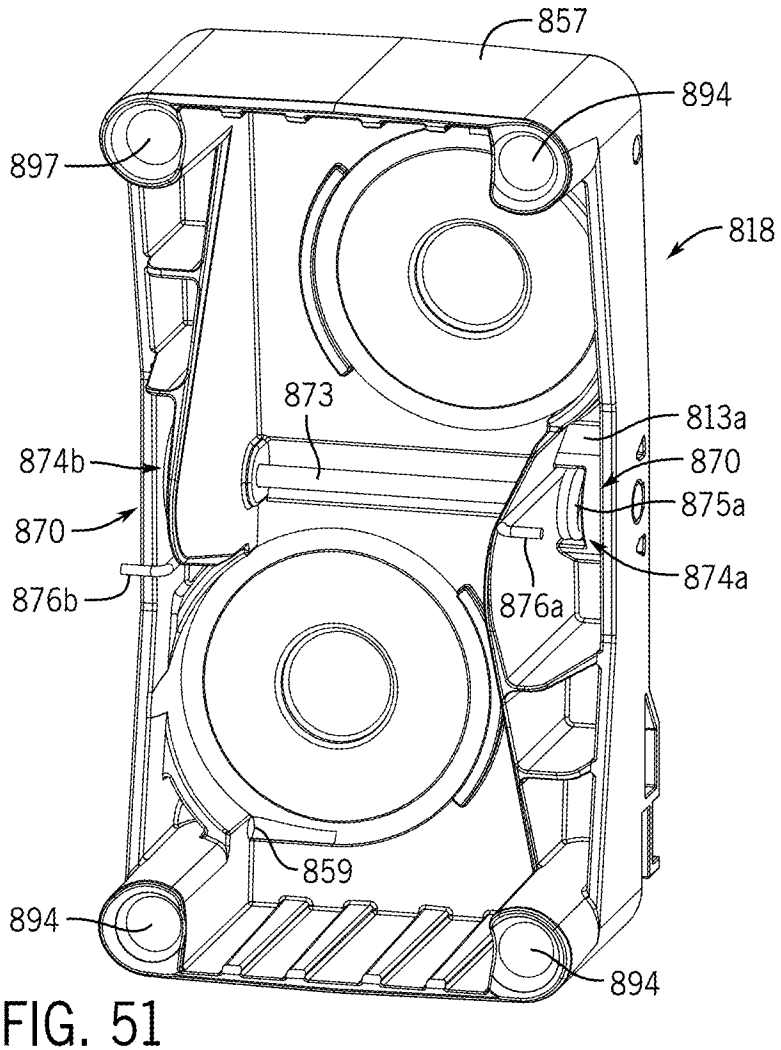
FIG. 51 is a first perspective view of a front side of a housing at the rear end of the pusher assembly of FIGS. 47 and 48.

As noted, FIG. 50 shows the two rearmost links 860*a* connected by the pin 873, which is supported within holes in the sides of the housing 857. Also shown is one of the springs 822, attached to the lower rearmost link 860*a*. The spring 822 has variable pitch and is shaped like a beehive. This allows the spring 822 to remain connected to the link 860*a* and follow a curved path as the link 860*a* pivots. The spring 822 has a first end 822*a* with a first diameter and a second end 822*b* with a second diameter, and the first diameter is less than the second diameter, thus allowing the consecutive coils to fit within one another as the spring 822 is collapsed. The upper spring 822 is removed from the upper rearmost link 860*a* so as to show the receiving tab 871 into which the first end 822*a* of the spring 822 can be inserted to connect the spring 822 to the rearmost links 860*a*. Meanwhile, the second ends 822*b* of the springs 822 are connected to the housing 857 at receiving apertures 859, which are shown in FIGS. 51 and 52. Although the springs 862 on the paddle 812 are not shown in detail, they have the same design as the springs 822, are connected to the frontmost links 860*b* by way of similar receiving tabs 871, and are connected to the paddle 812 by way of similar receiving apertures. In other examples, coil springs like those shown at 322, 362 in FIGS. 20 and 21, which also have first and second ends of different diameters, could be used instead of beehive-shaped springs 822, 862.

Product loaded in the product merchandizer system 800 is pushed toward the front end 16 of the shelf 10 as the bias of the springs 822 and 862 tends to extend the series of links 860, thereby pushing the paddle 812 toward the front end 16 every time a product is removed from the product merchandizer system 800. As the product merchandizer system 800 is restocked with product, the force of the added product pushes the paddle 812 against the force of the springs 822, the links 860 collapse on one another, and the paddle 812 moves toward the rear end 18 of the shelf 10. Thus, the paddle 812 is positionable along the depth of the shelf 10, anywhere between the locations shown in FIGS. 59 and 61.

FIGS. 51 and 52 show portions of a paddle locking mechanism 870 configured to secure the paddle 812 in a collapsed position proximate the rear end 818 of the pusher assembly 810. As will be discussed, the paddle 812 is slidable on the shelf 10 into and between an extended position (FIG. 59) proximate the front end 16 of the shelf 10 and a collapsed position (FIG. 61) proximate the rear end 818 of the pusher assembly 810. The locking mechanism 870 has a first portion 872*a* positioned on the paddle 812 (FIG. 53) and a second portion 874*a* positioned on the rear end 818 (FIG. 51) of the pusher assembly 810. As discussed in further detail below, the first portion 872*a* is configured to be engaged with the second portion 874*a* to retain the paddle 812 in the collapsed position. In the embodiments of FIGS. 51-54, the first portion 872*a* of the locking mechanism 870 is configured as a cam device 872*a* and the second portion 874*a* is configured as a spring 874*a* that is configured to slide into engagement with the cam device 872*a* in order to retain the paddle 812 in the collapsed position. Some embodiments of a locking mechanism, however, may include a first portion on the paddle 812 configured as a spring and a second portion on the rear end 818 of the pusher assembly 810 configured as a cam device.

Referring to FIGS. 51 and 52, the illustrated spring 874*a* is a torsion spring having a first end coupled to the rear end 818 of the pusher assembly 810 and an opposite second end 876*a*. In the illustrated embodiment, the first end (the coiled end 875*a*) of the spring 874*a* is secured to the housing 857 within a mounting member 813*a* and by extension of the pin 873 through the coiled end 875*a* of the spring 874*a*. The second end 876*a* of the spring 874*a* is bent at a right angle with respect to the remainder of the uncoiled section of the spring 874*a*. In another embodiment, a spring 574 with a resiliently deformable flat section 575 and a generally tubular latch member 576 on second end thereof can be used, as described herein above with respect to FIGS. 32-34.

Figure 54:
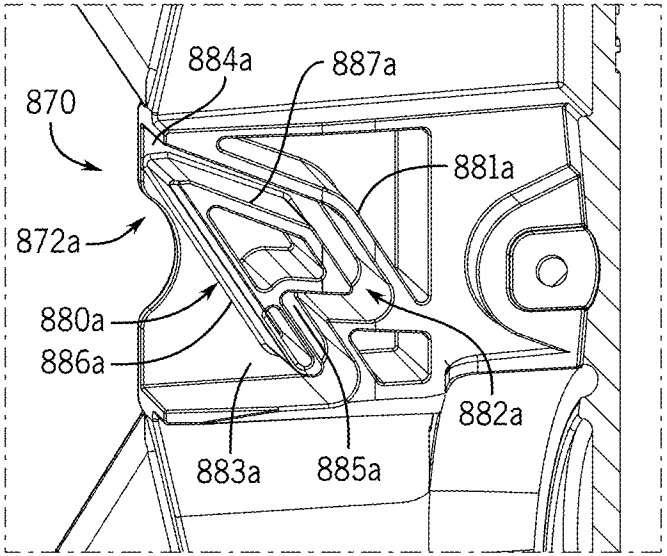
FIG. 54 is a detailed view of a portion of FIG. 53.
Figure 53:
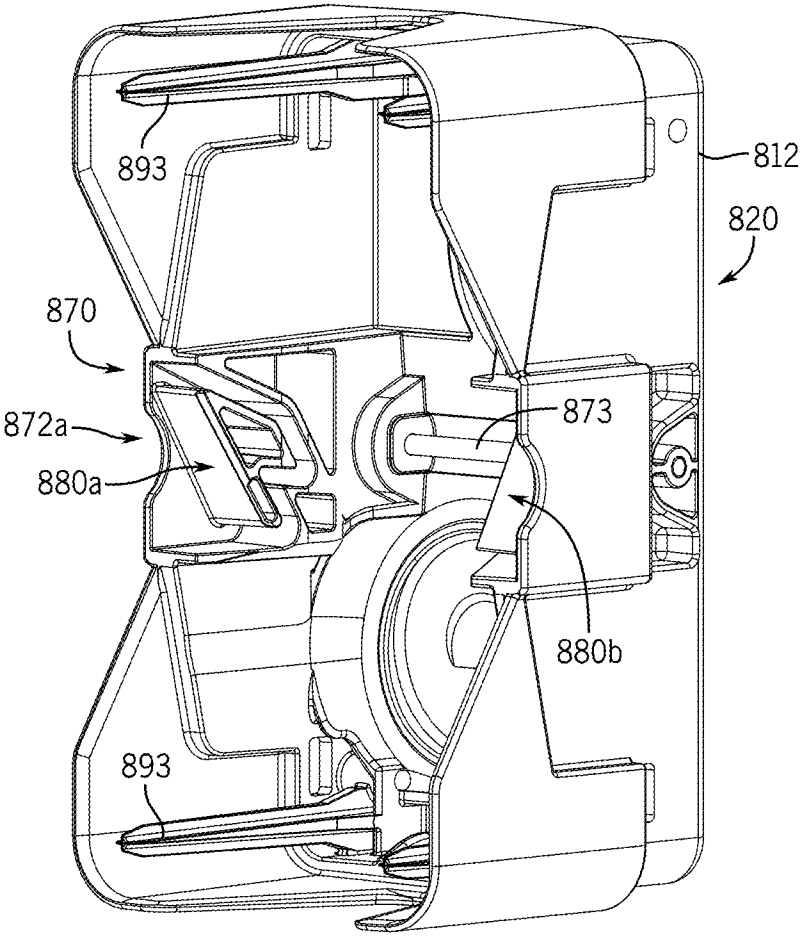
FIG. 53 is a first perspective view of a rear side of paddle of the pusher assembly of FIGS. 47 and 48.
Figure 56:
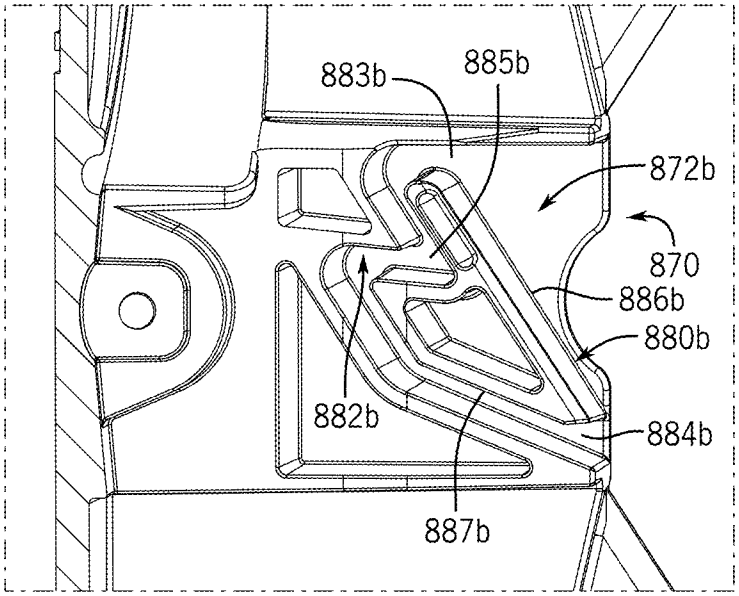
FIG. 56 is a detailed view of a portion of FIG. 55.
Figure 55:
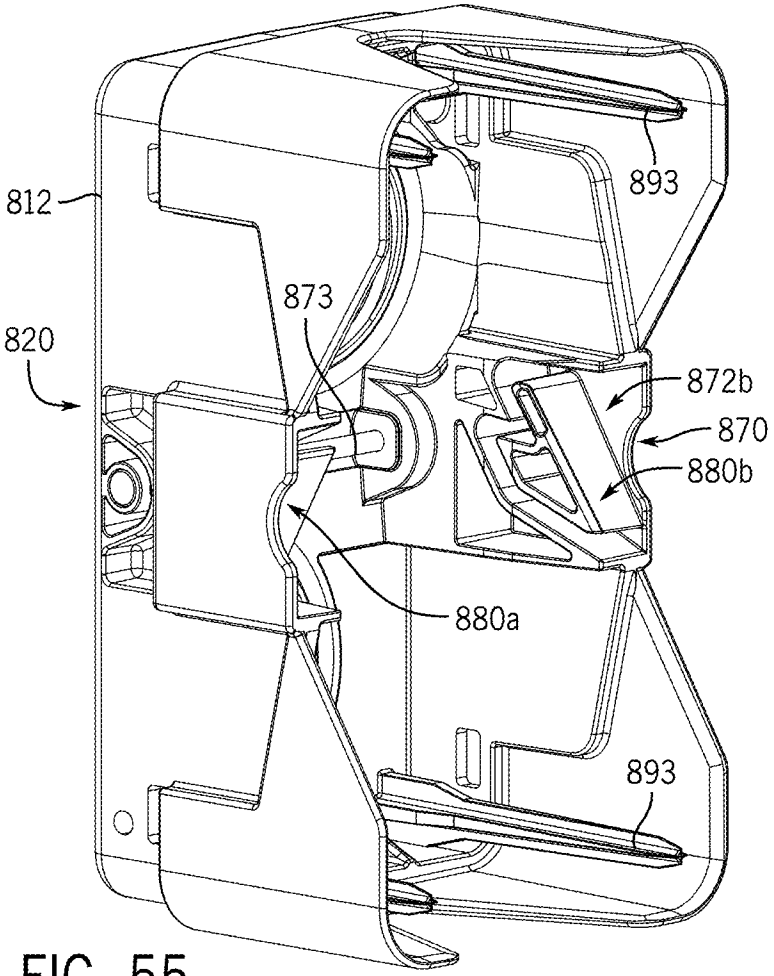
FIG. 55 is another perspective view of the rear side of the paddle of the pusher assembly of FIG. 53.

Referring to FIGS. 53 and 54, the cam device 872*a* on the paddle 812 includes a baffle member 880*a* and a wall member 881*a* that together form a serpentine path 882*a* between the baffle member 880*a* and the wall member 881*a*. The serpentine path 882*a* extends from a first opening 883*a* into the cam device 872*a* positioned at a lower end of the cam device 872*a* to a second opening 884*a* positioned at an upper end of the cam device 872*a*. A latch recess 885*a* is formed in the serpentine path 882*a* between the first and second openings 883*a*, 884*a*. The illustrated locking mechanism 870 is configured as a push-push locking mechanism 870 that is movable into and between a locked position and a disengaged position by pushing the paddle 812 towards the rear end 818 of the pusher assembly 810. As the paddle 812 slides towards the rear end 818 of the pusher assembly 810, the second end 876*a* of the spring 874*a* is configured to slide into engagement with the cam device 872*a* to move the locking mechanism 870 into a locked position in which the paddle 812 is retained in the collapsed position. In particular, as the paddle 812 slides towards the rear end 818 of the pusher assembly 810, the second end 876*a* of the spring 874*a* moves into abutment with a ramped surface 886*a* of the baffle member 880*a*, which is configured to bias the second end 876*a* of the spring 874*a* downward and into the first opening 883*a*. Once the second end 876*a* of the spring 874*a* is received in the serpentine path 882*a* via the first opening 883*a*, the springiness of the coiled end 875*a* of the spring 874*a* biases the second end 876*a* upwards through the serpentine path 882*a* and into the latch recess 885*a*, thereby placing the locking mechanism 870 in the locked position.

To unlock the locking mechanism 870, the paddle 812 is again pushed towards the rear end 818 of the pusher assembly 810. As the paddle 812 moves towards the rear end 818 while the locking mechanism 870 in the locked position, the sides of the serpentine path 882*a* and/or the springiness of the coiled end 875*a* of the spring 874*a* bias the second end 876*a* upwards in the serpentine path 882*a*. When pressure on the paddle 812 is released, the paddle 812 is biased away from the rear end 818 (for example by springs 822 of FIG. 47), thereby pulling the second end 876*a* of the spring 874*a* forward. An upper ramp surface 887*a* of the baffle member 880*a* biases the second end 876*a* of the spring 874*a* upward towards the second opening 884*a*. Continued movement of the paddle 812 toward the front end 16 of the shelf 10 causes the second end 876*a* to exit the cam device 872*a* via the second opening 884*a*, thereby placing the locking mechanism 870 in the unlocked position.

Referring to FIGS. 51, 52, 55, and 56, a similar locking mechanism can be provided on the opposite side of the pusher assembly 810. Specifically, at the rear end 818 of the pusher assembly 810, a spring 874*b* in the form of a torsion spring having a first coiled end 875*b* and a second end 876*b* is provided and secured to the housing 857 within a mounting member 813*b* and by extension of the pin 873 through the coiled end 875*b* of the spring 874*b*. A cam device 872*b* is provided at the front end 820 of the pusher assembly 810, on the paddle 812, with a configuration that is flipped upside-down vis a vis the cam device 872*a*. As the paddle 812 slides towards the rear end 818 of the pusher assembly 810, the second end 876*b* of the spring 874*b* is configured to slide into engagement with the cam device 872*b* to move the locking mechanism 870 into a locked position in which the paddle 812 is retained in the collapsed position. In particular, as the paddle 812 slides towards the rear end 818 of the pusher assembly 810, the second end 876*b* of the spring 874*b* moves into abutment with a ramped surface 886*b* of the baffle member 880*b*, which is configured to bias the second end 876*b* of the spring 874*b* upward and into the first opening 883*b*. Once the second end 876*b* of the spring 874*b* is received in the serpentine path 882*b* via the first opening 883*b*, the springiness of the coiled end 875*b* of the spring 874*b* biases the second end 876*b* downwards through the serpentine path 882*b* and into the latch recess 885*b*, thereby placing the locking mechanism 870 in the locked position. To unlock the locking mechanism 870, the paddle 812 is again pushed towards the rear end 818 of the pusher assembly 810. As the paddle 812 moves towards the rear end 818 while the locking mechanism 870 in the locked position, the sides of the serpentine path 882*b* and/or the springiness of the coiled end 875*b* of the spring 874*b* bias the second end 876*b* downwards in the serpentine path 882*b*. When force on the paddle 812 is thereafter released, the paddle 812 is biased away from the rear end 818 (for example by spring 822 of FIG. 47), thereby pulling the second end 876*b* of the spring 874*b* forward. A lower ramp surface 887*b* of the baffle member 880*b* biases the second end 876*b* of the spring 874*b* downward towards the second opening 884*b*. Continued movement of the paddle 812 toward the front end 16 of the shelf 10 causes the second end 876*b* to exit the cam device 872*b* via the second opening 884*b*, thereby placing the locking mechanism 870 in the unlocked position.

The locking mechanism 870 is configured such that the latching and unlatching of the spring 874*a* with the cam device 872*a* and of the spring 874*b* with the cam device 872*b* occurs simultaneously. The cam devices 872*a*, 872*b* are upside-down versions of one another, and the springs 874*a*, 874*b* are oppositely biased. Note that while two locking mechanisms 870 are shown here, in other examples, only one locking mechanism is provided. The single locking mechanism may be provided on the left or right side of the pusher assembly 810 as shown herein or may be provided at the top or bottom end of the pusher assembly 810.

Furthermore, as shown in FIGS. 51-56, the pusher assembly 810 may be provided with features that guide the paddle 812 into alignment with the housing 857 as the paddle 812 is moved into the fully collapsed position. Specifically, the rear side of the paddle 812 has protrusions 893 provided at each of its four corners, which protrusions 893 are configured to fit into corresponding blind receiving holes 894 provided at each of the four corners on the front side of the housing 857. The protrusions 893 are tapered so that they self-center as they are received into the blind receiving holes 894. This alignment of the paddle 812 to the housing 857 helps the push-push locking mechanism 870 to be correctly aligned for locking of the springs 874*a*, 874*b* into the cam devices 872*a*, 872*b*.

Figure 57:
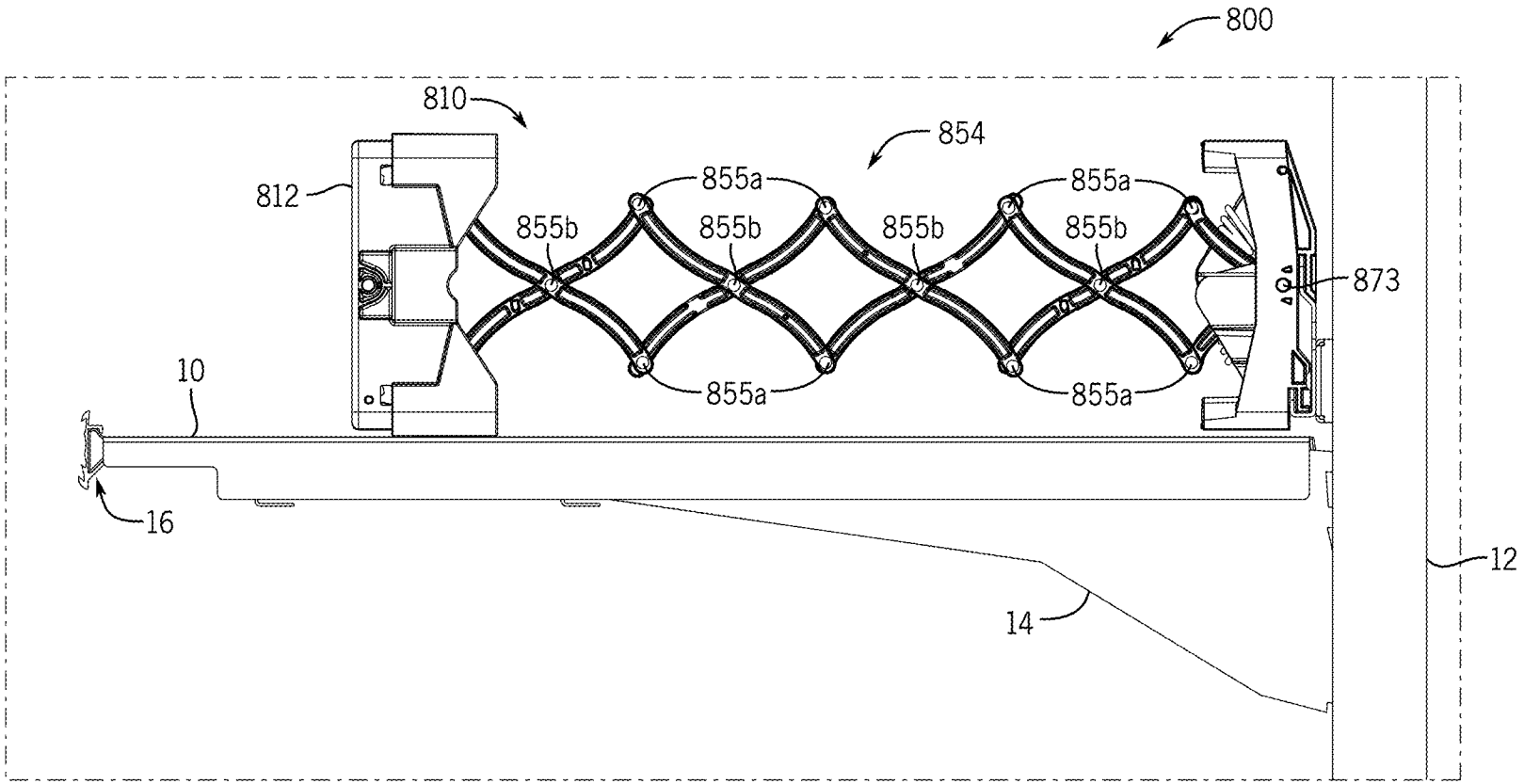
FIG. 57 is a side elevation view of the product merchandizer system of FIG. 43, comprising the pusher assembly of FIGS. 47 and 48, on a shelf.
Figure 58:
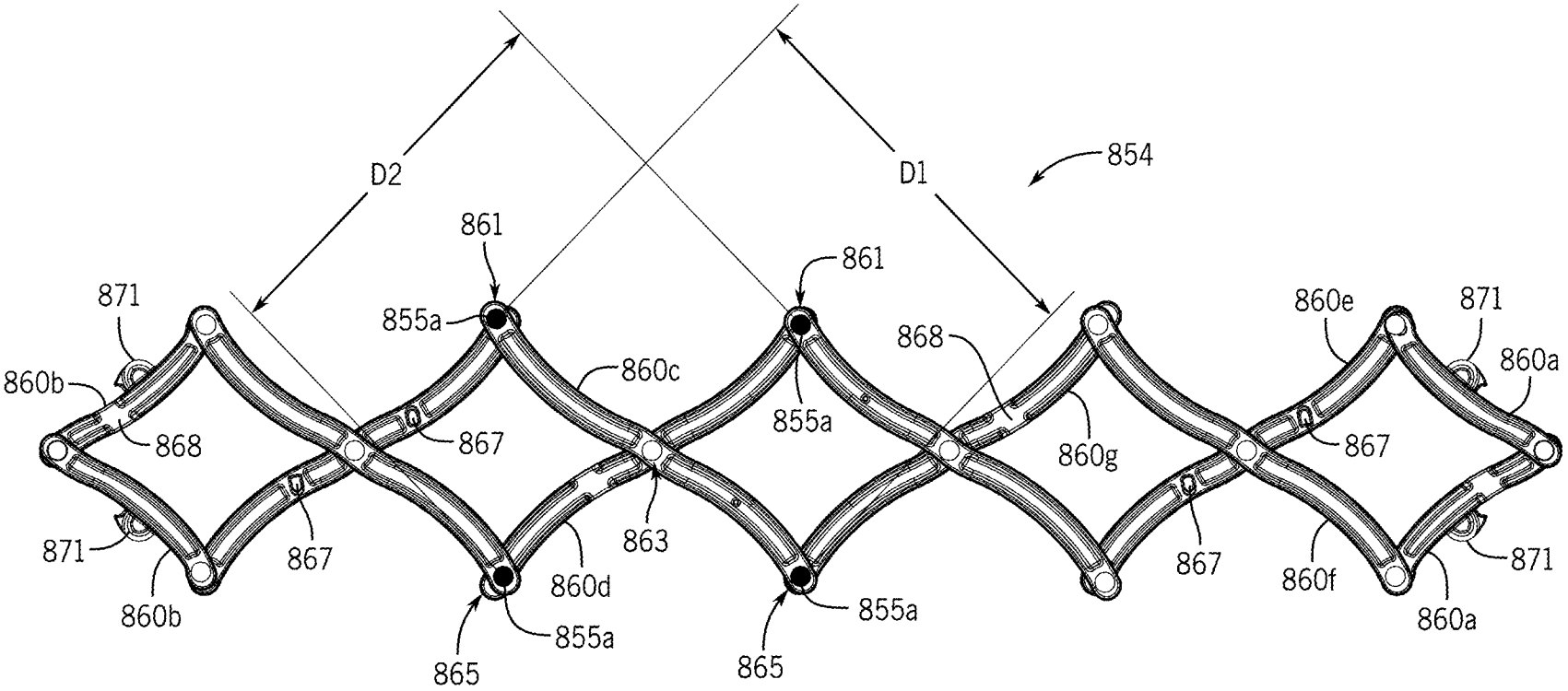
FIG. 58 shows an extensible member of the pusher assembly of FIGS. 47 and 48 in isolation.

FIG. 57 shows a side view of the product merchandizer system 800 when the pusher assembly 810 is biased about 75% of the way toward the front end 16 of the shelf 10. Pairs of links in the series of links 860 of the extensible member 854 are coupled together by pivot pins extending along respective pivot axes, which include end pivot axes 855*a* between the ends of each of the pairs of links and central pivot axes 855*b* near the center of each connected pair of links. In the present embodiment, the pivot pins are stainless steel rivets, but other types of connectors could be used. It can be seen that the pivot axes 855*a*, 855*b* are oriented horizontally when the pusher assembly 810 is installed on the shelf 10. Turning now also to FIG. 58, which shows the extensible member 854 in isolation, it is noted that at least one link 860*c* in the series of links 860 is curved from a first end 861 thereof to a second end 865 thereof. In the present embodiment, all links 860 are curved. Moreover, the at least one link 860*c* has reverse curvature, that is, the link 860*c* is curved in a first direction from the first end 861 to the center 863, which serves as an inflection point, and curved in an opposite direction from the center 863 to the second end 865. As shown, each of the links 860 except the rearmost links 860*a* and the frontmost links 860*b* has reverse curvature.

As illustrated in FIG. 58, a first distance D1 between pivot axes 855*a* at opposing ends 861, 865 of a first link 860*c* in a given pair of links is not the same as a second distance D2 between pivot axes 855*a* at opposing ends 861, 865 of a second link 860*d* in the given pair of links. The difference between D1 and D2 may be on the order of 1-5 millimeters. In a specific example, the difference between D1 and D2 may be between 2-3 millimeters. In a more specific example, the difference between D1 and D2 may be 2.6 millimeters. The percentage of the difference between D1 and D2 versus the distances D1 and D2 themselves may be about 2-3%. Each of the links 860 (including 860*c* and 860*d*) except the rearmost links 860*a* and the frontmost links 860*b* may have the same general dimensions, and the difference between D1 and D2 may be provided for by placing the hole for insertion of the pivot pin closer to or further from the ends 861, 865 of the links 860. In other embodiments, the links 860 may have different overall dimensions and the holes for the pivot pins may be uniformly spaced from the ends 861, 865 of the links 860. During development, the present inventors realized that deformation in the links 860 and accumulation of clearance in the holes provided for the pivot pins caused the angle between the links 860 to change in a non-linear fashion from one pair of links 860 to the next, resulting in the paddle 812 moving toward the collapsed position without compressing the springs 822. Therefore, the present inventors made the distances between the pivot axes 855*a* different from one pair of links 860 to the next, which caused the extensible member 854 to have an inherent spring force that counteracted the tendency of the paddle 812 to move into the collapsed position. Note that although only two links 860*c*, 860*d* are described as having different distances D1, D2, respectively, between their pivot axes 855*a*, this pattern may be repeated for each of the pairs of links 860.

Figure 59:
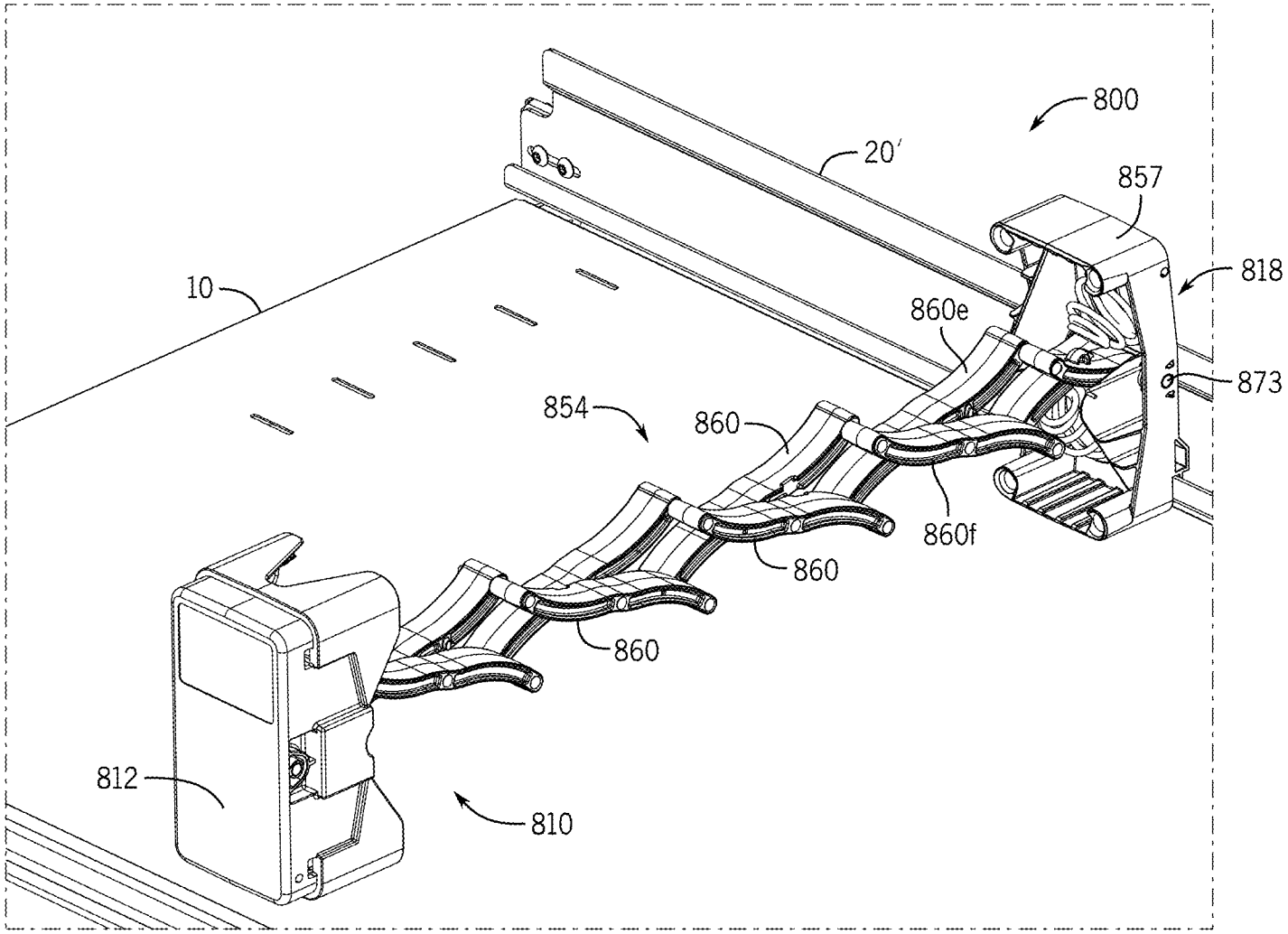
FIG. 59 shows the pusher assembly of FIGS. 47 and 48 in a fully extended position.
Figure 60:
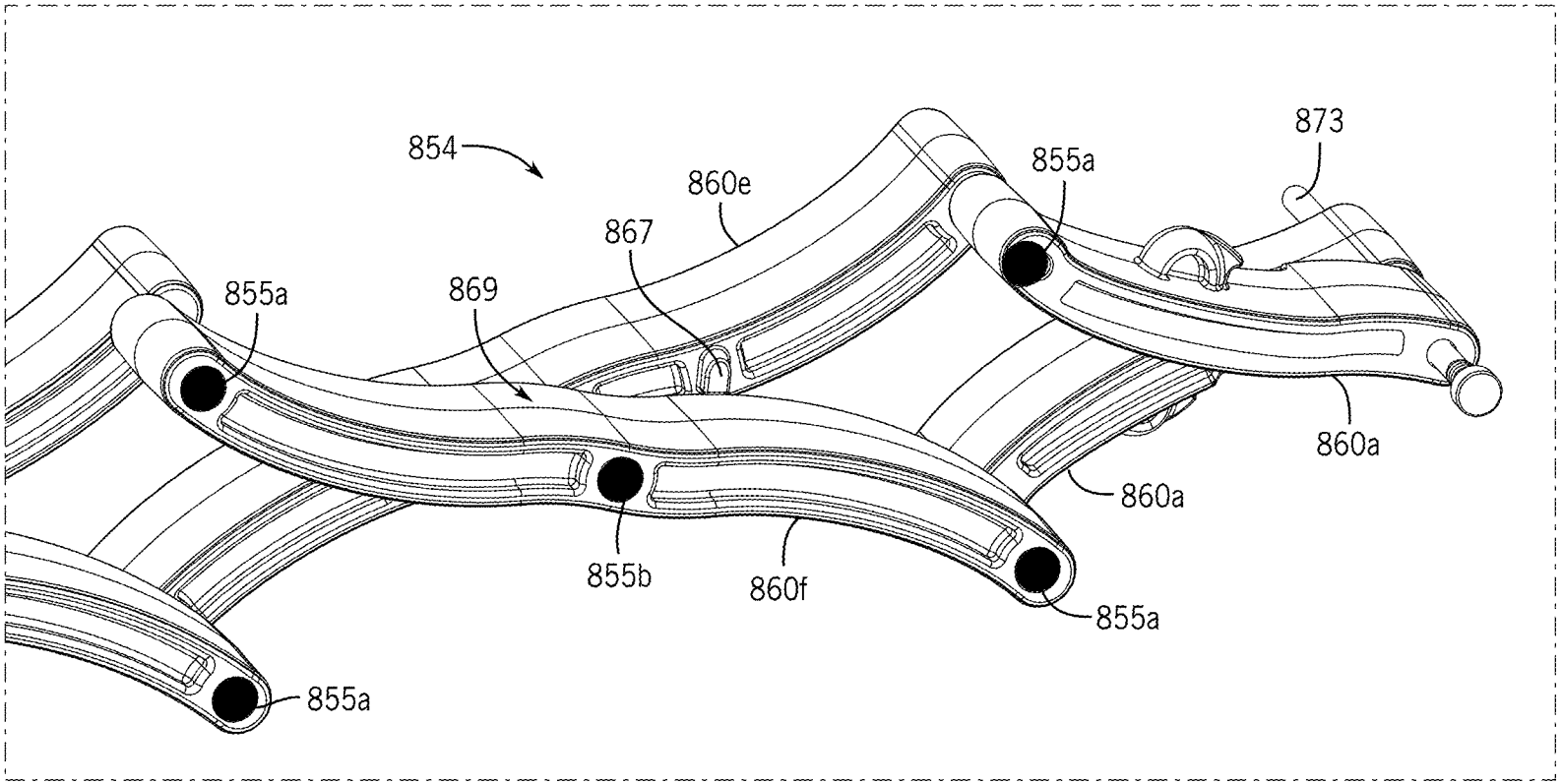
FIG. 60 is a detailed view of a portion of FIG. 59 shown in isolation.

FIG. 59 shows the product merchandizer system 800 when the pusher assembly 810 is biased as far as it is permitted to extend toward the front end 16 of the shelf 10. Note that the extensible member 854 in this case is fully extended, and the link 860 are pivoted to their minimal vertical height. FIG. 60 is a close-up view of a portion of FIG. 59, showing the mechanisms that prevent the links 860 from moving past the position shown in FIG. 59. Specifically, at least one of the links 860*e* in the series of links 860 comprises a protrusion 867 that is configured to interact with an adjacent link 860*f* in the series of links 860 so as to limit a degree to which the adjacent link 860*f* can pivot with respect to the at least one of the links 860*e* comprising the protrusion 867. Although FIG. 60 only shows the protrusion 867 interacting with the upper surface 869 of the link 860*f*, FIG. 58 shows how the link 860*e* has another protrusion 867 that would interact with the bottom surface of the link 860*f* when the extensible member 854 is fully extended. On the other hand, when the pusher assembly 810 is fully collapsed, the protrusion 867 fits within a slot 868 formed in the adjacent link 860*g*. FIG. 58 shows how multiple protrusions 867 and corresponding slots 868 can be provided on the series of links 860. Note that some of the protrusions and slots may be provided on the opposite sides of the links 860 than those shown here.

Figure 61:
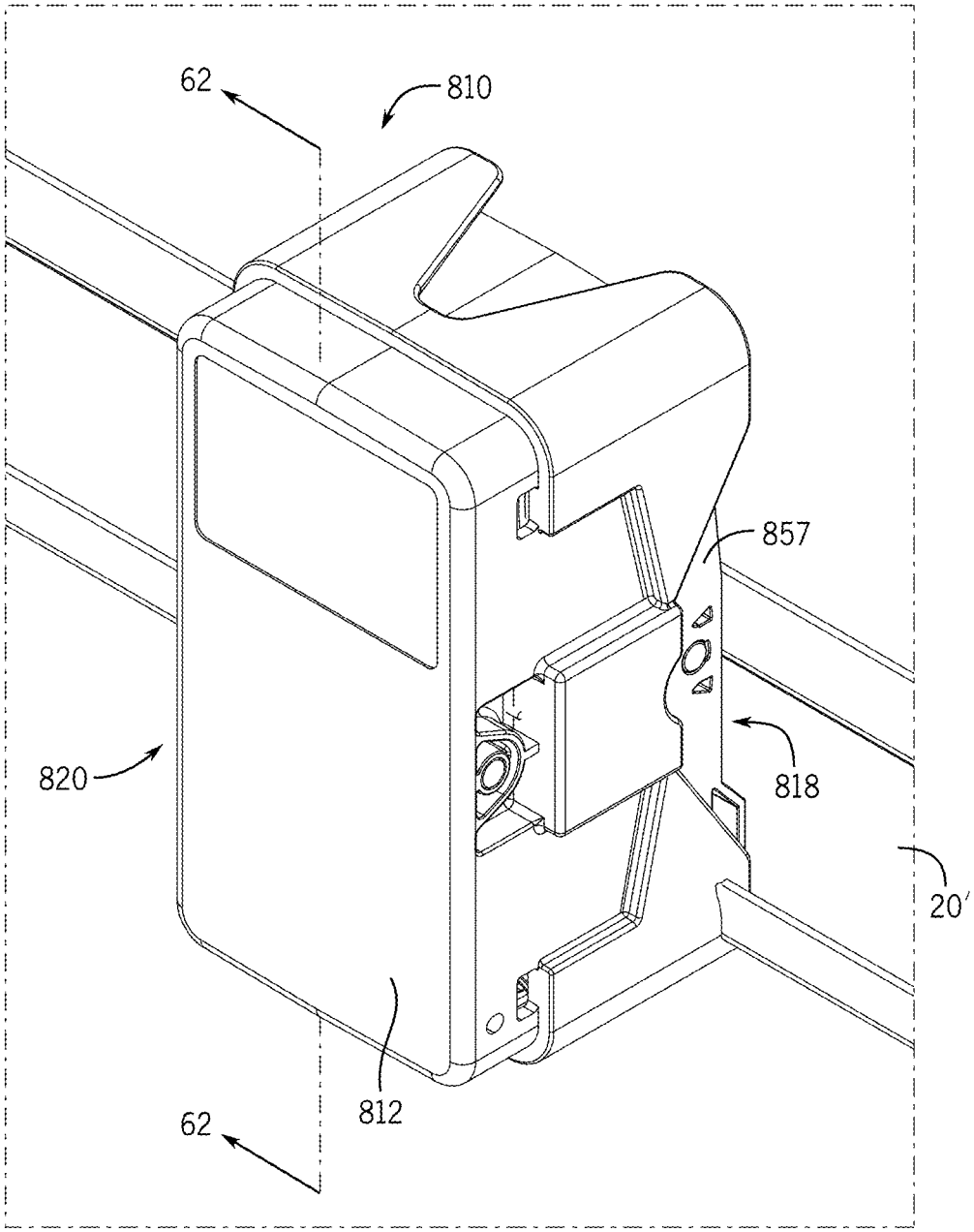
FIG. 61 shows the pusher assembly of FIGS. 47 and 48 in a fully collapsed position.
Figure 62:
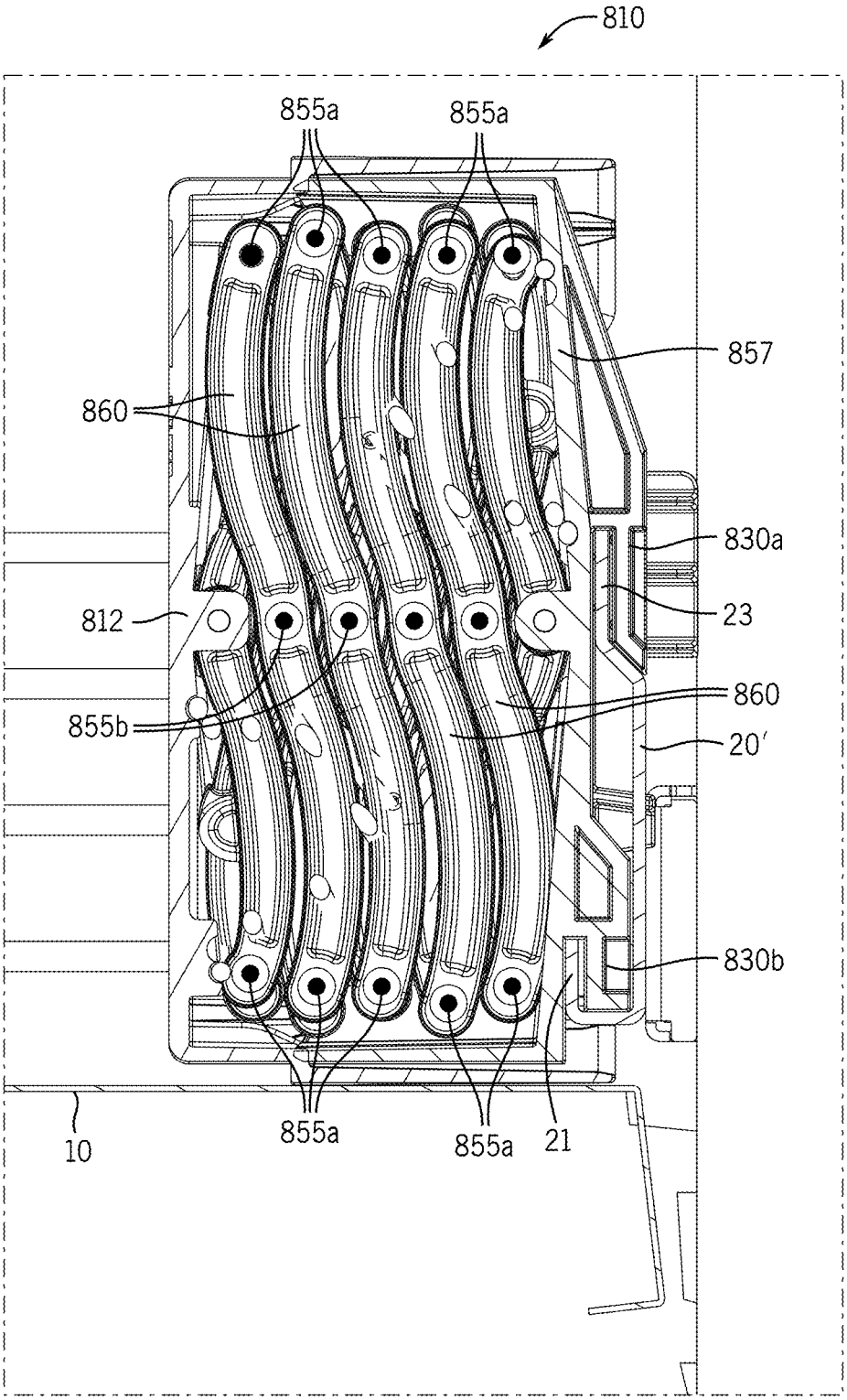
FIG. 62 is a cross-section taken along the line 62-62 in FIG. 61.

FIG. 61 shows the product merchandizer system 800 when the pusher assembly 810 is in the fully collapsed, locked position. As shown, the paddle 812 is locked to the housing 857 adjacent the horizontal bar 20'. FIG. 62 shows a cross-sectional view through the pusher assembly 810 in this position. It can be seen that the extensible member 854 is entirely collapsed, with each of the links 860 lying directly adjacent to one another and enclosed between the paddle 812 and the housing 857. The springs 822, 862 are not visible in this view, but are also collapsed, although not fully. Rather, the curvature of the links 860 allows the springs 822, 862 to be less than fully compressed at their innermost links. That is, the smaller diameter inner ends of the springs 822 fit between the adjacent curved surface of the rearmost link 860*a* and the inner surface of the housing 857, and the smaller diameter inner ends of the springs 862 fit between the adjacent curved surface of the frontmost links 860*b* and the inner surface of the paddle 812, while the surrounding larger diameter links of the springs 822, 862 are collapsed within one another. Allowing the springs 822, 862 to be less than fully compressed when the pusher assembly 810 is in the fully collapsed position of FIGS. 61 and 62 improves the fatigue life of the springs 822, 862.

Figure 63:
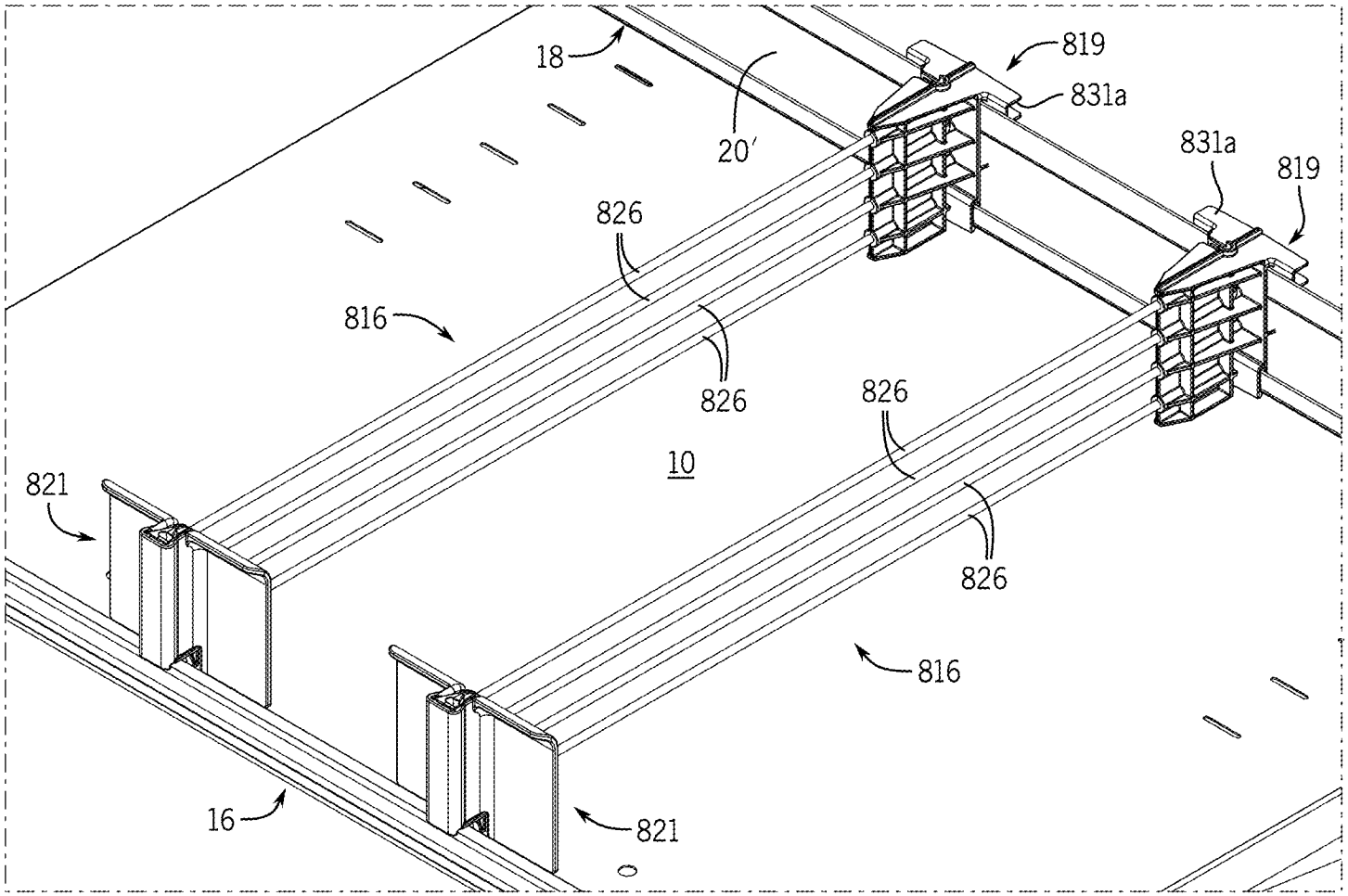
FIG. 63 shows two partitions of the product merchandizer system of FIG. 43 installed on the shelf.
Figure 64:
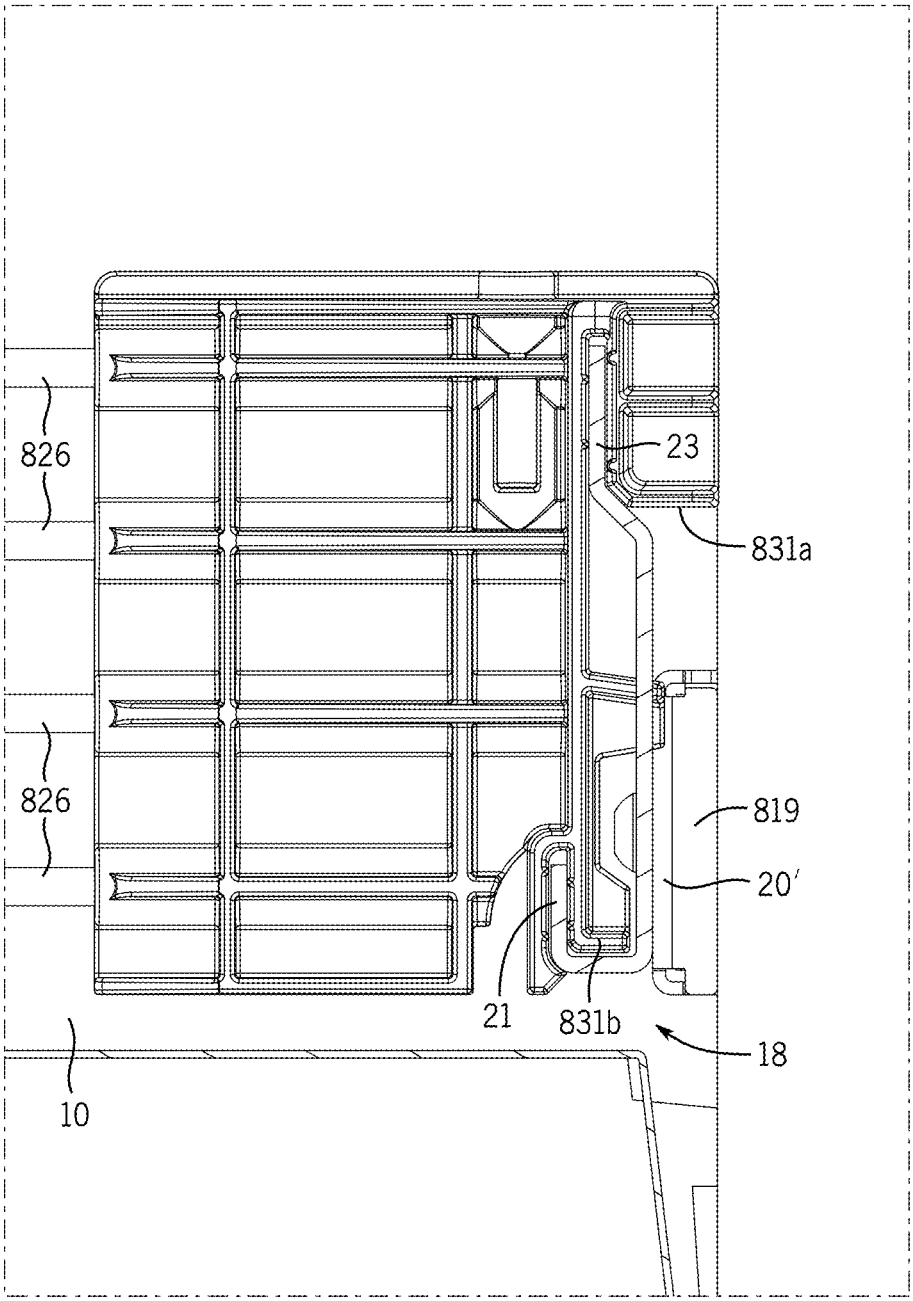
FIG. 64 is a perspective cross-sectional view near a rear end of one of the partitions shown in FIG. 63.
Figure 66:
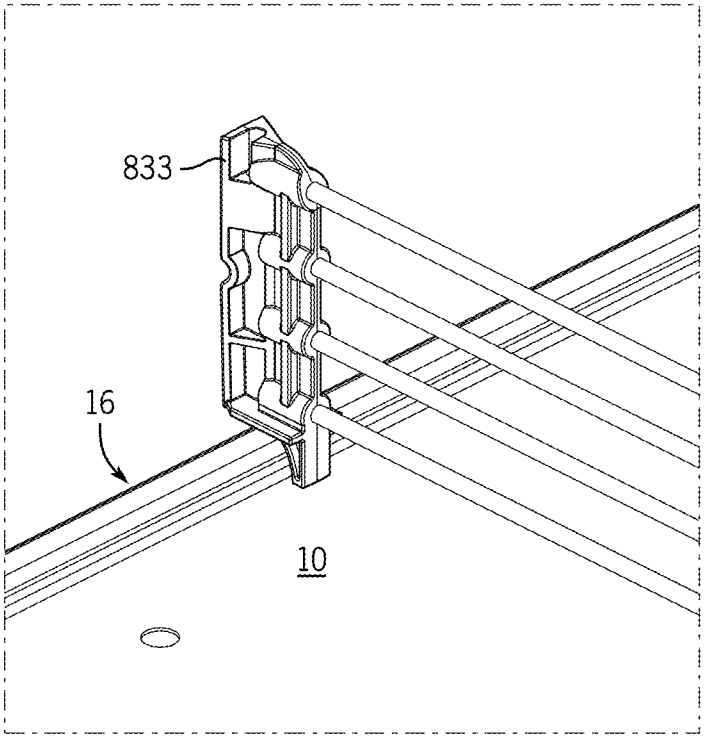
FIG. 66 shows the front end of one of the partitions without the lens installed.
Figure 65:
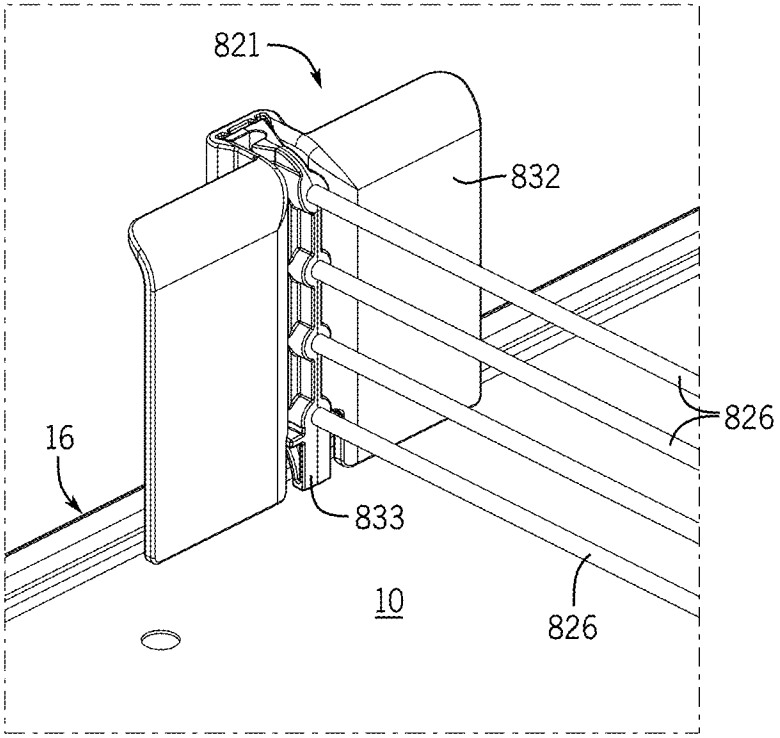
FIG. 65 shows a front end of one of the partitions with a lens installed.

FIG. 63 shows the partitions 816 on the shelf 10 with the pusher assembly 810 removed. Each partition 816 has a rear end 819 located at the rear end 18 of the shelf 10 and a front end 821 located at the front end 16 of the shelf 10. A plurality of horizontally extending, vertically stacked wires 826 connect the rear end 819 to the front end 821. Although four wires 826 are shown stacked here, in other examples, fewer or more wires could be provided. FIG. 64 shows how the rear end 819 is clipped to the horizontal bar 20' by way of an upper integral clip 831*a* that fits over the upper flange 23 of the horizontal bar 20' and a lower clip 831*b* that fits over the lower lip 21 of the horizontal bar 20'. FIG. 65 shows how the front end 821 of the partition 816 rests on the shelf 10. A lens 832 is provided over a support piece 833, both of which have lower ends that rest on the shelf 10. The support piece 833 holds the front ends of the wires 826 and maintains the lens 832 in place. Having a lens 832 that is separable from the support piece 833 allows the lens 832 to be customized, while the support piece 833 can remain the same across all applications. Further, the lens 832 can be made of a different type of material, such as a transparent material. The wires 826 are made of a rigid material, such as stainless steel, and may optionally be overmolded with plastic. The rigidity of the wires 826 prevents the front end 821 of the partition 816 from yawing with respect to the rear end 819 of the partition 816, seeing as the front end 821 of the partition 816 is not clipped to the shelf 10 but simply rests thereupon. Some embodiments of the partition 816 have only the lower clip 831*b*, which allows the partition 816 to fit in a space having low vertical clearance at the rear end 18 of the shelf 10.

FIG. 43-66 therefore show a product merchandizer system 800 configured to be installed on a shelf 10. The product merchandizer system 800 comprises a pusher assembly 810 configured to push products with which the product merchandizer system 800 is stocked toward a front end 16 of the shelf 10. The pusher assembly 810 comprises a paddle 812 at a front end of the pusher assembly 810, and the paddle 812 is configured to rest on the shelf 10 (see FIG. 57) A housing 857 is provided at a rear end 818 of the pusher assembly 810. A spring 822 is supported by the housing 857 and configured to bias the paddle 812 toward the front end 16 of the shelf 10. A series of links 860 couple the spring 822 to the paddle 812.

As shown in FIG. 57, pairs of links in the series of links 860 are coupled together along respective pivot axes 855*a*, 855*b*. The pivot axes 855*a*, 855*b* are oriented horizontally when the pusher assembly 810 is installed on the shelf 10.

As shown in FIG. 58, a first distance D1 between pivot axes 855*a* at opposing ends 861, 865 of a first link 860*c* in a given pair of links is not the same as a second distance D2 between pivot axes 855*a* at opposing ends 861, 865 of a second link 860*d* in the given pair of links.

As shown, at least one link 860 in the series of links is curved from a first end thereof 861 to a second end 865 thereof. In some embodiments, the at least one link 860 has reverse curvature.

As shown in FIGS. 58 and 60, at least one of the links 860*e* in the series of links comprises a protrusion 867 that is configured to interact with an adjacent link 860*f* in the series of links so as to limit a degree to which the adjacent link 860*f* can pivot with respect to the at least one of the links 860*e* comprising the protrusion.

Figure 49:
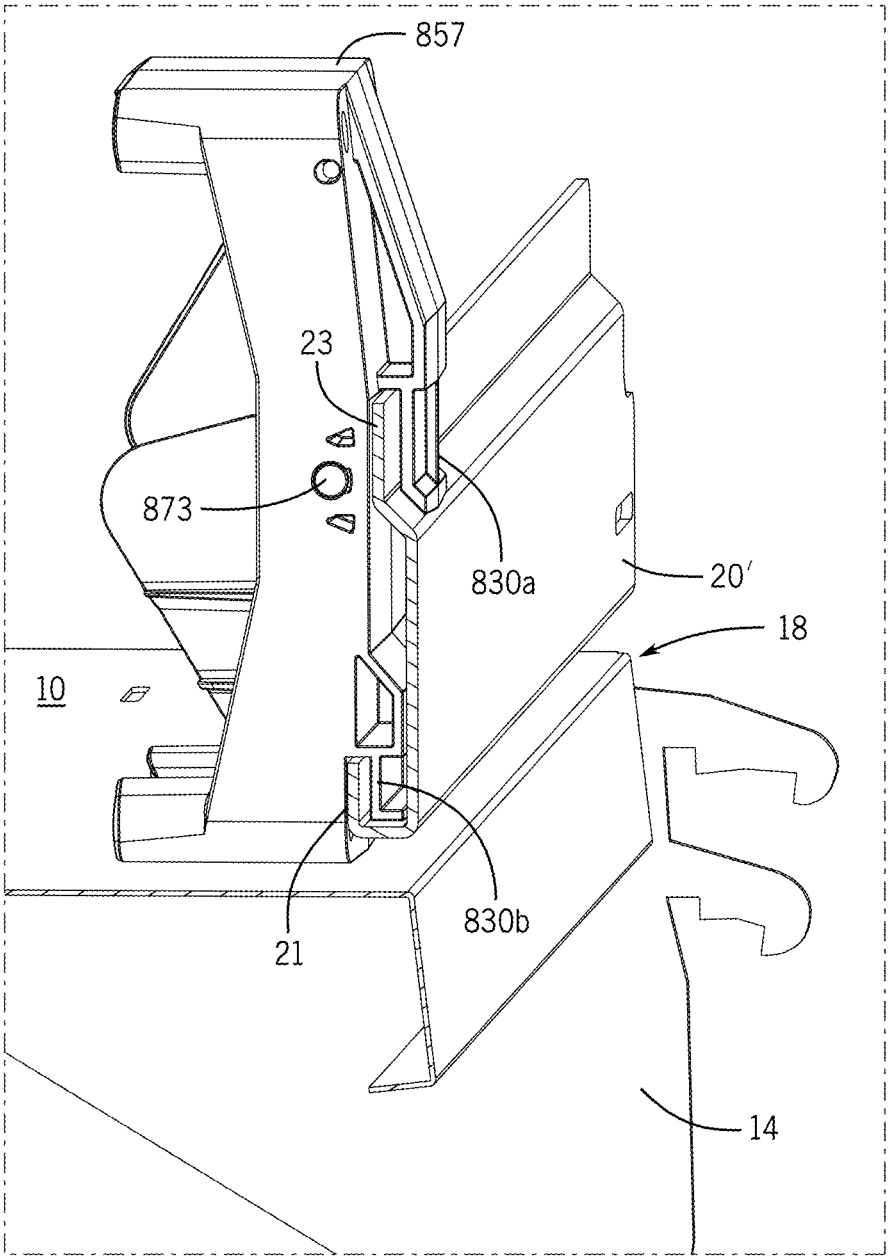
FIG. 49 shows the rear end of the pusher assembly of FIGS. 47 and 48 attached to the horizontal bar.

As shown in FIGS. 48 and 49, the housing 857 is configured to be clipped to a horizontal bar 20' supported above a rear end 18 of the shelf 10.

As shown herein, the paddle 812 is slidable on the shelf 10 into and between an extended position (FIG. 59) proximate the front end 16 of the shelf 10 and a collapsed position (FIG. 61) proximate the rear end 818 of the pusher assembly 810. The product merchandizer system 800 further comprises a locking mechanism 870 configured to retain the paddle 812 in the collapsed position. As discussed with respect to FIGS. 51-56, the locking mechanism 870 has a first portion 872*a*, 872*b* on the paddle 812 and a second portion 874*a*, 874*b* on the housing 857, wherein the first portion 872*a*, 872*b* is configured to be engaged with the second portion 874*a*, 874*b* to retain the paddle 812 in the collapsed position. A first one of the first portion and the second portion of the locking mechanism 870 is configured as a cam device 872*a*, 872*b* and a second one of the first portion and the second portion of the locking mechanism 870 is configured as a spring 874*a*, 874*b*. The spring 874*a*, 874*b* is configured to slide into engagement with the cam device 872*a*, 872*b* to retain the paddle 812 in the collapsed position.

Figure 67:
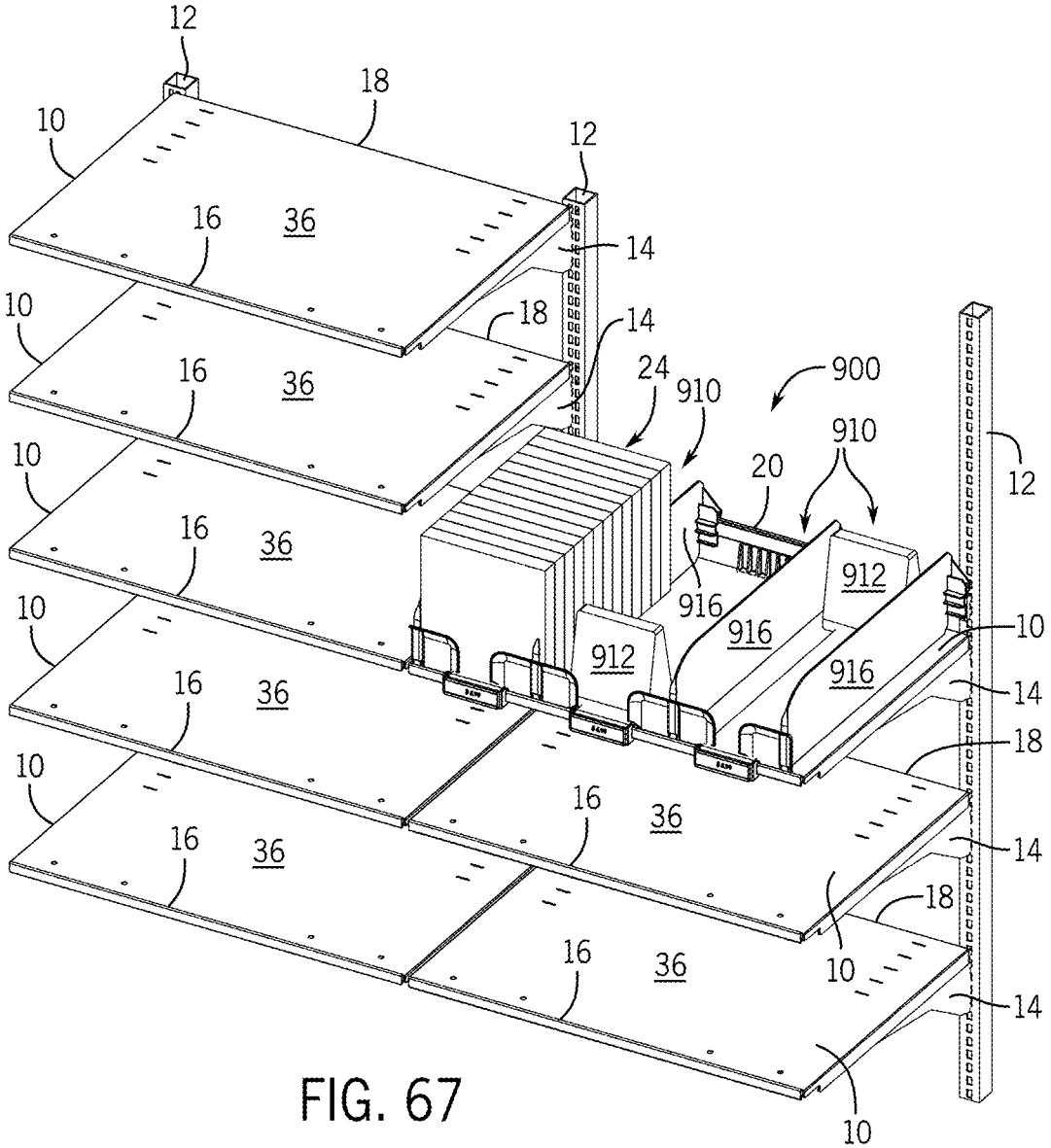
FIG. 67 illustrates a shelf with several product merchandizer systems according to an embodiment of the present disclosure installed thereon.
Figure 68:
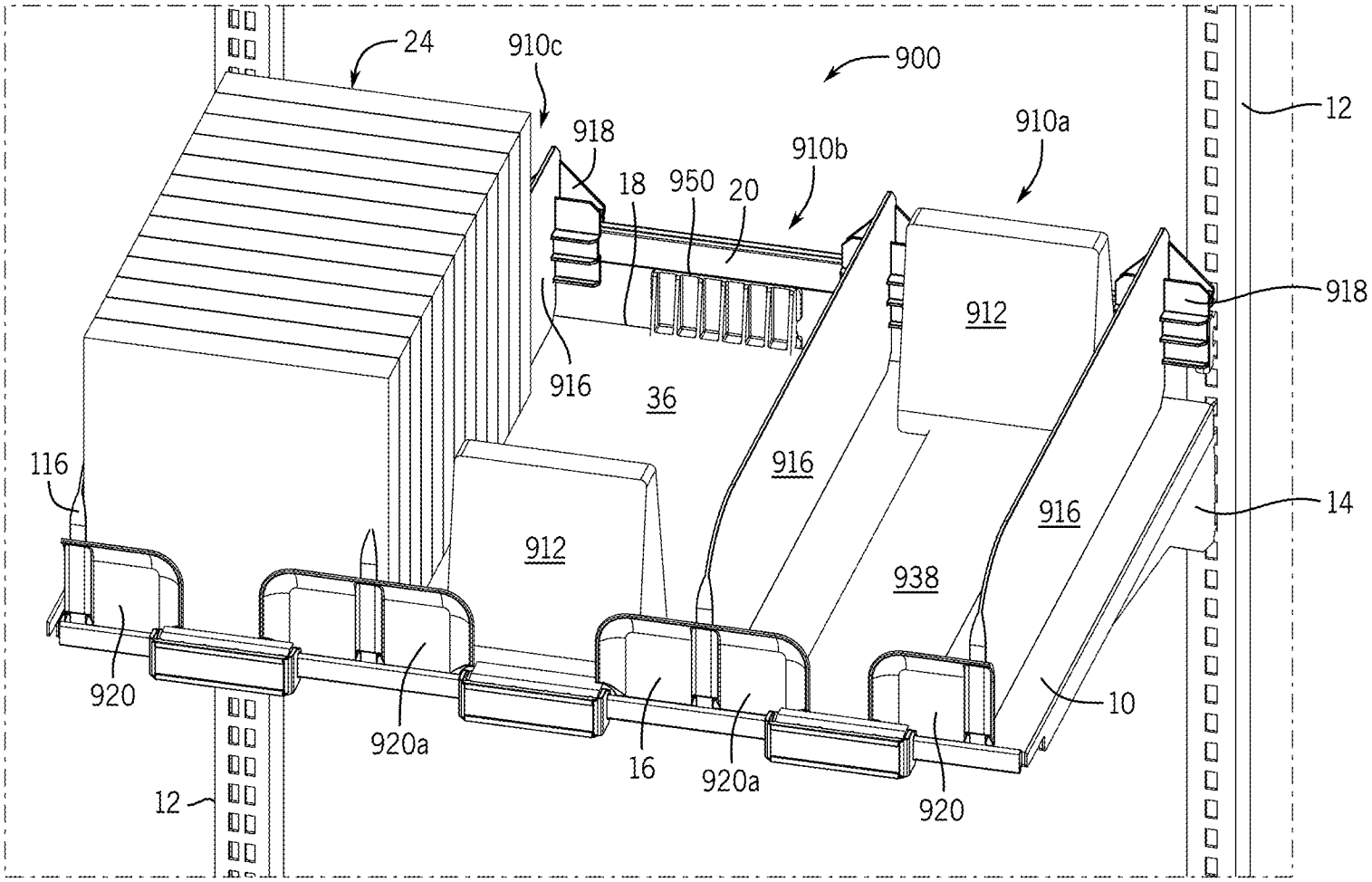
FIG. 68 is a detailed view of a portion of FIG. 67.

FIGS. 67 and 68 illustrate another embodiment of a product merchandizer system 900 installed on a shelf 10. The shelf 10 is supported by two vertical uprights 12 by way of brackets 14. At least one shelf 10 may be installed above, below, and/or laterally to the side of the shelf 10, as illustrated in FIG. 1. In some embodiments, the vertical uprights 12 and shelf 10 may be preinstalled in a store location where the product merchandizer system 900 is to be installed, for example, in a refrigerator, freezer chest, and/or another store location.

Figure 69:
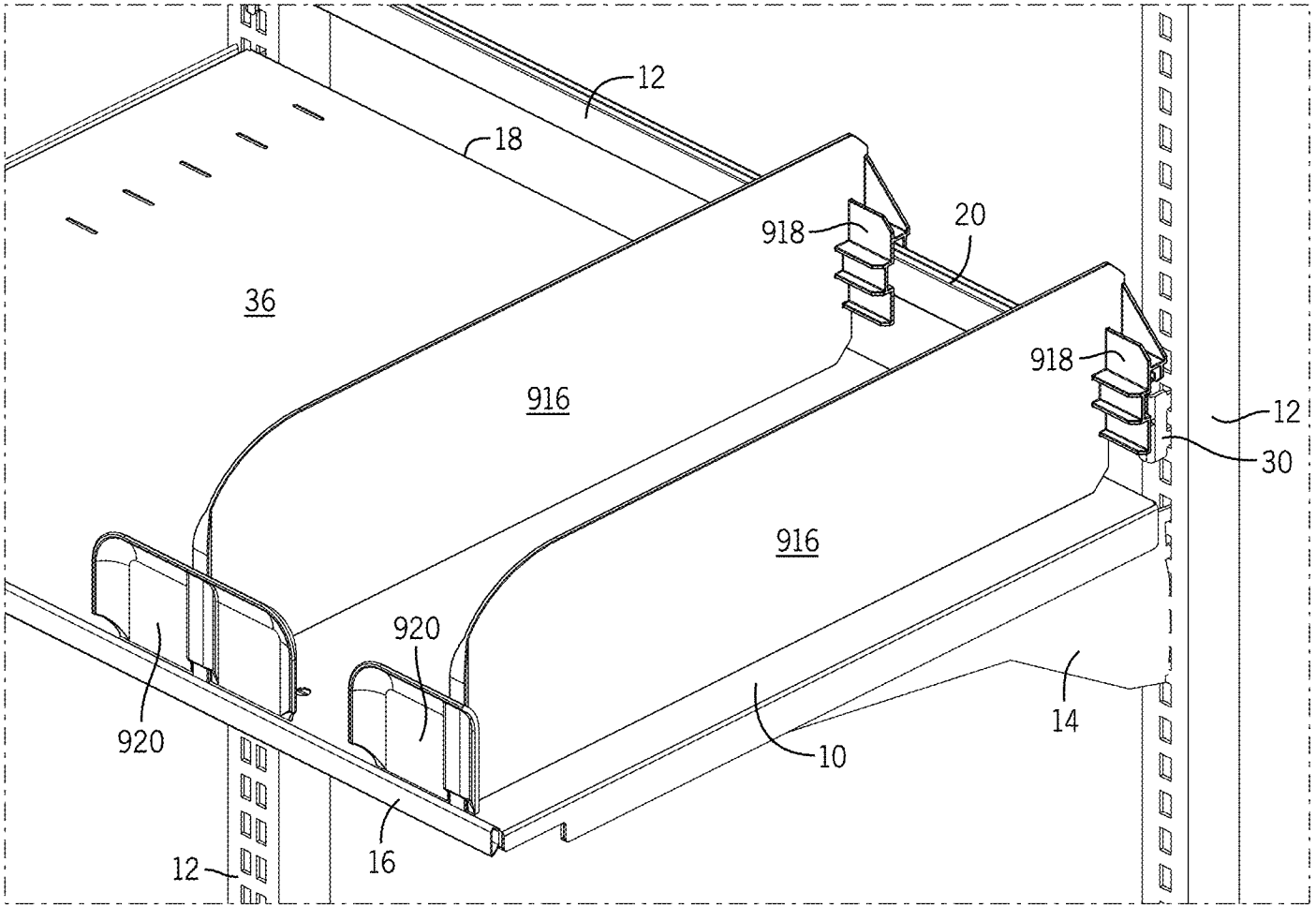
FIG. 69 illustrates partitions of one of the product merchandizer systems of FIG. 67 installed on the shelf.
Figure 70:
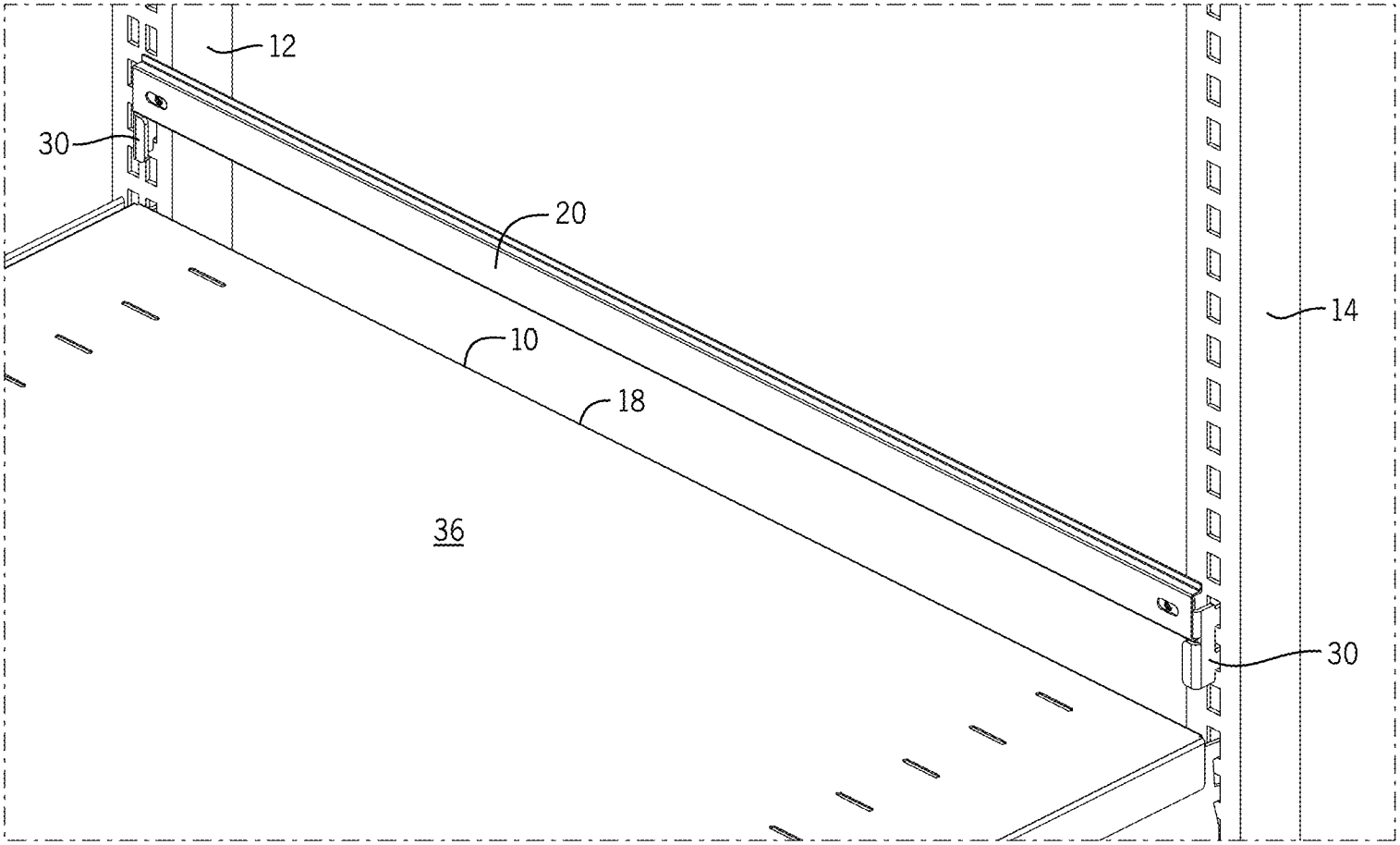
FIG. 70 illustrates a horizontal bar installed on vertical uprights above the shelf.
Figure 71:
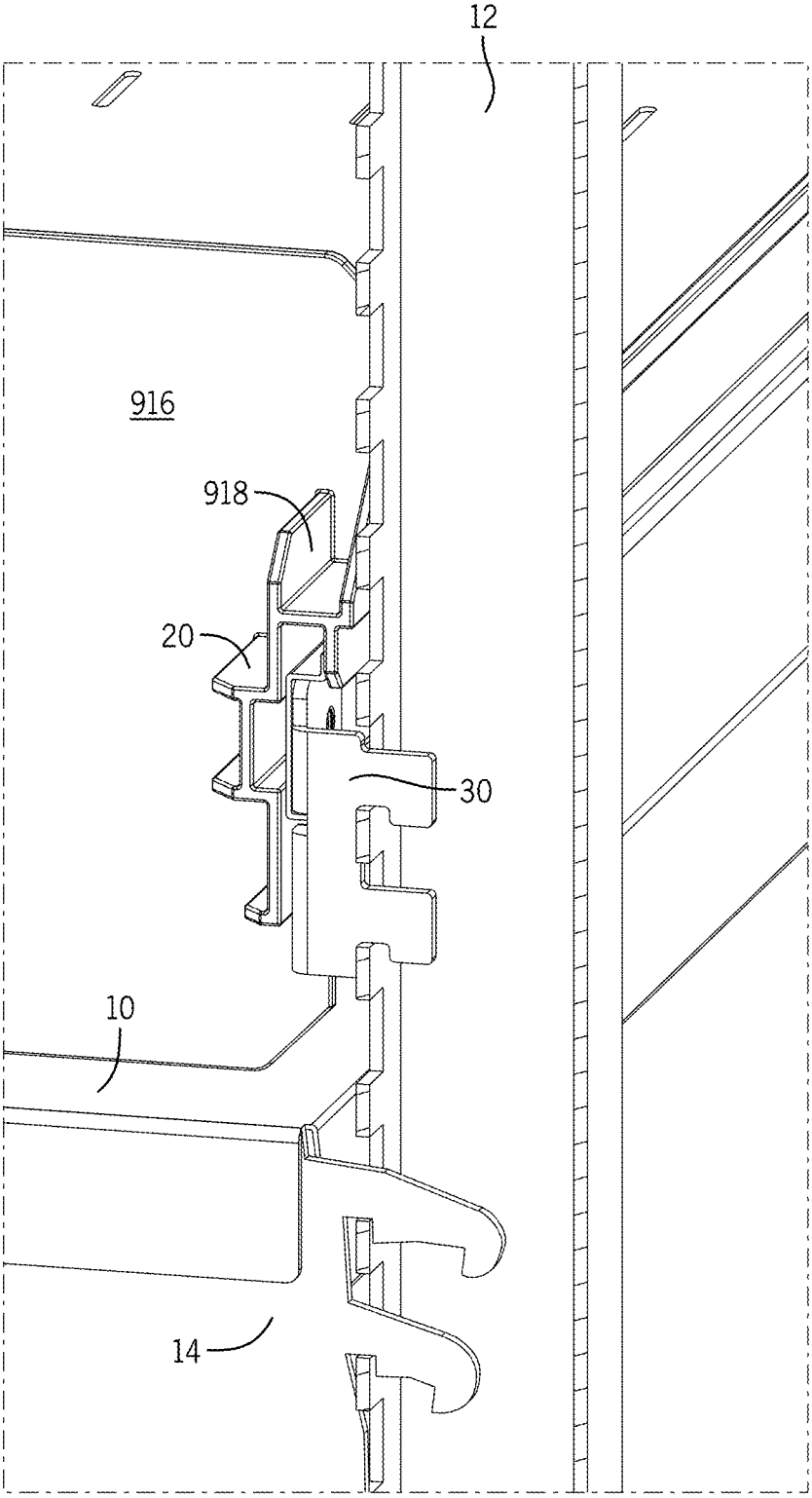
FIG. 71 is a rear perspective view of a vertical upright and an end of the horizontal bar.

Referring to FIGS. 67-72, the shelf 10 has a front end 16 and a rear end 18, the front end 16 being the end that is closer to the consumer when the shelf 10 is installed on the vertical uprights 12. A horizontal bar 20 is supported above the rear end 18 of the shelf 10. Generally, the horizontal bar 20 is parallel with the rear end 18 of the shelf 10, although the two surfaces could be offset from one another in a given application. As illustrated in FIGS. 70 and 71, mounting members 30 engage the vertical uprights 12 to support the horizontal bar 20. In some embodiments, the horizontal bar 20 may be a DIN rail having a top hat section, a C section, or a G section. In the present embodiment, the horizontal bar 20 is a DIN 3 rail having a top hat section, as illustrated in FIGS. 70-71. In other embodiments, the horizontal bar 20 may be a different type of standard rail or may be a custom-manufactured rail. One having ordinary skill in the art will recognize that the shelf 10, vertical uprights 12, and horizontal bar 20 are not the only possible arrangement on which the product merchandizer system 100 can be installed.

As noted hereinabove, the present inventors have discovered through research and development that a shelf-supported merchandizer system can achieve the same or similar functionality as prior art systems, while consuming less vertical, horizontal, and pack-out space than existing merchandizers. The present merchandizer systems are thus low-profile in one, two, or all three dimensions. This allows a shelf to be stocked with a maximum amount of product, decreasing the frequency of re-stocking and thereby decreasing labor costs. Through their research and development, the present inventors have determined that it would be advantageous to equip a product merchandizer system with an assembly configured to move products with which the product merchandizer system is stocked toward a front end of the shelf by pulling, rather than pushing, the products.

As illustrated in FIG. 67, one embodiment of a product merchandizer system 900 may include at least one pusher assembly 910 configured to push products 24 that the product merchandizer system 900 is stocked with toward a front end 16 of the shelf 10. Each pusher assembly 910 is separated from any adjacent pusher assemblies 910 by a partition 916 positioned on, and projecting upwardly from, a top side 36 of the shelf 10. Thus, the partitions 916 divide the product merchandizer system 900 into multiple lanes that are each configured to be stocked with products 24. In the illustrated embodiments, the product merchandizer system 900 includes three lanes that each include a pusher assembly 910. Referring to FIG. 68, a first pusher assembly 910*a* is illustrated in the extended position, a second pusher assembly 910*b* is illustrated in the retracted position, and a third pusher assembly 910*c* is illustrated in the extended position and is stocked with products 24. Some embodiments, however, may be configured with a different number of lanes and/or pusher assemblies 910. Furthermore, at least one pusher assembly may be different than the illustrated pusher assemblies 910.

Figure 72:
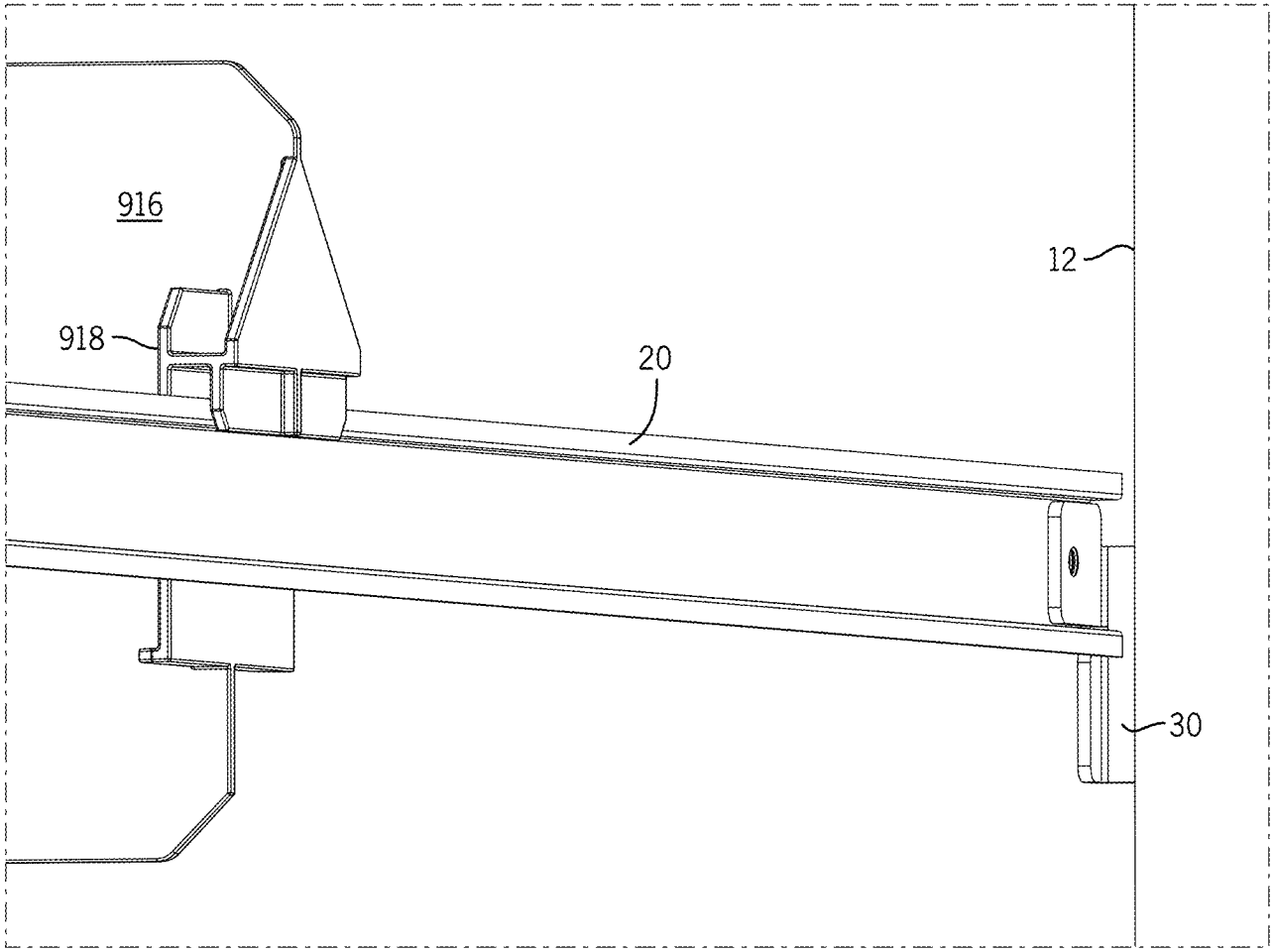
FIG. 72 is a rear perspective view of a partition installed on the horizontal bar.

As illustrated in FIGS. 69 and 72, the partitions 916 each extend from a front end proximate the front end 16 of the shelf 10 to a back end proximate the rear end 18 of the shelf 10. Each partition 916 includes a clip feature 918 configured to secure the partition 916 to the horizontal bar 20. The illustrated clip feature 918 has the shape of a downwardly facing U and is integrally formed with the body of the partition 916. As previously mentioned, the horizontal bar 20 in the illustrated embodiment is a top hat section DIN rail. Thus, the illustrated clip features 918 are designed and shaped accordingly. The clip feature 918 may take other shapes if a different type of DIN rail or a different shape of bar is used. Each partition 916 is slidably movable along the horizontal bar 20 so that the lateral position of the partition 916 on the shelf 10 may be adjusted. This may be useful, for example, in order to adjust the distance between two partitions 916, thereby adjusting the lateral width of the lane between said partitions 916.

Referring to FIGS. 68 and 69, a product merchandizer system 900 may include at least one forward stop 920 configured to limit the longitudinal (i.e., front to back) movement of products 24 on the shelf 10, thereby preventing the products 24 from falling off the front end 16 of the shelf 10. Each forward stop 920 may be secured to at least one of the shelf 10 and a partition 916 proximate the front end 16 and extends laterally away from at least one side of a partition 916. Thus, each forward stop 920 extends laterally across at least a portion of a lane to restrict forward movement of the products 24 in said lane. Forward stops 920 that are positioned proximate a partition 916 that is between two adjacent lanes, such as the forward stops 920*a* in FIG.

Figure 74:
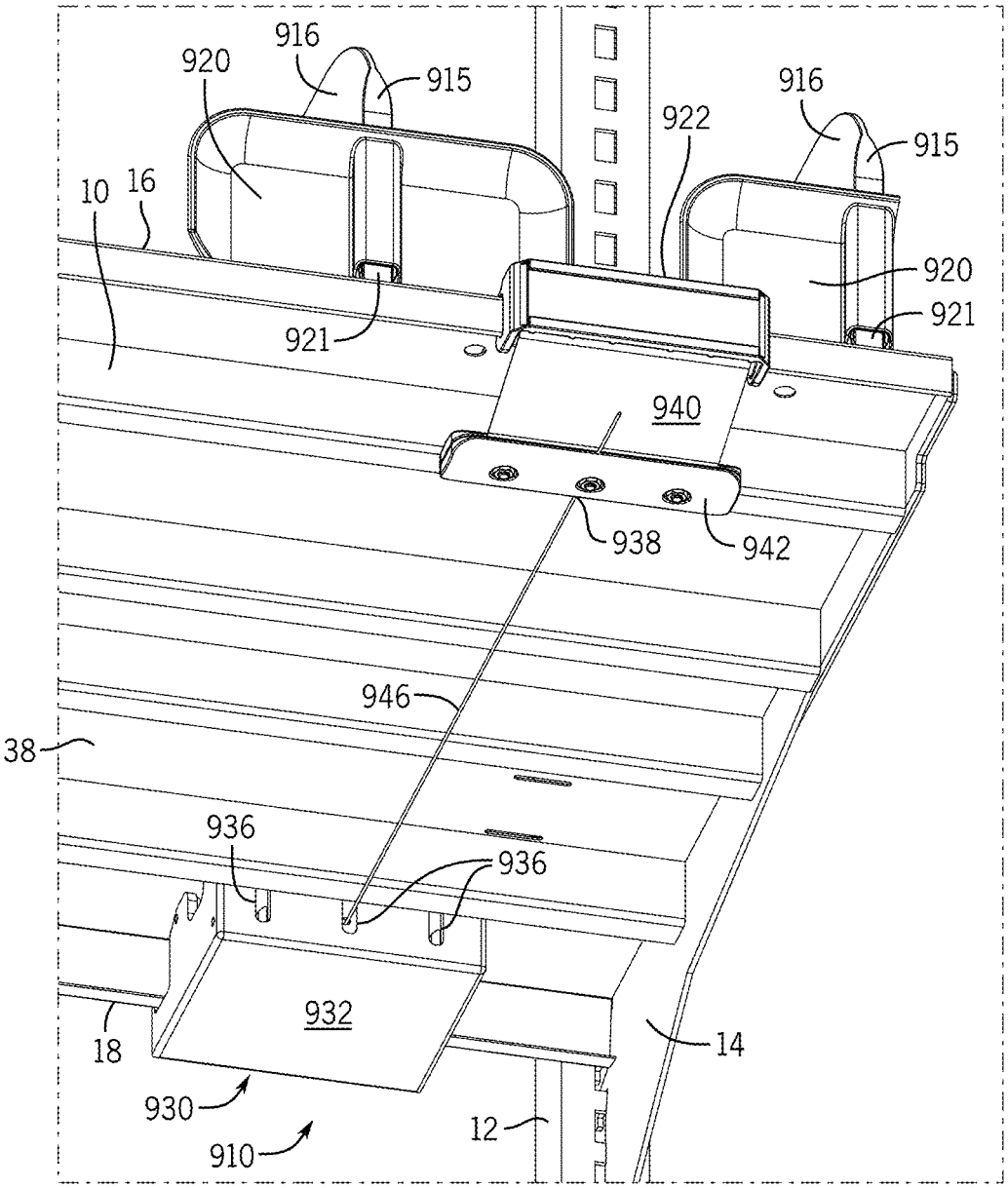
FIG. 74 illustrates an underside of the shelf with the pusher assembly installed thereon.
Figure 75:
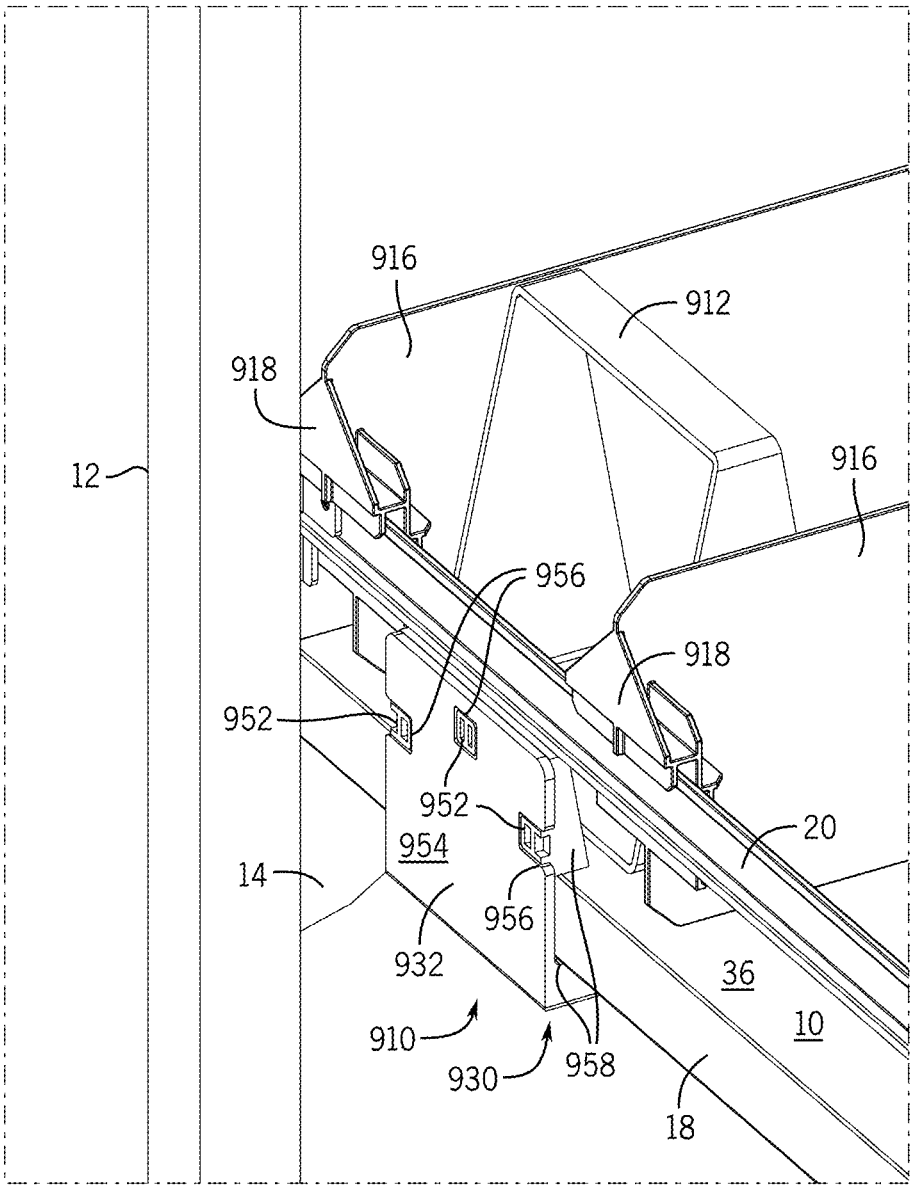
FIG. 75 illustrates a top rear view of the shelf with the pusher assembly installed thereon.
Figure 76:
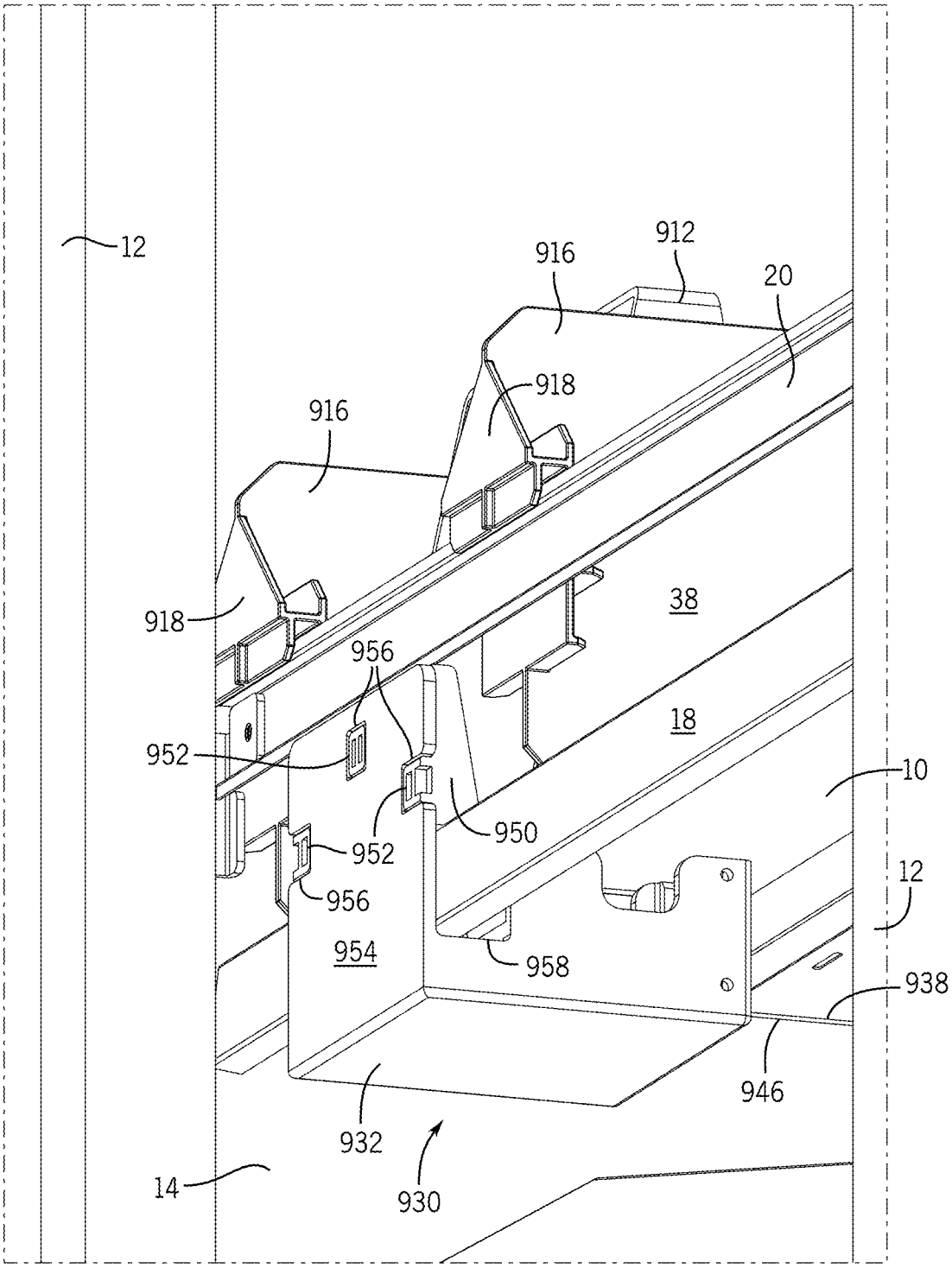
FIG. 76 illustrates a bottom rear view of the shelf with the pusher assembly installed thereon.
Figure 77:
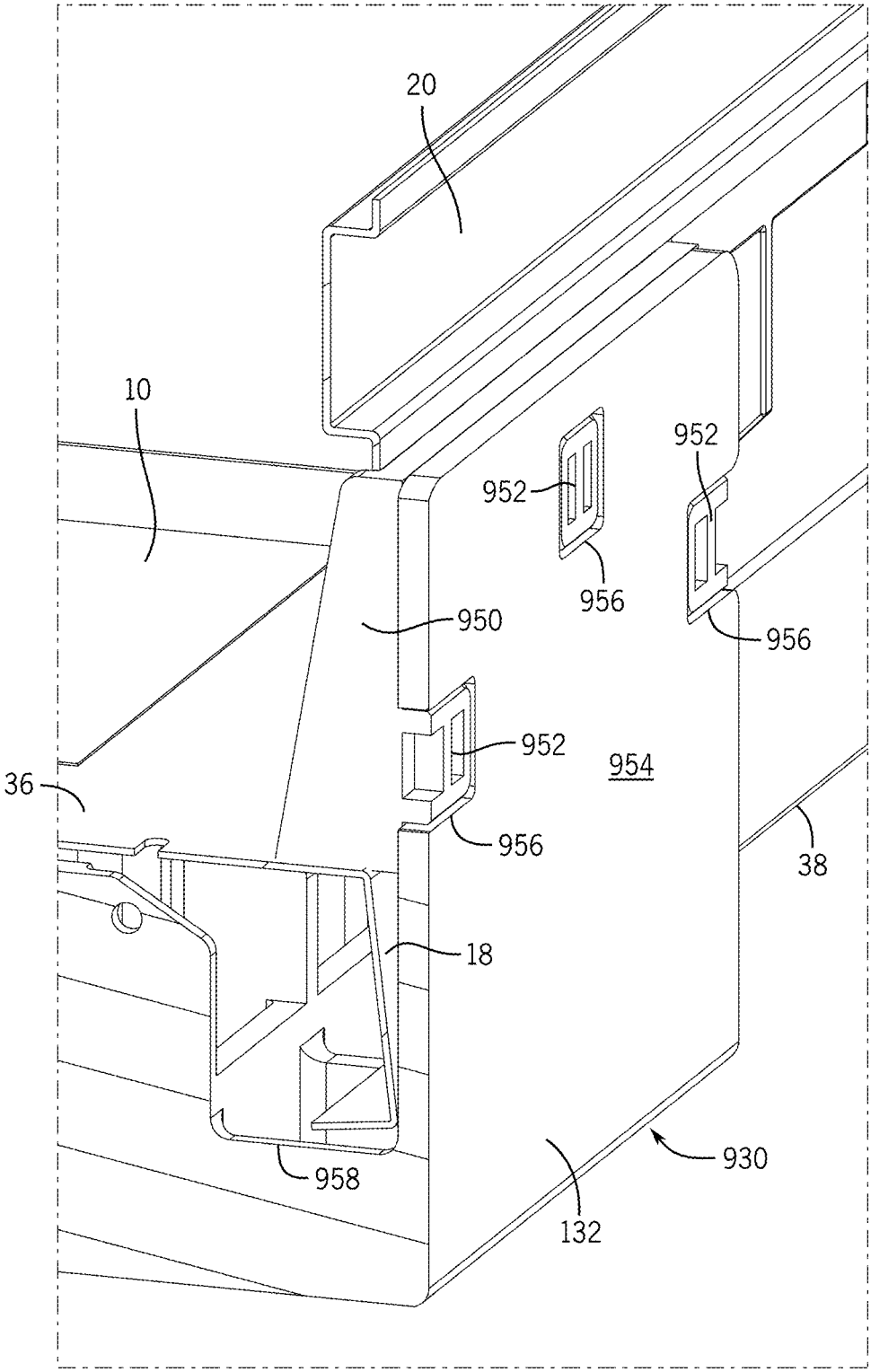
FIG. 77 is a rear perspective view of a retractor housing and a clamp member of one of the product merchandizer systems of FIG. 67.

68, may extend laterally from opposite sides of the partition 916, thereby extending across at least a portion of both adjacent lanes. Some embodiments, however, may be configured with two forward stops that each extend across only one of the adjacent lanes. As shown in FIG. 74, the forward stops 920 may include a channel 921 configured to receive a dovetail 915 on the front end of the partition 916, which together serve to couple the forward stop 920 to the partition 916.

In the illustrated embodiments, at least one of the forward stops 920 may be configured as a lens 920. The lenses 920 are at least partially transparent, thereby allowing a customer to see through the forward stop 920 to view the product 24 on the shelf. Some embodiments, however, may include at least one opaque forward stop 920.

Figure 81:
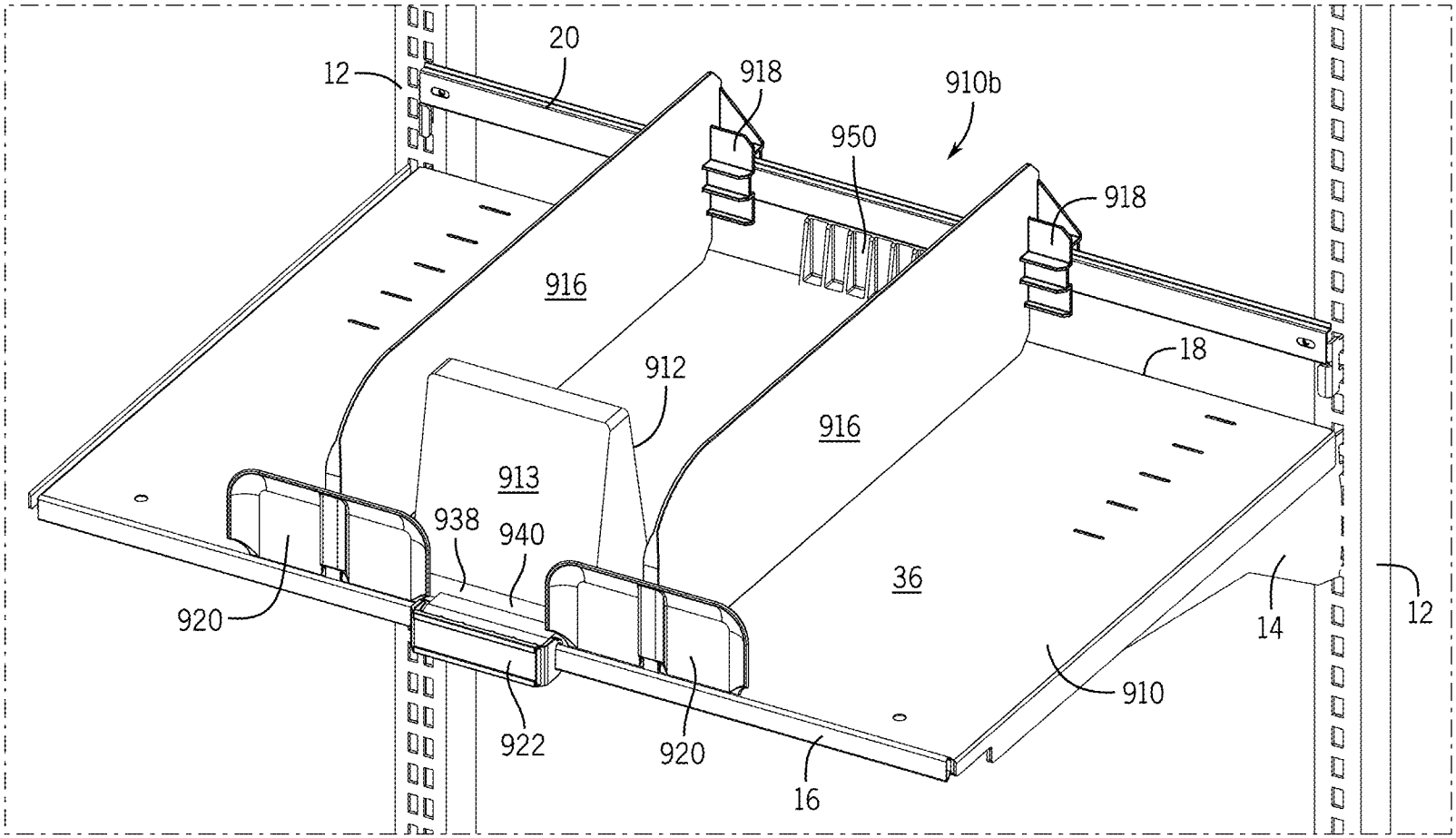
FIG. 81 is a top perspective view of one of the product merchandizer systems of FIG. 67 with the pusher assembly in a retracted position.
Figure 82:
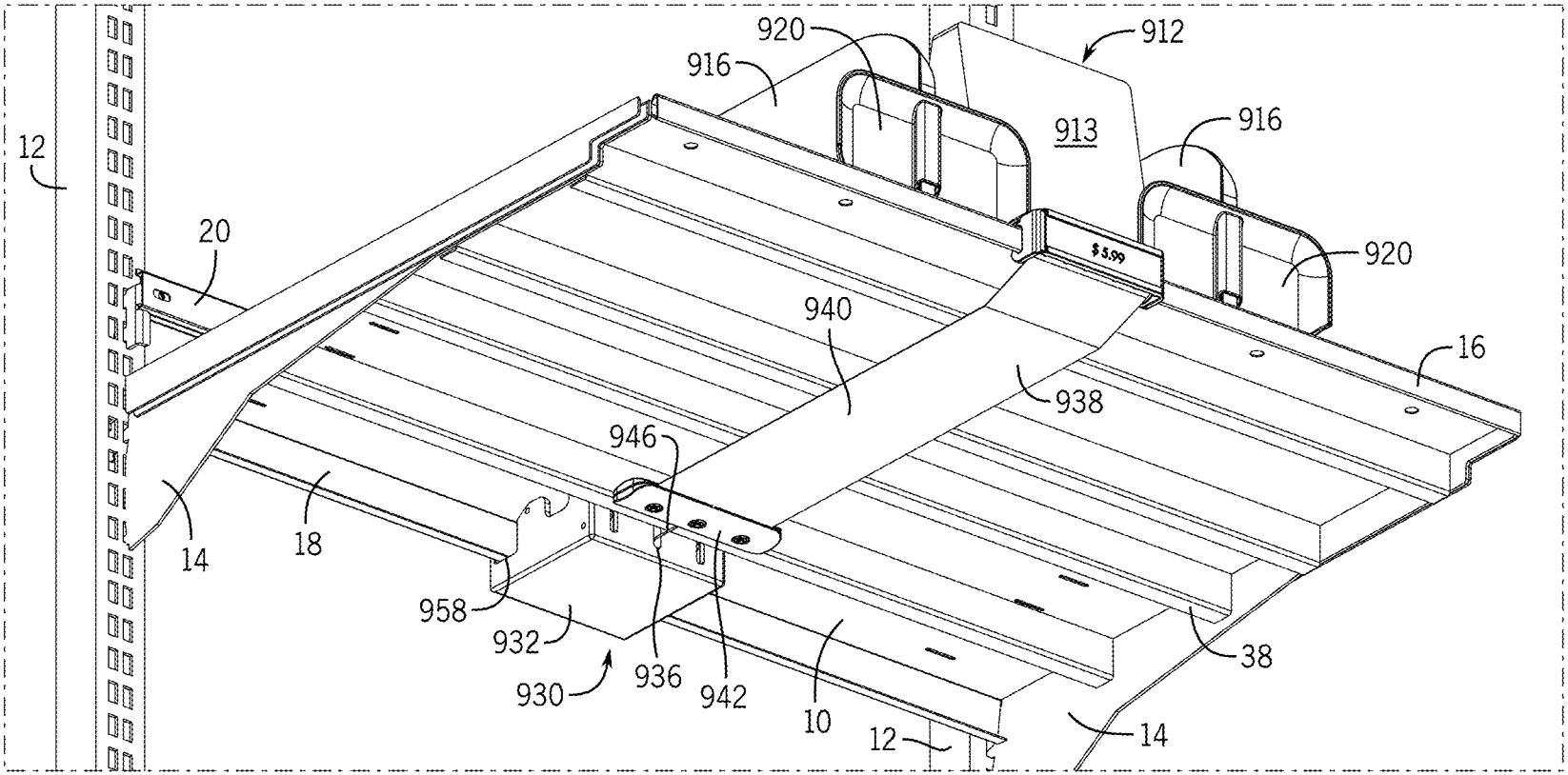
FIG. 82 is a bottom perspective view of the arrangement shown in FIG. 81.
Figure 83:
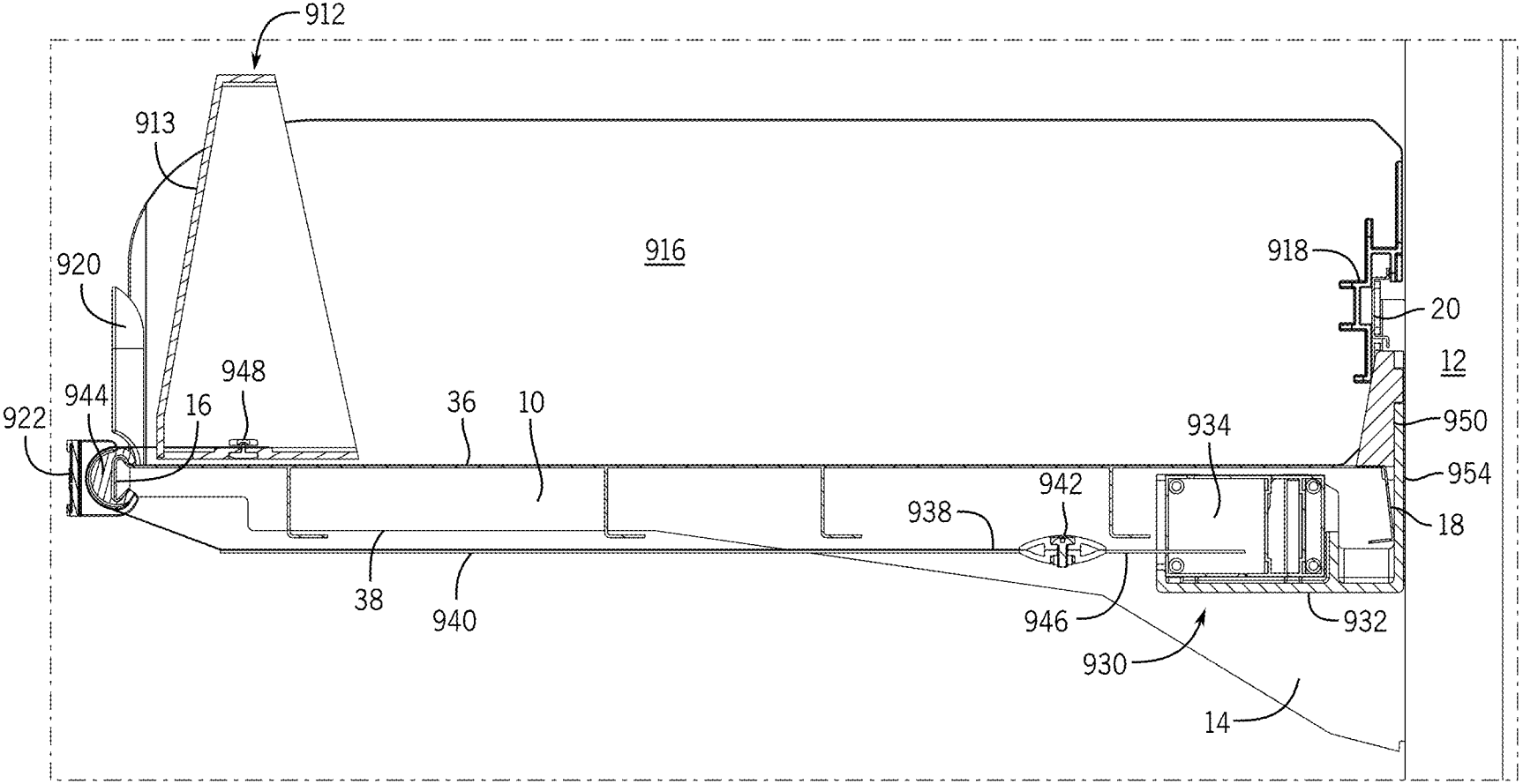
FIG. 83 is a side cross-sectional view of the arrangement shown in FIG. 81.
Figure 84:
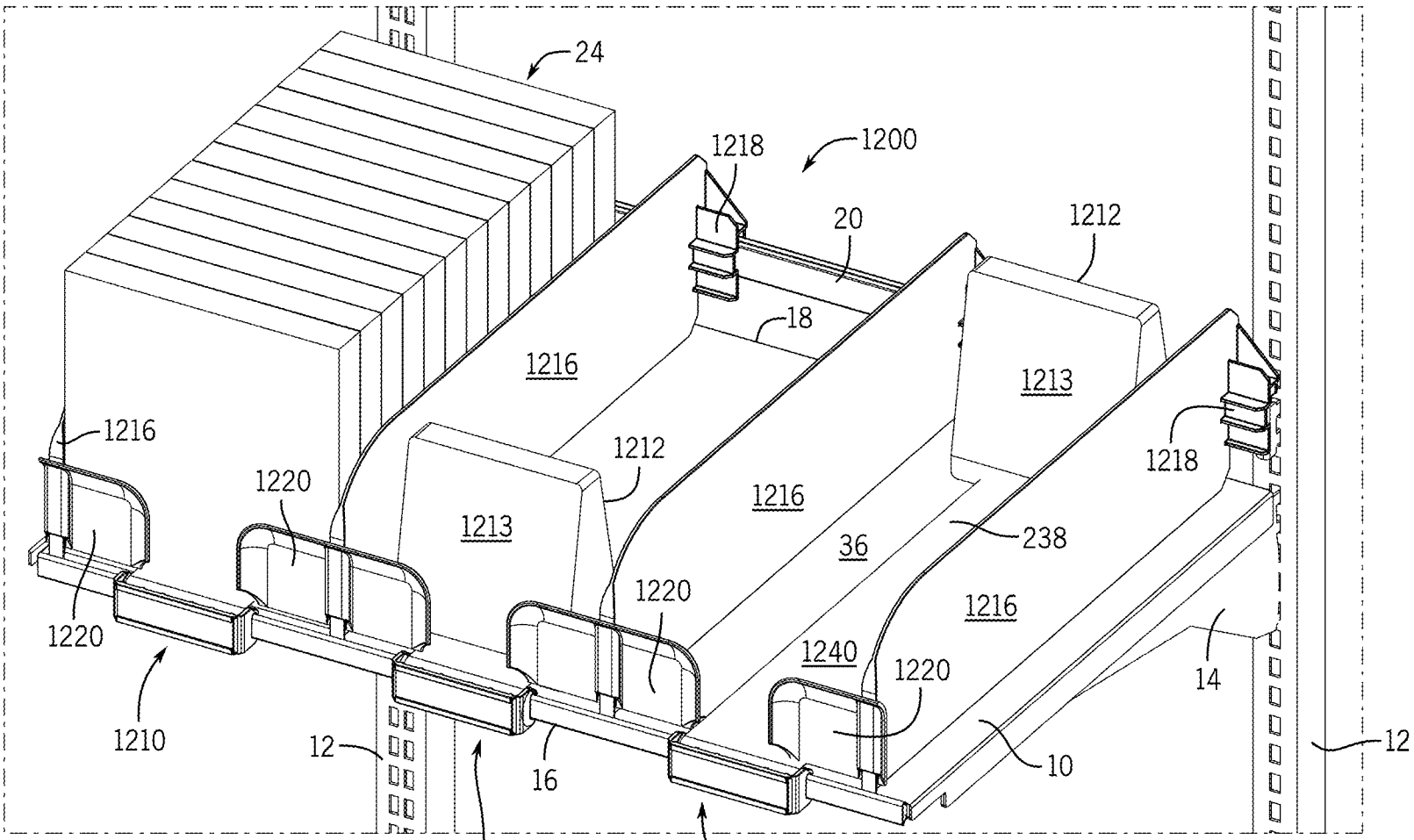
FIG. 84 illustrates a shelf with several product merchandizer systems according to an embodiment of the present disclosure installed thereon.

As previously discussed, the illustrated product merchandizer system 900 includes novel pusher assemblies 910 that push products 24 stocked in the product merchandizer system 900 towards the front end 16 of the shelf 10. For example, FIGS. 73-80 illustrate an embodiment of a pusher assembly 910 in the extended position and FIGS. 81-83 illustrate an embodiment of a pusher assembly 910 in the retracted position.

Figure 73:
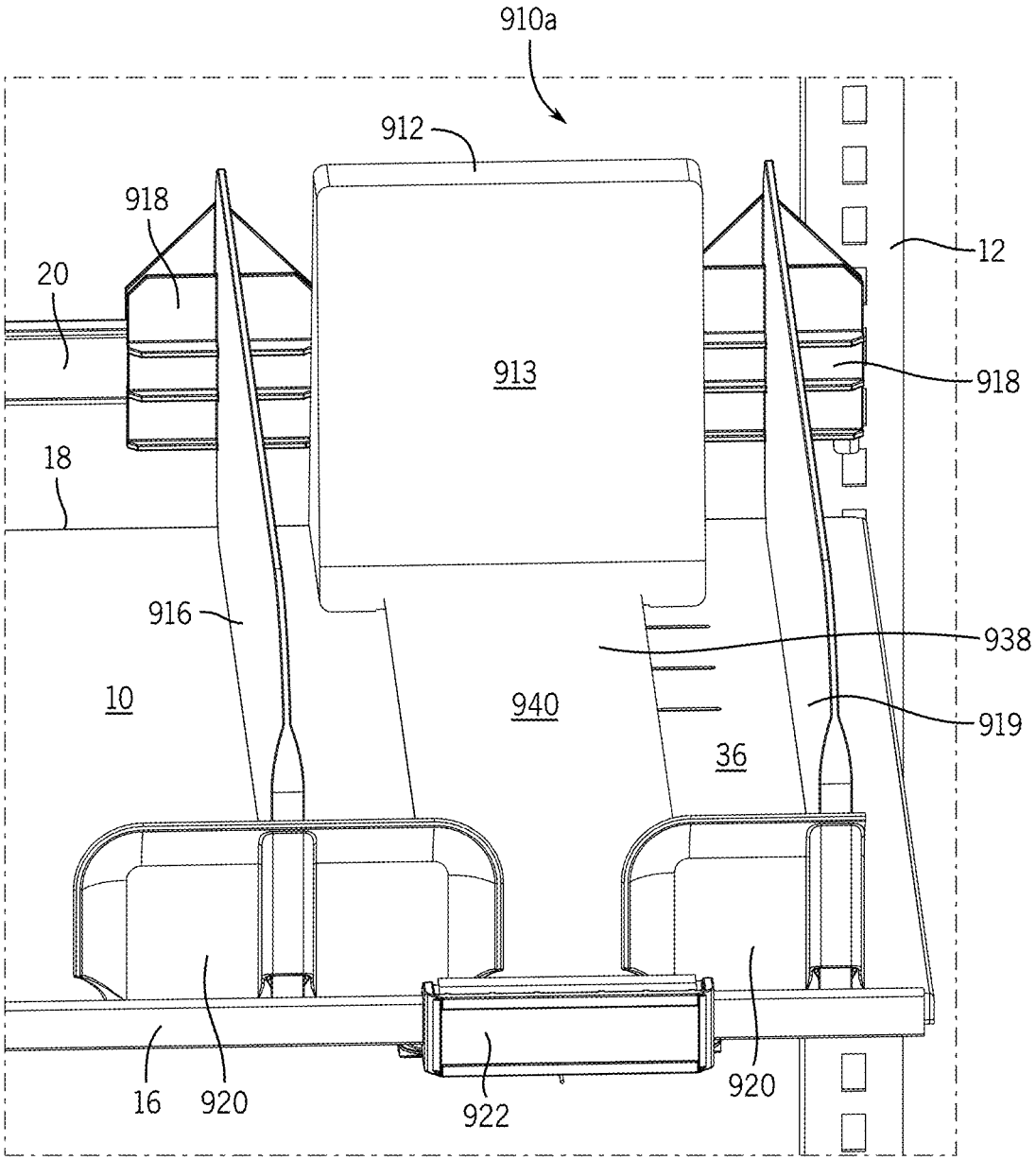
FIG. 73 illustrates a pusher assembly installed between two partitions, with the pusher assembly in an extended position.

Referring to FIGS. 73 and 74, the illustrated pusher assembly 910 includes a pusher paddle 912, a retractor assembly 930 including a retractor device 934 (see, for example, FIGS. 78 and 80), and a flexible connector 938 that extends between the retractor device 934 and the pusher paddle 912. The pusher paddle 912 is positioned on the top side 36 of the shelf 10 and is configured to slide on the top side 36 as the pusher paddle 912 (and therefore the pusher assembly 910) moves into and between the extended and retracted positions. Movement of the pusher paddle 912 towards the retracted position (i.e., towards the front end 16) pushes the products 24 towards the front end 16 of the shelf 10. The pusher paddle 1912 includes a forward facing pushing surface 913 that is configured to abut and push against the products 24 stocked in the corresponding lane of the product merchandizer system 900. The retractor assembly 930 is mounted on the bottom side 38 of the shelf 10 proximate the rear end 18 and is configured to pull the pusher paddle 912 towards the front end 16 of the shelf 10. The retractor assembly 930 includes a retractor housing 932 that houses the retractor device 934 and supports the retractor device 934 below the shelf 10.

Some embodiments of a retractor assembly may be clamped onto the rear end 18 of the shelf 10. For example, referring to FIGS. 75-77 and 80, the retractor housing 932 includes a laterally extending, upwardly facing slot 958 configured to receive the downwardly depending rear end 18 of the shelf 10. A rear wall 954 of the retractor housing 932 extends vertically from a lower end thereof below the bottom side 38 of the shelf to an upper end above the top side 36 of the shelf 10. A clamp member 950 is positioned on the top side 36 of the shelf 10 and is configured to engage the rear wall 954 in order to couple the clamp member 950 to the retractor housing 932, thereby clamping the shelf 10 between the clamp member 950 and the retractor housing 932. In the illustrated embodiment, the retractor housing 932 includes a plurality of openings 956 formed through the rear wall 954. Each opening 956 is engaged by a corresponding protrusion 952 that extends rearwardly from the clamp member 950. Engagement between the openings 956 and the protrusions 952 secures the clamp member 950 to the rear wall 954. While the clamp member 950 is coupled to the rear wall 954, the rear end 18 of the shelf 10 is retained in the slot 958 in the retractor housing 932, thereby coupling the retractor assembly 930 to the rear end 18 of the shelf 10. As will be discussed in further detail below, some embodiments of a retractor assembly may be secured to a shelf 10 in a different manner.

As previously mentioned, a flexible connector 938 extends between the retractor assembly 930 and the pusher paddle 912. Referring to FIGS. 73, 74, 78, and 79, the flexible connector 938 extends forward from the retractor device 934 towards the front end 16 of the shelf 10, wraps around the front end 16 of the shelf 10 from the bottom side 38 to the top side 36, and extends rearward from the front end 16 to the pusher paddle 112. In the illustrated embodiment, the flexible connector 938 is coupled to the pusher paddle 912 by a mechanical fastener 948. However, some embodiments may use a different fastening arrangement.

Figure 78:
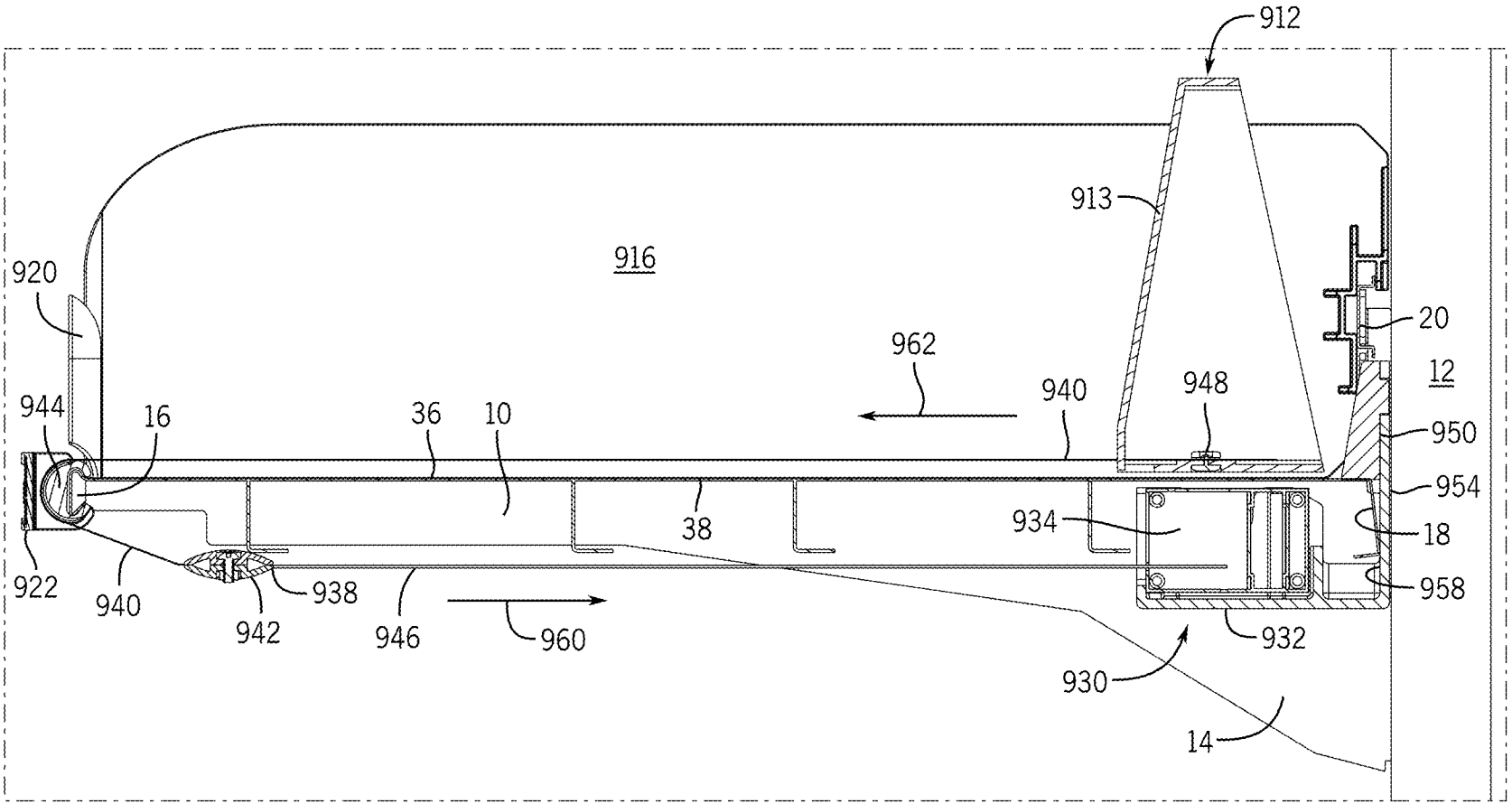
FIG. 78 is a side cross-sectional view of the product merchandizer system of FIG. 73.

Referring to FIGS. 74 and 78, the flexible connector 938 includes a first section configured as a cable 946 and a second section configured as a conveyor belt 940. Additionally or alternatively, some embodiments may include a flexible connector formed entirely by a cable, a flexible connector formed entirely by a conveyor belt, and/or a flexible connector that is at least partially formed from another flexible connecting material. In the present embodiment, the conveyor belt 940 and the cable 946 are secured to each other by a belt clamp 942 that is located between the first and second ends of the flexible connector 938 (e.g., proximate a midpoint of the flexible connector 938 in some embodiments). The cable 946 extends through the front side of the retractor housing 932 via an opening 936 and has a first end connected to the retractor device 934 and a second end secured to the conveyor belt 940 by the belt clamp 942. The retractor device 934 is operatively connected to the cable 946 such that the retractor device 934 may pull the cable 946 rearward and into the retractor housing 932 and/or the retractor device 934. In some embodiments, the retractor device 934 may be configured to selectively provide a biasing force to pull the cable 946 towards the rear end 18 of the shelf 10 while some embodiments of a retractor device 934 may be configured to provide a persistent biasing force to pull the cable 946 to the retractor assembly 930.

Figure 79:
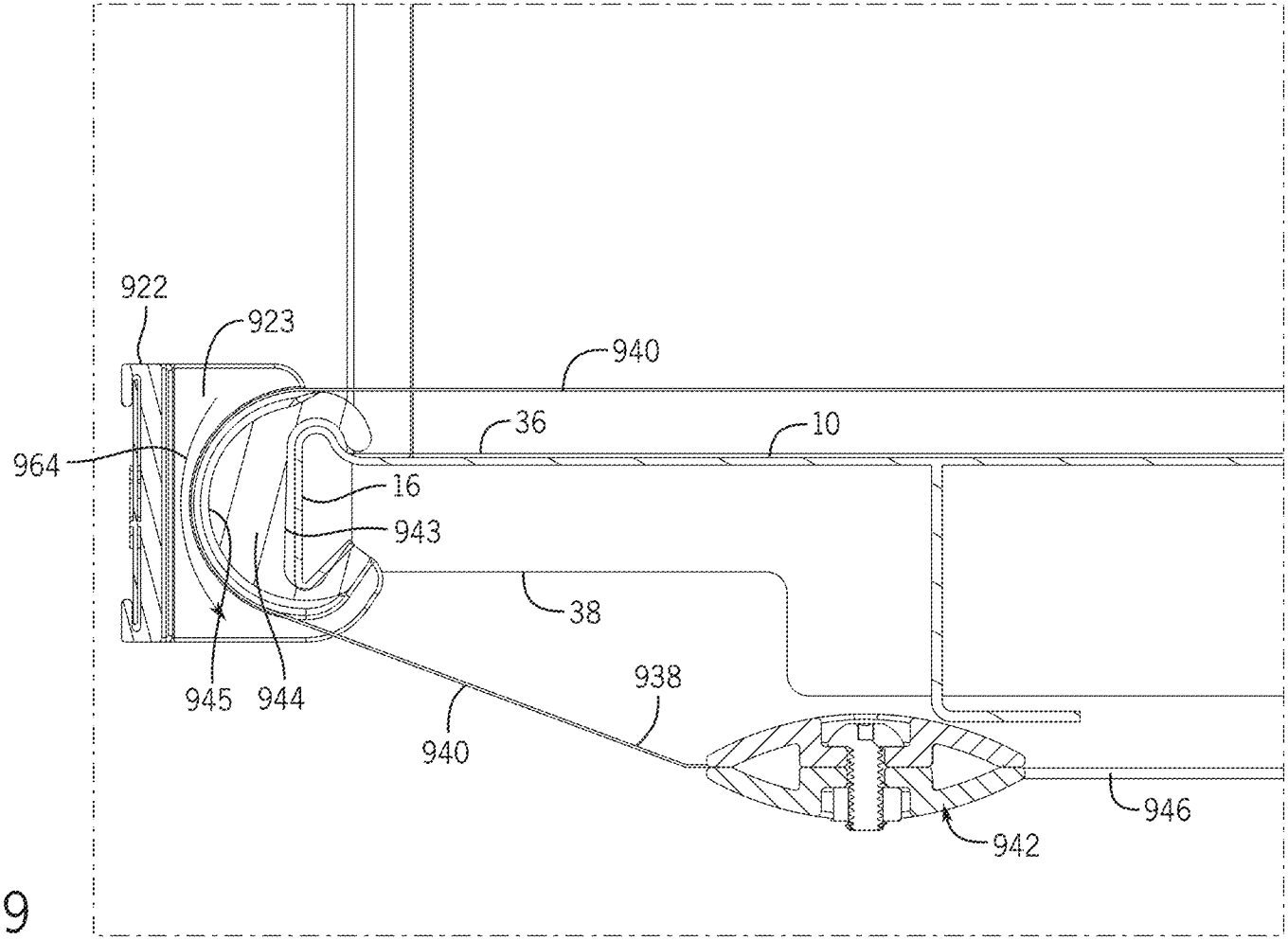
FIG. 79 is a detailed view of a front portion of the product merchandizer system of FIG. 78.
Figure 80:
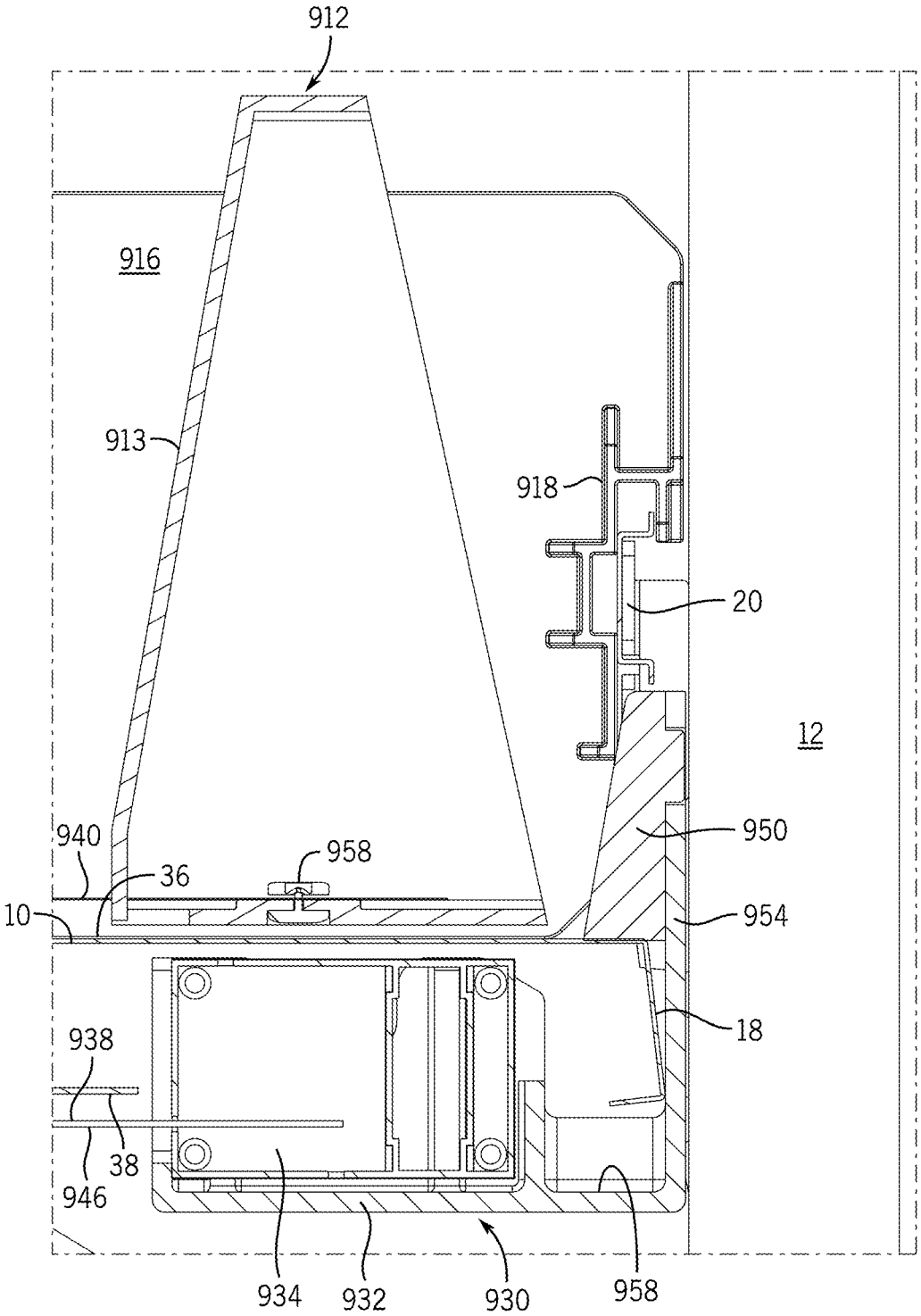
FIG. 80 is a detailed view of a rear portion of the product merchandizer system of FIG. 78.

Referring to FIGS. 73, 74, and 78, the conveyor belt 940 includes a first end that is coupled to the cable 946 by the belt clamp 942 and a second end that is coupled to the pusher paddle 912. As illustrated in FIGS. 78 and 79, the conveyor belt 940 wraps around the front end 16 of the shelf 10 between the top and bottom sides 36, 38 thereof. A conveyor slide 944 is coupled to the front end 16 of the shelf 10 such that the conveyor belt 940 wraps around an outer surface 945 of the conveyor slide 944. As the pusher assembly 910 moves into and between the extended position and retracted position, the conveyor belt 940 slides across the outer surface 945 of the conveyor slide 944. This may be useful, for example, in order to reduce and/or control the friction between the conveyor belt 940 and the front end 16 of the shelf 10. In some embodiments, a display member 922 may be mounted on the front end 16 of the shelf 10 and/or on the conveyor slide 944. The display member 922 may be configured to display information, for example a product price and/or other product information, on the customer facing side of the shelf 10. As illustrated in FIG. 79, the conveyor belt 940 may extend through an interior cavity 923 inside the display member 922. This may be useful, for example, to protect and obscure a portion of the conveyor belt 940 and/or another portion of the pusher assembly 910. The rearward side 943 of the conveyor slide 944 has a geometry that is configured to be clipped or snapped to the front end 16 of the shelf 10. Additionally or alternatively, the conveyor slide 944 may be magnetic. While the illustrated embodiments of the pusher assembly 910 include a conveyor slide 944 coupled to the front end 16 of the shelf 10, some embodiments may be differently configured. For example, a conveyor slide may be integrally formed on the front end of a shelf, and/or a pusher assembly 910 may omit a conveyor slide.

As illustrated in FIG. 68, products 24 stocked in the product merchandizer system 900 are positioned between the pusher paddle 912 and the forward stops 920 at the front end 16 of the shelf 10. The products 24 are supported on top of the conveyor belt 940 such that they (or at least the portion of each product 24 that rests on the conveyor belt 940) are spaced apart from the top side 36 of the shelf 10.

Referring to FIGS. 73, 74, 78, and 79, as the retractor device 934 biases the flexible connector 938 towards the retractor assembly 930, the pusher assembly 910 moves towards the retracted position (see, e.g., FIGS. 81-83). In particular, the illustrated retractor device 934 biases the cable 946 into the retractor device 934, thereby pulling the belt clamp 942 and a portion of the conveyor belt 940 that is located below the shelf 10 towards the retractor assembly 930, for example in the direction of arrow 960 (FIG. 78). As the flexible connector 938 is retracted, the conveyor belt 940 is pulled around the outer surface 945 of the conveyor slide 944, for example in the direction of arrow 964 in FIG. 79. Retracting movement of the conveyor belt 940 towards the retractor device 934 pulls the pusher paddle 912 away from the rear end 18 of the shelf 10 and towards the front end 16. Because the products 24 are supported on top of the conveyor belt 940, they (or at least the portion of each product 24 that rests on the conveyor belt 940) advantageously ride on the conveyor belt 940 and do not slide along the top side 36 of the shelf 10. This may be useful, for example, to control and provide a consistent friction force that resists the forward motion of the products 24. Additionally or alternatively, the weight of the products 24 on the conveyor belt 940 may retain the position of the pusher paddle 912 proximate the middle of the lane between the adjacent partitions 916. Further, the conveyor belt 940 may provide more stability for products such as bags or other items that are irregularly sized and/or shaped.

As products 24 are removed from the product merchandizer system 900, the retractor assembly 930 continues to bias the pusher paddle 912 towards the front end 16 of the shelf 10 by pulling the flexible connector 938 from the bottom side 38 of the shelf 10. When all products 24 have been removed from a lane of the product merchandizer system 900, the pusher assembly 910 is in the fully retracted position illustrated in FIGS. 81-83. In the fully retracted position, the pusher paddle 912 is positioned proximate the front end 16 of the shelf 10 such that the forward stops 920 restrict continued forward movement of the pusher paddle 912.

As the product merchandizer system 900 is restocked with products 24, the force of the added products 24 pushes the pusher paddle 912 against the biasing force of the retractor device 934. This movement pulls the flexible connector 938 away from the retractor assembly 930 to move the pusher paddle 912 toward the rear end 18 of the shelf 10. Thus, the pusher paddle 912 is positionable along the depth of the shelf 10, anywhere between the locations shown in FIGS. 73 and 81.

As previously mentioned, some embodiments of a product merchandiser system may be configured with a different arrangement for mounting a retractor assembly on the shelf 10. For example, referring to FIGS. 84-87, embodiments of a product merchandizer system 1200 may be configured with at least one pusher assembly 1210 including a retractor assembly 1230 that is magnetically coupled to the shelf 10. Similar to the embodiments of FIGS. 67-83, the pusher assemblies 1210 of FIGS. 84-87 include partitions 1216 that are coupled to the horizontal bar 20 and separate adjacent pusher assemblies 1210 from each other. A pusher paddle 1212 on the top side 36 of the shelf 10 is operatively linked to a retractor assembly 1230 positioned on the bottom side 38 of the shelf 10 by a flexible connector 1238 including a conveyor belt 1240 and a cable 1246. A retractor device 1234 housed within a retractor housing 1232 is configured to bias the pusher assembly 1210 into the retracted position. In particular, the retractor device 1234 is configured to retract the cable 1246, thereby pulling the conveyor belt 1240 around a conveyor slide (not shown) on the front end 16 of the shelf 10 and pulling the pusher paddle 1212 towards the front end 16 of the shelf 10 to advance products 24 towards the front end 16. Forward stops 1220, which may be configured as viewing lenses 1220, are configured to prevent products 24 from falling off the front end 16 of the shelf 10.

Figure 85:
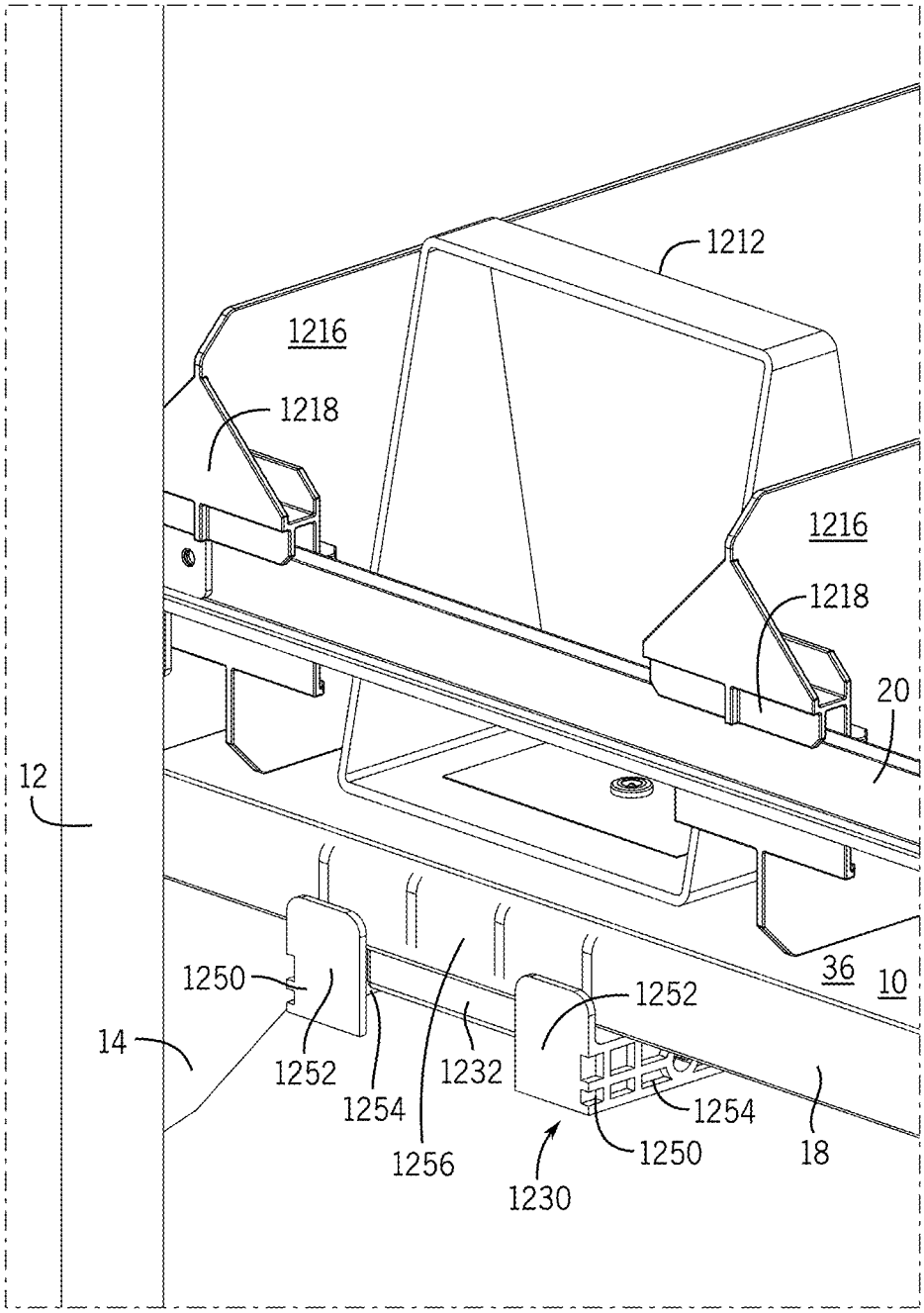
FIG. 85 is a top rear view of one of the product merchandizer systems of FIG. 84.
Figure 86:
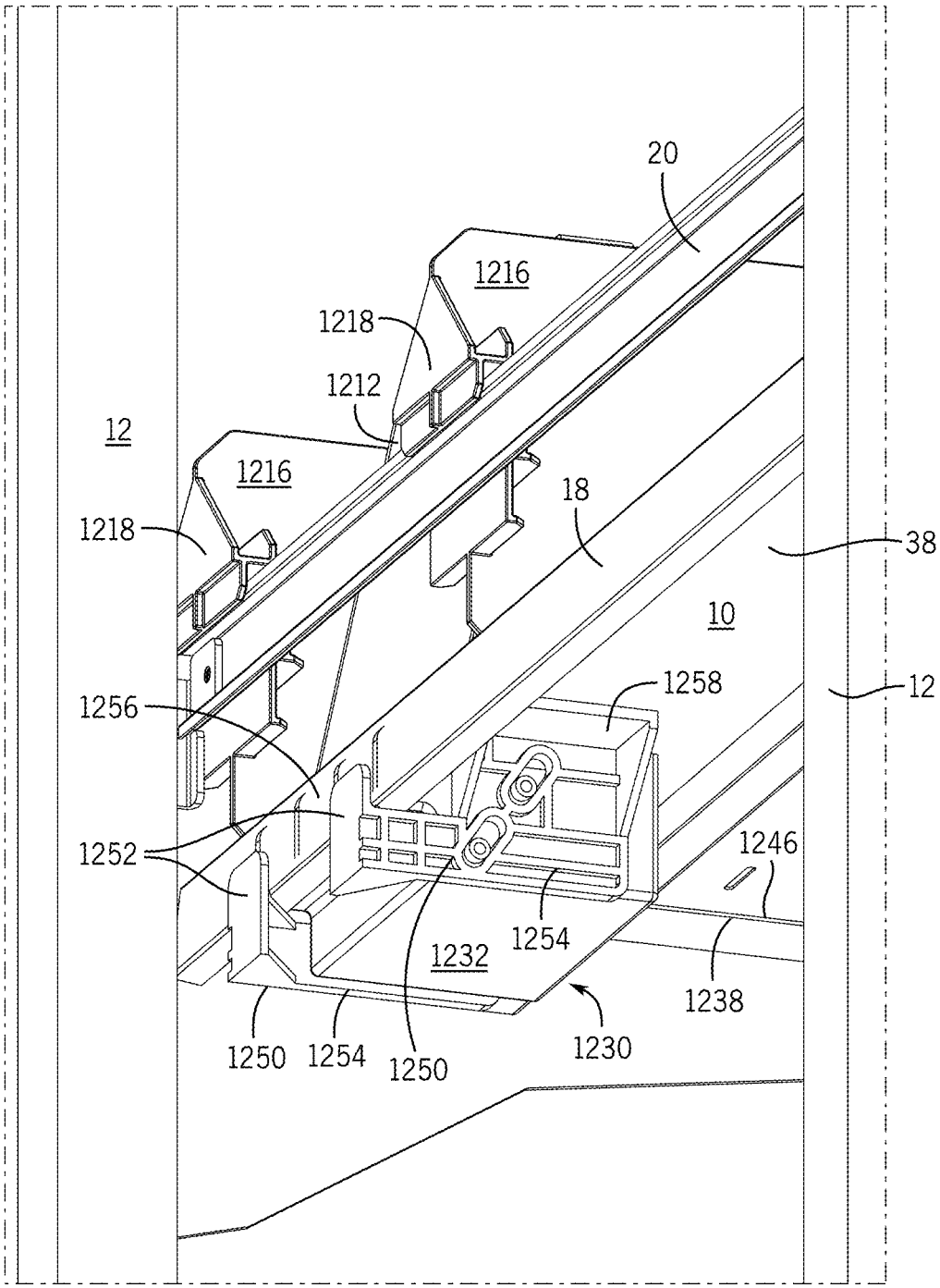
FIG. 86 is a bottom rear view of the product merchandizer system of FIG. 85.
Figure 87:
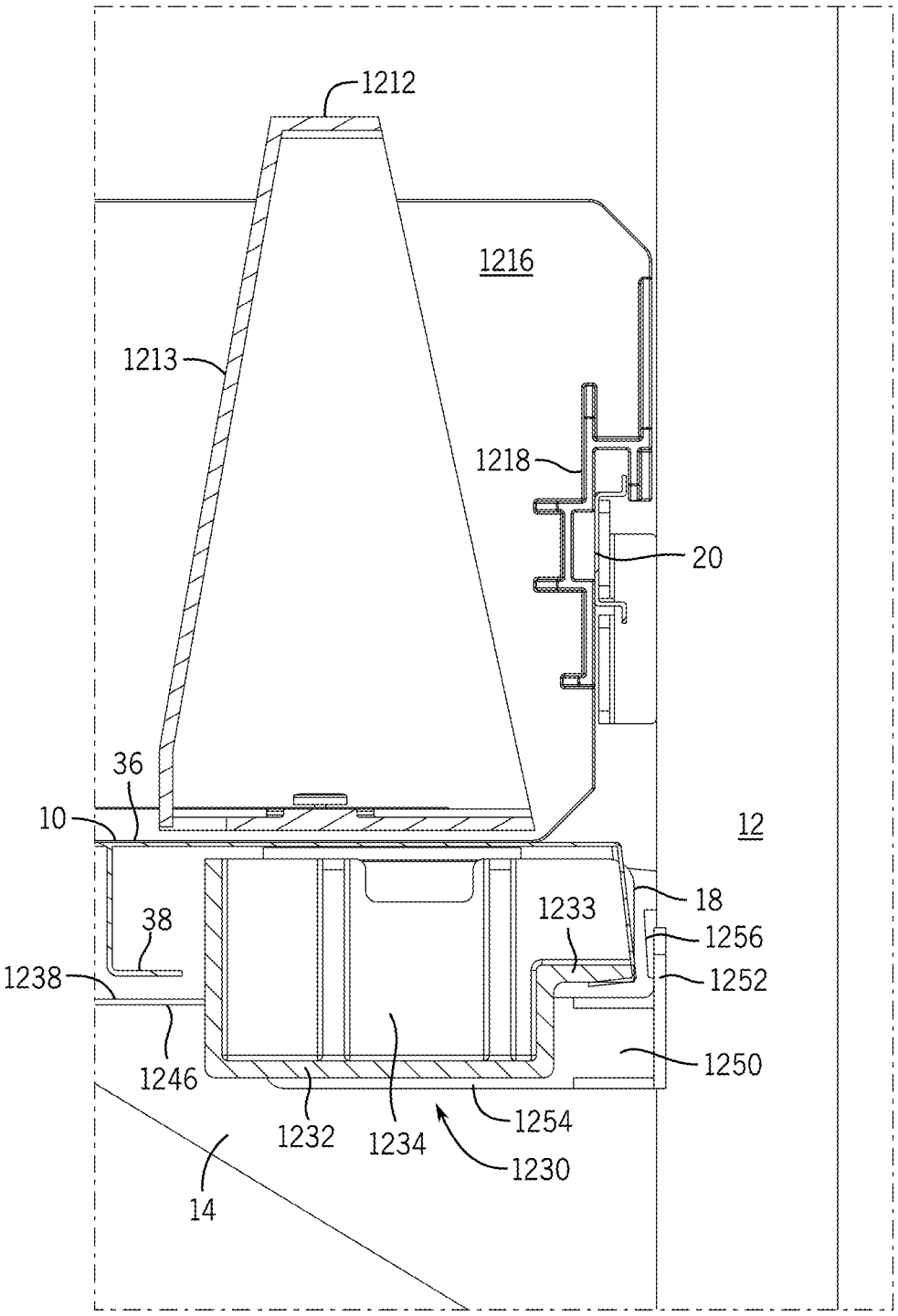
FIG. 87 is a side cross-sectional view of a rear portion of the product merchandizer system of FIG. 85.

Referring to FIGS. 85-87, unlike the pusher assemblies 910 of FIGS. 67-83, the pusher assemblies 1210 include a retractor assembly 1230 that is supported on the bottom side 38 of the shelf 10 proximate the rear end 18 by a magnetic force. Each retractor assembly 1230 includes a retractor housing 1232 that houses the retractor device 1234 and at least one mounting bracket 1250 that suspends the retractor housing 1232 from the shelf 10. The illustrated embodiment includes two mounting brackets 1250 coupled to opposing lateral sides of the retractor housing 1232. However, other embodiments may be differently configured.

Each of the illustrated mounting brackets 1250 includes a support panel 1254 that is coupled to the retractor housing 1232, a rear mounting panel 1252 that abuts and extends upwards along a mounting surface 1256 on the rear end 18 of the shelf 10, and an upper mounting panel 1258 that abuts the bottom side 38 of the shelf 10. At least one of the rear mounting panel 1252 and the upper mounting panel 1258 may be at least partially formed from a magnetic material and/or include a magnet that magnetically couples the mounting bracket 1250 to the shelf 10, thereby securing the retractor assembly 1230 thereto.

Both embodiments of the retractor assembly 930, 1230 shown and described hereinabove operate to bias the pusher assembly 910, 1210 into the retracted position in the same way. Specifically, each retractor housing 932, 1232 houses a retractor device 934, 1234 configured as a cable retractor. The cable retractor may include a coil-spring-biased spindle or drum about which the cable 946, 1246 is wound as the cable 946, 1246 is pulled into the retractor device 934, 1234. In some embodiments, the cable retractor is configured such than an operator can adjust the tension of the coil spring. In some embodiments, more than one cable retractor is located in a given retractor housing 932, 1232, and the cable 946, 1246 associated with each cable retractor is coupled to the belt clamp 942, 1242 to provide additional force to pull the conveyor belt 940, 1240, pusher paddle 912, 1212, and products 24 along the shelf 10. For example, as can be envisioned with respect to FIG. 74, the cables of additional cable retractors could extend from the retractor housing 932 via the openings 936 on either side of the central opening 936 and could be connected to the belt clamp 942 at their distal ends.

The retractor housings 932, 1232 of each embodiment are coupled to the rear end 18 of the shelf 10 in manners that minimize the amount of the assembly that is located on the top side 36 of the shelf 10. This maximizes the pack-out depth of the product merchandizer systems 900, 1200. Further, because the conveyor belt 940, 1240 is a thin, pliable material, it occupies significantly less vertical space than a traditional pusher track. Finally, the use of partitions 916, 1216 with integral clip features 918, 1218 for separating channels, which partitions 916, 1216 attach to a horizontal bar 20 above the shelf 10, maximizes horizontal space that can be used to hold products.

EXAMPLES

According to one embodiment of the present disclosure, a product merchandizer system configured to be installed on a shelf comprises a pusher assembly configured to push products with which the product merchandizer system is stocked toward a front end of the shelf and at least one partition configured to project upwardly from the shelf. A horizontal bar is supported above a rear end of the shelf. The pusher assembly comprises a rear end configured to be clipped to the horizontal bar and a front end configured to rest on the shelf. The at least one partition comprises a rear end configured to be clipped to the horizontal bar and a front end configured to rest on the shelf at the front end of the shelf.

According to some aspects, the pusher assembly is at least partially built into the at least one partition. According to some aspects, the pusher assembly comprises a paddle and a coil spring supported by the paddle. The at least one partition comprises a wall portion and a wire configured to extend from the rear end of the shelf to the front end of the shelf. The paddle is configured to slide along the wire and the coil spring is configured to extend along the wall portion.

According to some aspects, the pusher assembly comprises a track having a lower surface configured to be supported by the shelf and an upper surface configured to support products with which the product merchandizer system is stocked, a paddle that rides along the track, and a coil spring that biases the paddle toward the front end of the shelf. According to some aspects, the pusher assembly further comprises a clip that couples a rear end of the track to the horizontal bar.

According to some aspects, the pusher assembly comprises a paddle, a spring that biases the paddle toward the front end of the shelf, and an extensible member that couples the spring to the paddle. According to some aspects, the pusher assembly further comprises a clip that couples a rear end of the spring and a rear end of the extensible member to the horizontal bar. According to some aspects, the extensible member comprises a series of links. According to other aspects, the extensible member comprises a series of telescoping housings.

According to some aspects, the at least one partition comprises an integral clip feature at rear end thereof, which is configured to be attached to the horizontal bar.

According to some aspects, the pusher assembly comprises a rear end configured to be clipped onto the horizontal bar, a paddle slidable on the shelf into and between an extended position proximate the front end of the shelf and a collapsed position proximate the rear end of the pusher assembly, and a locking mechanism configured to retain the paddle in the collapsed position. According to some aspects, the locking mechanism has a first end on the paddle and a second end on the rear end, and the first end is configured to be engaged with the second end to retain the paddle in the collapsed position. According to some aspects, a first one of the first end and the second end of the locking mechanism is configured as a cam and a second one of the first end and the second end of the locking mechanism is configured as a spring, and the spring is configured to slide into engagement with the cam to retain the paddle in the collapsed position. According to some aspects, the spring is configured to slide into engagement with the cam through a first opening into the cam, and to disengage from the cam via a second opening into the cam. According to some aspects, the locking mechanism is a push-push locking mechanism that is movable into and between a locked position and a disengaged position by pushing the paddle towards the rear end of the pusher assembly.

According to some aspects, the pusher assembly comprises a rear end configured to be clipped onto the horizontal bar, a paddle configured to slide into and between a collapsed position proximate the rear end of the pusher assembly and an extended position proximate the front end of the shelf, wherein the paddle pushes the products stocked in the product merchandizer system the front end of the shelf, and an extender coupled to the paddle, the extender being vertically adjustable to prohibit the products from falling behind the paddle. According to some aspects, the extender is a telescoping extender. According to some aspects, the extender is configured to prohibit the products from falling between the paddle and the rear end of the pusher assembly.

According to some aspects, pairs of links in the series of links are coupled together along respective pivot axes. The pivot axes are oriented horizontally when the pusher assembly is installed on the shelf.

According to some aspects, a first distance between pivot axes at opposing ends of a first link in a given pair of links is not the same as a second distance between pivot axes at opposing ends of a second link in the given pair of links.

According to some aspects, at least one link in the series of links is curved from a first end thereof to a second end thereof.

According to some aspects, the at least one link has reverse curvature.

According to some aspects, at least one of the links in the series of links comprises a protrusion that is configured to interact with an adjacent link in the series of links so as to limit a degree to which the adjacent link can pivot with respect to the at least one of the links comprising the protrusion.

According to one embodiment of the present disclosure, a product merchandizer system configured to be installed on a shelf comprises a pusher assembly configured to push products with which the product merchandizer system is stocked toward a front end of the shelf. The pusher assembly comprises a paddle at a front end of the pusher assembly, the paddle being configured to rest on the shelf, a housing at a rear end of the pusher assembly, a spring supported by the housing and configured to bias the paddle toward the front end of the shelf, and a series of links coupling the spring to the paddle.

According to some aspects, pairs of links in the series of links are coupled together along respective pivot axes. The pivot axes are oriented horizontally when the pusher assembly is installed on the shelf.

According to some aspects, a first distance between pivot axes at opposing ends of a first link in a given pair of links is not the same as a second distance between pivot axes at opposing ends of a second link in the given pair of links.

According to some aspects, at least one link in the series of links is curved from a first end thereof to a second end thereof.

According to some aspects, the at least one link has reverse curvature.

According to some aspects, at least one of the links in the series of links comprises a protrusion that is configured to interact with an adjacent link in the series of links so as to limit a degree to which the adjacent link can pivot with respect to the at least one of the links comprising the protrusion.

According to some aspects, the housing is configured to be clipped to a horizontal bar supported above a rear end of the shelf.

According to some aspects, the paddle is slidable on the shelf into and between an extended position proximate the front end of the shelf and a collapsed position proximate the rear end of the pusher assembly. The product merchandizer system further comprises a locking mechanism configured to retain the paddle in the collapsed position, the locking mechanism having a first portion on the paddle and a second portion on the housing, wherein the first portion is configured to be engaged with the second portion to retain the paddle in the collapsed position. A first one of the first portion and the second portion of the locking mechanism is configured as a cam and a second one of the first portion and the second portion of the locking mechanism is configured as a spring. The spring is configured to slide into engagement with the cam to retain the paddle in the collapsed position.

According to some aspects, the spring has a first end with a first diameter and a second end with a second diameter, and wherein the first diameter is less than the second diameter.

According to one embodiment of the present disclosure, a pusher assembly is for a product merchandiser system configured to be mounted on a shelf. The pusher assembly comprises a rear end positioned proximate a rear end of the shelf and a paddle configured to slide into and between a collapsed position proximate the rear end of the pusher assembly and an extended position proximate a front end of the shelf. The paddle is configured to push products stocked in the product merchandizer system towards the front end of the shelf. A locking mechanism is configured to retain the paddle in the collapsed position, and an extender is coupled to the paddle, the extender being vertically adjustable to prohibit the products from falling behind the paddle.

According to some aspects, the locking mechanism is configured as a push-push locking mechanism with a first end on the paddle and a second end on the rear end of the pusher assembly, wherein the first end of the locking mechanism is slidably engageable with the second end of the locking mechanism to retain the paddle in the collapsed position. According to some aspects, the extender is a telescoping extender configured to prohibit the products from falling between the paddle and the rear end of the pusher assembly.

According to one embodiment of the present disclosure, a product merchandizer system configured to be installed on a shelf comprises at least one partition configured to project upwardly from the shelf. A pusher assembly is configured to move products with which the product merchandizer system is stocked toward a front end of the shelf. The pusher assembly comprises a pusher paddle configured to move the products towards the front end of the shelf and a retractor configured to pull the pusher paddle towards the front end of the shelf. The pusher paddle is positioned on a top side of the shelf and the retractor is positioned on a bottom side of the shelf.

According to some aspects, the retractor is connected to the pusher paddle by a flexible connector, wherein the flexible connector wraps around the front end of the shelf between the top side and the bottom side of the shelf such that the retractor pulls the flexible connector towards a back end of the shelf in order to pull the pusher paddle towards the front end of the shelf.

According to some aspects, the flexible connector comprises a conveyor belt coupled to the pusher paddle, wherein the products are supported on the conveyor belt and are moved towards the front end of the shelf on the conveyor belt as the flexible connector is retracted by the retractor.

According to some aspects, the flexible connector comprises a cable configured to be retracted by the retractor, wherein the cable extends from the retractor to the conveyor belt to couple the conveyor belt to the retractor.

According to some aspects, the product merchandiser system further comprises a belt clamp that couples the cable to the conveyor belt below the bottom side of the shelf.

According to some aspects, the product merchandiser system further comprises a conveyor slide coupled to the front end of the shelf, wherein the flexible connector is configured to slide on the conveyor slide as the flexible connector is pulled around the front end of the shelf from the top side to the bottom side thereof.

According to some aspects, the product merchandiser system further comprises a retractor housing that secures the retractor to the bottom side of the shelf proximate a back end of the shelf.

According to some aspects, the retractor housing clamps onto the shelf to support the retractor on the bottom side of the shelf.

According to some aspects, the retractor housing is magnetically coupled to the shelf to support the retractor on the bottom side of the shelf.

According to another embodiment of the present disclosure, a pusher assembly for a product merchandiser on a shelf comprises a pusher paddle configured to move products stocked on the product merchandiser towards a front end of the shelf. A retractor is configured to pull the pusher paddle towards the front end of the shelf. The pusher paddle is positioned on a top side of the shelf and the retractor is positioned on a bottom side of the shelf.

According to some aspects, the retractor is connected to the pusher paddle by a flexible connector, wherein the flexible connector wraps around the front end of the shelf between the top side and the bottom side of the shelf such that the retractor pulls the flexible connector towards a back end of the shelf to pull the pusher paddle towards the front end of the shelf.

According to some aspects, the pusher assembly further comprises a connector slide coupled to the front end of the shelf, wherein the flexible connector is configured to slide on the connector slide as the flexible connector is pulled around the front end of the shelf by the retractor.

In the above description, certain terms have been used for brevity, clarity, and understanding. No unnecessary limitations are to be inferred therefrom beyond the requirement of the prior art because such terms are used for descriptive purposes and are intended to be broadly construed. The order of method steps or decisions shown in the Figures and described herein are not limiting on the appended claims unless logic would dictate otherwise. It should be understood that the decisions and steps can be undertaken in any logical order and/or simultaneously. The different systems and methods described herein may be used alone or in combination with other systems and methods. It is to be expected that various equivalents, alternatives and modifications are possible within the scope of the appended claims.

What is claimed is:

1. A product merchandizer system configured to be installed on a shelf, the product merchandizer system comprising:

a pusher assembly configured to push products with which the product merchandizer system is stocked toward a front end of the shelf; and at least one partition configured to project upwardly from the shelf;

wherein a horizontal bar is supported above a rear end of the shelf;

wherein the pusher assembly comprises a rear end configured to be clipped to the horizontal bar and a front end configured to rest on the shelf;

wherein the at least one partition comprises a rear end configured to be clipped to the horizontal bar and a front end configured to rest on the shelf at the front end of the shelf; and wherein the pusher assembly comprises:

a paddle;

a spring that biases the paddle toward the front end of the shelf: and an extensible member that couples the spring to the paddle.

2. The product merchandizer system of claim 1, wherein the pusher assembly further comprises a housing having a clip that couples a rear end of the spring and a rear end of the extensible member to the horizontal bar.

3. The product merchandizer system of claim 1, wherein the extensible member comprises a series of links.

4. The product merchandizer system of claim 3, wherein pairs of links in the series of links are coupled together along respective pivot axes; and wherein the pivot axes are oriented horizontally when the pusher assembly is installed on the shelf.

5. The product merchandizer system of claim 4, wherein a first distance between pivot axes at opposing ends of a first link in a given pair of links is not the same as a second distance between pivot axes at opposing ends of a second link in the given pair of links.

6. The product merchandizer system of claim 3, wherein at least one link in the series of links is curved from a first end thereof to a second end thereof.

7. The product merchandizer system of claim 6, wherein the at least one link has reverse curvature.

8. The product merchandizer system of claim 3, wherein at least one of the links in the series of links comprises a protrusion that is configured to interact with an adjacent link in the series of links so as to limit a degree to which the adjacent link can pivot with respect to the at least one of the links comprising the protrusion.

9. The product merchandizer system of claim 1, wherein the paddle is slidable on the shelf into and between an extended position proximate the front end of the shelf and a collapsed position proximate the rear end of the pusher assembly; and wherein the pusher assembly further comprises a locking mechanism having a first portion on the paddle and a second portion on the rear end of the pusher assembly, wherein the first portion is configured to be engaged with the second portion to retain the paddle in the collapsed position.

10. The product merchandizer system of claim 9, wherein a first one of the first portion and the second portion of the locking mechanism is configured as a cam and a second one of the first portion and the second portion of the locking mechanism is configured as a further spring; and wherein the further spring is configured to slide into engagement with the cam to retain the paddle in the collapsed position.

11. The product merchandizer system of claim 10, wherein the further spring is configured to slide into engagement with the cam through a first opening into the cam, and to disengage from the cam via a second opening into the cam.

12. A product merchandizer system configured to be installed on a shelf, the product merchandizer system comprising:

a pusher assembly configured to push products with which the product merchandizer system is stocked toward a front end of the shelf, wherein the pusher assembly comprises:

a paddle at a front end of the pusher assembly, the paddle being configured to rest on the shelf;

a housing at a rear end of the pusher assembly;

a spring supported by the housing and configured to bias the paddle toward the front end of the shelf; and a series of links coupling the spring to the paddle;

wherein the housing is configured to be clipped to a horizontal bar supported above a rear end of the shelf.

13. The product merchandizer system of claim 12, wherein pairs of links in the series of links are coupled together along respective pivot axes; and wherein the pivot axes are oriented horizontally when the pusher assembly is installed on the shelf.

14. The product merchandizer system of claim 13, wherein a first distance between pivot axes at opposing ends of a first link in a given pair of links is not the same as a second distance between pivot axes at opposing ends of a second link in the given pair of links.

15. The product merchandizer system of claim 12, wherein at least one link in the series of links is curved from a first end thereof to a second end thereof.

16. The product merchandizer system of claim 15, wherein the at least one link has reverse curvature.

17. The product merchandizer system of claim 12, wherein at least one of the links in the series of links comprises a protrusion that is configured to interact with an adjacent link in the series of links so as to limit a degree to which the adjacent link can pivot with respect to the at least one of the links comprising the protrusion.

18. The product merchandizer system of claim 12, wherein the paddle is slidable on the shelf into and between an extended position proximate the front end of the shelf and a collapsed position proximate the rear end of the pusher assembly; and wherein the product merchandizer system further comprises a locking mechanism configured to retain the paddle in the collapsed position, the locking mechanism having a first portion on the paddle and a second portion on the housing, wherein the first portion is configured to be engaged with the second portion to retain the paddle in the collapsed position;

wherein a first one of the first portion and the second portion of the locking mechanism is configured as a cam and a second one of the first portion and the second portion of the locking mechanism is configured as a further spring; and wherein the further spring is configured to slide into engagement with the cam to retain the paddle in the collapsed position.

19. The product merchandizer system of claim 12, wherein the spring has a first end with a first diameter and a second end with a second diameter, and wherein the first diameter is less than the second diameter.

20. A product merchandizer system configured to be installed on a shelf, the product merchandizer system comprising:

a pusher assembly configured to push products with which the product merchandizer system is stocked toward a front end of the shelf; and at least one partition configured to project upwardly from the shelf;

wherein a horizontal bar is supported above a rear end of the shelf;

wherein the at least one partition comprises a rear end configured to be clipped to the horizontal bar and a front end configured to rest on the shelf at the front end of the shelf; and wherein the pusher assembly comprises:

a rear end configured to be clipped to the horizontal bar and a front end configured to rest on the shelf;

a paddle slidable on the shelf into and between an extended position proximate the front end of the shelf and a collapsed position proximate the rear end of the pusher assembly; and a locking mechanism having a first portion on the paddle and a second portion on the rear end of the pusher assembly, wherein the first portion is configured to be engaged with the second portion to retain the paddle in the collapsed position.

21. A product merchandizer system configured to be installed on a shelf, the product merchandizer system comprising:

a pusher assembly configured to push products with which the product merchandizer system is stocked toward a front end of the shelf, wherein the pusher assembly comprises:

a paddle at a front end of the pusher assembly, the paddle being configured to rest on the shelf;

a housing at a rear end of the pusher assembly;

a spring supported by the housing and configured to bias the paddle toward the front end of the shelf; and a series of links coupling the spring to the paddle;

wherein at least one link in the series of links is curved from a first end thereof to a second end thereof.

22. A product merchandizer system configured to be installed on a shelf, the product merchandizer system comprising:

a pusher assembly configured to push products with which the product merchandizer system is stocked toward a front end of the shelf, wherein the pusher assembly comprises:

a paddle at a front end of the pusher assembly, the paddle being configured to rest on the shelf;

a housing at a rear end of the pusher assembly;

a first spring supported by the housing and configured to bias the paddle toward the front end of the shelf; and a series of links coupling the first spring to the paddle;

wherein the paddle is slidable on the shelf into and between an extended position proximate the front end of the shelf and a collapsed position proximate the rear end of the pusher assembly;

wherein the product merchandizer system further comprises a locking mechanism configured to retain the paddle in the collapsed position, the locking mechanism having a first portion on the paddle and a second portion on the housing, wherein the first portion is configured to be engaged with the second portion to retain the paddle in the collapsed position;

wherein a first one of the first portion and the second portion of the locking mechanism is configured as a cam and a second one of the first portion and the second portion of the locking mechanism is configured as a second spring; and wherein the second spring is configured to slide into engagement with the cam to retain the paddle in the collapsed position.

* * * * *